US005772198A

United States Patent [19]

Yamamoto

[11] Patent Number: 5,772,198

[45] Date of Patent: Jun. 30, 1998

[54] STAPLING APPARATUS

[75] Inventor: Kazushi Yamamoto, Kitakatsuragi-gun, Japan

[73] Assignee: Sharp Kabushiki Kaisha, Osaka, Japan

[21] Appl. No.: 639,270

[22] Filed: Apr. 24, 1996

[30] Foreign Application Priority Data

Apr. 26, 1995 [JP] Japan ..... 7-102330

[51] Int. Cl.[6] ..... B65H 39/02

[52] U.S. Cl. ..... 270/58.12; 270/58.17; 270/58.27

[58] Field of Search ..... 270/58.08, 58.11, 270/58.12, 58.17, 58.27

[56] References Cited

U.S. PATENT DOCUMENTS

| | | | |
|---|---|---|---|
| 4,073,391 | 2/1978 | O'Brien et al. | 270/58.17 X |
| 4,134,672 | 1/1979 | Burlew et al. . | |
| 4,248,413 | 2/1981 | Fox | 270/58.17 |
| 5,344,131 | 9/1994 | Lawrence | 270/58.17 |

FOREIGN PATENT DOCUMENTS

| | | |
|---|---|---|
| 4-37592 | 2/1992 | Japan . |
| 4-148993 | 5/1992 | Japan . |
| 6-63075 | 7/1994 | Japan . |
| 6-63345 | 9/1994 | Japan . |

*Primary Examiner*—Hoang Nguyen
*Attorney, Agent, or Firm*—David G. Conlin; William J. Daley, Jr.

[57] ABSTRACT

It is an object of the invention to bind recording papers at a desired position, and produce a stapled sheaf of recording papers efficiently. The recording paper fed in the feeding direction by conveying rollers is held by a support plate so that a downstream end in the conveying direction thereof abuts against a predetermined gate projecting from a holding face of a support plate by a paddler. Mutually opposite ends parallel to the conveying direction are aligned by joggers. When a predetermined number of recording papers are held in stuck, upper and lower stapling units separately provided with the support plate between them are put in action, and a staple is driven from a surface of the recording paper. A tip portion of the staple projecting from the other surface of the recording paper is bent by a clinching member of the lower stapling unit. A stapled sheaf of recording papers is discharged in the discharging direction parallel to the feeding direction.

9 Claims, 53 Drawing Sheets

STAPLING APPARATUS

BACKGROUND OF THE INVENTION

1. Field of the Invention

The present invention relates to a stapling apparatus attached to, for example, a copying machine and such electronic devices as a printer for binding plural recording papers on which characters and images are recorded as a result of a predetermined process such as a copying process by the apparatus to which the stapling apparatus is attached.

2. Description of the Related Art

Conventional stapling apparatuses with upper and lower units integrated with each other are of so-called spectacles clinch and flat clinch types. Those of the spectacles clinch type are constructed in a manner similar to so-called staplers, and it is a problem that a stapled sheaf of recording papers cannot be smoothly handled, because a tip portion of a staple driven through the recording papers may project beyond the surface from which the staple was driven, when a relatively small number of recording papers are stapled, and the projecting parts of the staple may caught by each other. It is another problem that a staple is bulky in a bending portion thereof, in the case of saddle stitching, and reformation of folding the recording papers in a central part comes to be difficult in bookbinding.

On the other hand, those of the flat clinch type allows a tip portion of a staple driven through recording papers to be bent in such manner that the tip portion never projects beyond the surface of the uppermost recording paper against which a staple was driven (hereinafter described as drive surface), and a stapled sheaf of recording papers can be smoothly handled. For such reason, the flat clinch type is more widely applied in practice than the spectacles clinch type.

FIG. 51 is a side view showing a construction of a conventional stapling apparatus 301 of the flat clinch type. FIG. 52 is a plan view taken in a direction I of FIG. 51, and FIG. 53 is a front view taken in a direction II of FIG. 51. The stapling apparatus 301 is constructed by integrating an upper stapling unit 302 with a lower stapling unit 303. The upper stapling unit 302 comprises an upper main stapling member 304, a driving member 305 having an anvil member 306 and a staple containing member 307. The lower stapling unit 303 comprises a lower main stapling member 308 having a clinching member 309.

A staple is driven from one surface of a sheaf of recording papers to be bound by placing the sheaf of recording papers between the upper and lower stapling units 302 and 303, lowering the anvil member 306 so that the staple contained in the staple containing member 307 is bent into a U-shape, and forced out of the containing member. A tip portion of the staple projecting outside from the other surface of the sheaf of recording papers is bent as they abut against a clinching groove 310 in the clinching member 309. A stapled sheaf of recording papers is produced by binding the recording papers with the staple in such manner.

The upper and lower stapling units 302, 303 are driven by a driving motor 315 located in the lower main stapling member 308. In order to control operations of the anvil member 306 and clinching member 309, the upper and lower stapling units 302, 303 are integrally joined with each other by a support shaft 314 of a gear 311, so that they are pivoted about the support shaft 314. An output from the driving motor 315 is transmitted through plural gears 312, 316 to the gear 311. An encoder 313 reads a location of the lower stapling unit 303.

Such stapling apparatus with upper and lower stapling units integrated with each other is disclosed, for example, in Japanese Unexamined Patent Publications JPA 4-148993 and JPA 4-37592. The former shows a stapling apparatus allowing selection of a binding position in the direction orthogonal to a recording paper feed direction, and the latter provides a stapling apparatus allowing change of a position of binding recording papers by moving stapling units.

FIG. 54 is a side view showing a construction of a finishing apparatus 351 having a stapling apparatus similar to that described above with upper and lower units integrated with each other. The finishing apparatus 351 is used by attaching it to a copying machine 352. A recording paper discharged by discharge rollers 353, 354 of the copying machine 352 is conveyed in a direction 360 through a conveying path 359 by conveying rollers 355, 356; 357, 358 of the finishing apparatus 351. The recording paper is conveyed to an area below a paper Inlet, where a stapling apparatus 361 similar to that described above with the upper and lower units integrated with each other is placed, and bound by the stapling apparatus 361 to form a sheaf of recording papers. The sheaf of recording papers is pushed out by a pusher 362 provided in a downstream side in the recording paper conveying direction. Then, the sheaf of recording papers turned to a different direction in such manner is conveyed in a direction 368 through a conveying path 367 by conveying rollers 363, 364; 365, 366. The sheaf of recording papers is thereafter discharged to a paper tray 369 through a sheaf outlet positioned generally in a same level as that of the paper inlet.

FIG. 55 is a side view showing a construction of another finishing apparatus 370 having a stapling apparatus with upper and lower units integrated with each other. A recording paper discharged by discharge rollers 353, 354 of a copying machine 352 is generally horizontally conveyed by conveying rollers 371, 372 and a paddler 376 of the finishing apparatus 370. The recording paper is conveyed to an area where a stapling apparatus 374 with upper and lower units integrated with each other is placed, and bound by the stapling apparatus 374 to form a sheaf of recording papers. The sheaf of recording papers is pushed out by a pusher 375 located in a downstream side in the recording paper conveying direction. Then, the sheaf of recording papers turned to a different direction in such manner is conveyed in a direction 382 through a conveying path 381 by conveying rollers 377, 378; 379, 380. The sheaf of recording papers is thereafter discharged to a paper tray 383 through a sheaf outlet provided below a paper inlet.

FIG. 56 is a side view showing a construction of the stapling apparatus 321 of other prior art. The stapling apparatus 321 comprises an upper stapling unit 322 and a lower stapling unit 323 separated therefrom. The upper stapling unit 322 comprises an upper main stapling member 324, a driving member 325 and a staple containing member 327.

An output from a driving motor 328 is transmitted through plural gears 329 to 331, 338 to an attachment element 326 attached to the gear 331. The attachment element 326 is fixed through a guide plate 336 to an anvil member in the driving member 325 by means of a pin 335. When the driving motor 328 is operated, and the gear 331 is rotated, the attachment element 326 vertically moves along a guide groove 337 in the guide plate 336. As the attachment element 326 is lowered, a staple contained in the staple containing member 327 is bent into a U-shape, and forced out of the containing member. The lower stapling unit 323 comprises a lower main stapling member 332 having a clinching member 333 with a clinching groove 334 formed therein.

A staple is driven through recording papers to be bound together by placing the recording papers between the upper and lower stapling units 322, 323, and forcing the staple out as described above. A tip portion of the staple projecting from the recording papers is bent as the tip portion of the staple abuts against the clinching groove 334 in the clinching member 333. The recording papers are stapled in such manner to form a sheaf of recording papers.

Such stapling apparatus with upper and lower stapling units separated from each other is disclosed, for example, in Japanese Utility Model Publications JPU 6-53075 and JPU 6-63345.

In the finishing apparatuses 351, 370 of FIGS. 54 and 55 provided with a stapling apparatus similar to the stapling apparatus 301 as shown in FIGS. 51 to 53 with upper and lower units integrated with each other, mutually opposite directions are selected for feeding recording papers between the upper and lower stapling units 302, 303 and removing a bound sheaf of the recording papers. The discharging direction is selected so as to be orthogonal to the feeding direction. As a consequence, the recording paper conveying direction must be changed, and a conveying mechanism is, therefore, complex. In addition, recording papers to be stapled next can be fed only after the stapled sheaf of recording papers is completely removed, and an efficiency of producing sheaves of recording papers is low.

The upper and lower stapling units 302, 303 are pivoted about the pivot shaft 314, and accordingly when the number of recording papers placed between the upper and lower stapling units 302, 303 is increased, a staple is not driven orthogonally to a surface of the sheaf of recording papers to be bound, and a tip portion of the staple projecting from the other surface thereof cannot be bent, resulting in that the recording papers are not bound, or the stapled sheaf of recording papers is poor in appearance.

In the case of JPA 4-37592 described above, it is a problem that plural sheaves of recording papers are stapled in positions different from each other, and are poor in appearance, although tangling between staples of the sheaves is avoided, and the sheaves of recording papers can be smoothly conveyed, because they are stapled in different positions.

Such problems can be solved by using a stapling apparatus of separate type as shown in FIG. 56. In other words, since upper and lower stapling units are separated from each other, sheaves of recording papers can be discharged in the direction identical to the feeding direction thereof. Thus, it is not required to change the recording paper conveying direction, and a conveying mechanism can be simplified. Also, recording papers to be stapled next can be fed immediately after discharge of a stapled sheaf of recording papers is started, and the efficiency of producing stapled sheaves of recording papers Is increased. The recording papers are stapled securely in good appearance, because a staple is always driven orthogonally against one surface of the sheaf of recording papers to be stapled, and a tip portion of the staple projecting from the other surface of the sheaf of recording papers is bent without fail, even when the number of recording papers is increased.

SUMMARY OF THE INVENTION

It is an object of the invention to provide a stapling apparatus enabling simplification of a recording paper conveying mechanism, assuring a high efficiency of producing stapled sheaves of recording papers, and allowing a sheaf to be easily stapled at an arbitrary position of a surface of the sheaf of recording papers to be stapled.

The invention provides a stapling apparatus for producing a stapled sheaf of recording papers by stapling plural recording papers, the stapling apparatus comprising:

holding means for stacking and holding recording papers fed into a stapled sheaf production area for producing a stapled sheaf of recording papers, aligning means having a projecting piece angularly displaceable such that the projecting piece projects from a holding face of the holding means, recording paper conveying means for conveying the sheaf of the recording papers in such manner that the downstream end of the sheaf of the recording papers in the recording paper conveying direction abuts against the projecting piece projecting from the holding face of the holding means, stapling means including a driving-side stapling unit provided with a drive member for driving a staple from one surface of the sheaf of the plural recording papers held by the holding means and a bending-side stapling unit separated from the driving-side stapling unit and provided with a bending member for bending a tip portion of the driven staple, projecting outside from the other surface of the sheaf of the plural recording papers, discharge means for discharging the sheaf of the recording papers from the stapled sheaf production area in the discharging direction parallel to the feeding direction to the stapled sheaf production area, after the sheaf of the recording papers is stapled and the tip portion of the staple projecting outside from the other surface of the sheaf of the plural recording papers is bended, and control means for allowing the projecting piece to project from the holding face of the holding means at a predetermined alignment position selected from plural alignment positions preset in the stapled sheaf production area according to a distance between the downstream end of the sheaf of the recording papers in the recording paper conveying direction and a stapling position of the recording papers, activating the stapling means to bind a predetermined number of recording papers to produce a stapled sheaf when the predetermined number of recording papers are held by the holding means, and driving the discharge means.

According to the invention, the recording papers fed to the stapled sheaf production area are held by the holding means in such a manner that the downstream end of the recording papers in the recording paper conveying direction abutting against the projecting piece which projects from the holding face of the holding means. The projecting piece projects from the holding face at a predetermined alignment position selected from plural alignment positions preset in the stapled sheaf production area according to a distance between the downstream end of the recording paper and a stapling position of the recording paper. When a predetermined number of recording papers are held, the stapling means is put in action, a staple is driven from one surface of the sheaf of the recording papers, and a tip portion of the staple projecting outside from the other surface of the sheaf of the recording papers is bent so that a stapled sheaf of the recording papers is produced. The stapled sheaf of recording papers is discharged from the stapled sheaf production area in the discharging direction parallel to the direction of feeding to the stapled sheaf production area. At the time of such discharge, the projecting piece is angularly displaced so that it does not project from the holding face of the holding means.

Since the driving-side stapling unit and the bending-side stapling unit constituting the stapling means are separately provided, the feeding direction and the discharging direction can be selected to be parallel to each other, as described above. Thus, it is not required to change the recording paper conveying direction, and therefore a conveying mechanism is relatively simplified. Also, recording papers to be stapled next can be fed immediately after a stapled sheaf of recording papers begins to be discharged, and an efficiency of producing stapled sheaves of recording papers can be increased. Further, even when the number of recording papers is increased, as a staple can be always driven orthogonally to one surface of the sheaf of recording papers, and a tip portion of the staple projecting from the other surface of the sheaf of recording papers can be bent without fail, a stapled sheaf of recording papers is assuredly produced in a good appearance. The projecting piece may be provided, respectively, in plural alignment positions preset in the stapled sheaf production area, and a stapling position can be selected in the direction parallel to the recording paper conveying direction by allowing a projecting piece provided at a predetermined alignment position out of the plural projecting pieces to project from the holding face of the holding member.

Further, the invention is characterized in that:

the stapling means is provided at each of plural stapling positions preset in the direction orthogonal to the recording paper conveying direction, and the control means activates the stapling means provided at a position selected from the plurality of preset stapling positions, when a predetermined number of recording papers are held by the holding means.

According to the Invention, the stapling means is provided at each of plural stapling positions preset in the direction orthogonal to the recording paper conveying direction and the stapling means provided at a selected one from the plurality of preset stapling positions is put in action. Therefore, a stapling position can be selected in the direction orthogonal to the recording paper conveying direction.

Further, the invention is characterized in that:

the stapling apparatus further comprises driving means for moving the driving-side and bending-side stapling units of the stapling means in synchronization with each other in the direction orthogonal to the recording paper conveying direction, and when a predetermined number of recording papers are held by the holding means, the control means drives the driving means to move the stapling means to one selected from the plurality of stapling positions preset in the direction orthogonal to the recording paper conveying direction, and then activates the stapling means.

According to the invention, since the stapling means is moved in the direction orthogonal to the recording paper conveying direction with the driving-side and bending-side stapling units synchronized with each other, a stapling position can be selected in the direction orthogonal to the recording paper conveying direction.

Since the stapling means is movable in the direction orthogonal to the recording paper conveying direction, a stapling position can be selected in the direction orthogonal to the recording paper conveying direction, and only one stapling means is required, which can be moved by a general moving mechanism, resulting in lowered production cost of a stapling means. Furthermore, since supplement only to one driving-side stapling unit suffices, the ease of manipulation is increased in comparison with the case where plural driving-side stapling units are provided.

Further, the invention is characterized in that:

the stapling apparatus further comprises driving means for moving the stapling unit on one side of the bending side and the driving side of the stapling means, the stapling unit on the other side of the driving side and the bending side of the stapling means is provided in each of plural stapling positions preset in the direction orthogonal to the recording paper conveying direction, and when a predetermined number of recording papers are held by the holding means, the control means drives the driving means to move the staple unit on the one side to one stapling position selected from the plurality of preset stapling positions, and then activates the stapling unit on the one side and the stapling unit on the other side, provided at the selected stapling position.

According to the invention, the bending-side stapling unit is provided in each of the plural stapling positions, and the driving-side stapling unit is moved in the direction orthogonal to the recording paper conveying direction. Accordingly, a stapling position can be selected in the direction orthogonal to the recording paper conveying direction. Besides, refilling of staples is required only for the driving-side stapling unit, and therefore the controllability is increased.

On the contrary to the above, the driving-side stapling unit is provided in each of the plural stapling positions, respectively, and the bending-side stapling unit is moved in the direction orthogonal to the conveying direction. Therefore, a stapling position can be selected in the direction orthogonal to the conveying direction. Since the movable bending-side stapling unit is lighter in weight than the driving-side stapling unit, the force of inertia is lower, a lower driving force is enough, and the power consumption can be reduced in comparison with the case of moving the driving-side stapling unit.

The invention also provides a stapling apparatus for producing a stapled sheaf of recording papers by stapling plural recording papers, the stapling apparatus comprising:

holding means for stacking and holding recording papers fed to a stapled sheaf production area for producing a stapled sheaf of recording papers, a pair of alignment means movable in the direction orthogonal to the recording paper conveying direction for aligning the recording paper by abutting against mutually opposite ends parallel to the recording paper conveying direction, respectively, a staple unit comprising a driving-side stapling unit provided with a driving member for driving a staple to plural recording papers held by the holding means from one surface of the sheaf of the plural recording papers and a bending-side stapling unit provided separately from the driving-side stapling unit with a bending member for bending a tip portion of the driven staple projecting outside from the other surface of the sheaf of the plural recording papers, discharge means for discharging a stapled sheaf of the recording papers produced by driving the staple to the sheaf of the plural recording papers and bending the tip portion of the staple projecting outside from the other surface of the sheaf of the plural recording papers, from the stapled sheaf production area in the discharging direction parallel to the feeding direction to the stapled sheaf production area, and control means for allowing the pair of alignment means to abut against the mutually opposite ends parallel to the recording paper conveying direction every time when the recording paper is fed, moves the pair of alignment means by a predetermined length in a same direction, when a predetermined number of recording papers are held by the holding means, while alignment of the recording papers is maintained, then activating the stapling means so that the recording papers are stapled to form a stapled sheaf of recording papers, and driving the discharge means.

According to the invention, the recording papers fed to the stapled sheaf production area are aligned by abutting the pair of alignment means against mutually opposite ends parallel to the recording paper conveying direction and held by the holding means. The recording paper is aligned every time when each paper is fed. When a predetermined number of recording papers are aligned and held, the stapling means is put in action in a manner similar to the case described above, the recording papers are stapled, and a stapled sheaf of recording papers is produced. When the recording papers are stapled, the pair of alignment means is moved by a predetermined length in the same direction orthogonal to the recording paper conveying direction.

Accordingly, a stapling position can be selected in the direction orthogonal to the conveying direction. The stapled sheaf of recording papers is discharged in the discharging direction orthogonal to the conveying direction. Thus, since a stapling position can be selected only by controlling the movement of the pair of alignment means, a stapling apparatus can be constructed in a simple manner, and the production cost of the stapling apparatus is lowered.

The invention is characterized in that the control means moves the pair of alignment means by a predetermined length in a same direction every time when a stapled sheaf of recording papers is discharged.

According to the invention, the pair of alignment means is moved by a predetermined length in a same direction even when a stapled sheaf of recording papers is discharged. In such manner, overlapping of staples in sheaves of recording paper can be avoided between sheaves. Therefore, conveyance of the sheaves of recording paper is never obstructed due to tangling of staples, use of an expensive offset tray for a specific purpose is eliminated, and a smooth conveying operation can be achieved at a low cost.

The invention further provides a stapling apparatus for producing a stapled sheaf of recording papers by stapling plural recording papers, the stapling apparatus comprising:

holding means for stacking and holding recording papers fed to a stapled sheaf production area for producing a stapled sheaf of recording papers, stapling means comprising a driving-side stapling unit provided with a driving member for driving a staple to the sheaf of the plural recording papers held by the holding means from one surface of the sheaf of plural recording papers and a bending-side stapling unit provided separately from the driving-side stapling unit with a bending member for bending a tip portion of the driven staple projecting outside from the other surface of the sheaf of the plural recording papers, first driving means for moving the driving-side and bending-side stapling units of the stapling means in synchronization with each other in the direction parallel to the recording paper conveying direction, and control means for driving the first driving means to move the stapling means to a stapling position selected from plural stapling positions preset in the direction parallel to the recording paper conveying direction when a predetermined number of recording papers are held by the holding means, and then activating the stapling means so that the recording papers are stapled to form a stapled sheaf of recording papers.

According to the invention, the first driving means moves the driving-side and bending-side stapling units of the stapling means in synchronization with each other parallel to the recording paper conveying direction. Accordingly, a stapling position can be selected in the direction parallel to the conveying direction.

The invention is characterized in that:

the stapling apparatus further comprises second driving means for moving the driving-side and bending-side stapling units of the stapling means in synchronization with each other in the direction orthogonal to the recording paper conveying direction, and when a predetermined number of recording papers are held by the holding means, the control means drives the first and second driving means to move the stapling means to selected one from plural stapling positions preset according to a size of the recording paper surface, and then activates the stapling means.

According to the invention, the second driving means is provided in addition to the first driving means, and the second driving means moves the driving-side and bending-side stapling units of the stapling means in synchronization with each other in the direction orthogonal to the recording paper conveying direction. Accordingly, the stapling means is movable in the direction parallel and orthogonal to the recording paper conveying direction, and a stapling position can be arbitrarily selected in an entire surface of the recording paper.

The invention still further provides a stapling apparatus for producing a stapled sheaf of recording papers by stapling plural recording papers comprising:

holding means inclined to the horizontal direction by a predetermined angle for stacking and holding recording papers fed to a stapled sheaf production area for producing a stapled sheaf of recording papers, a projecting piece positioned orthogonal to a holding face of the holding means in a lower side of the holding means and movable to be closer to and apart from the holding face of the holding means, stapling means comprising a driving-side stapling unit provided with a driving member for driving a staple to the plural recording papers held by the holding means from one surface of the sheaf of plural recording papers and a bending-side stapling unit provided separately from the driving-side stapling unit with a bending member for bending a tip portion of the driven staple projecting outside from the other surface of the sheaf of the plural recording papers, and control means for moving the projecting piece closer to the holding face of the holding member, activating the stapling means so that the recording papers are stapled to form a stapled sheaf of recording papers when a predetermined number of recording papers are held by the holding member, and moving the projecting piece apart from the holding face of the holding means.

According to the invention, the recording paper fed to the stapled sheaf production area for producing a stapled sheaf of recording papers is held by the holding face of the holding means inclined to the horizontal direction by a predetermined angle. In such operation, the recording paper is held so as to abuts against the projecting piece positioned orthogonal to the holding means in the vicinity of the holding face in a lower side of the holding means. When a predetermined number of recording papers are held by the holding means, the stapling means is put in action, and the recording paper are stapled to form a stapled sheaf of recording papers. After the stapled sheaf of recording papers is produced, the projecting piece is moved apart from the holding face of the holding means, and the stapled sheaf of recording papers falls downward by its own weight, and is discharged from the stapled sheaf production area.

By positioning the holding means to be inclined, the stapled sheaf of recording papers falls by its own weight for discharge, and therefore the above-described discharge means is not required. Accordingly, a stapling apparatus can be constructed in a simple manner. Since space for a conveying system for sheaves of recording paper is effectively used, a conveying system can be achieved in a smaller space. Furthermore, since the recording papers to be stapled next can be fed immediately after a stapled sheaf of recording papers is discharged, conveying time is reduced, and a stapled sheaf of recording papers can be efficiently produced.

The invention is characterized in that:

the holding means is arranged to be inclined so that an end of the holding means corresponding to the upstream side in the recording paper feeding direction is located in a lower level, and the stapling apparatus further comprises conveying direction reversing means for reversing the conveying direction for conveying the recording paper so that an upstream end in the recording paper feeding direction abuts against the projecting piece in the vicinity of the holding face of the holding means.

According to the invention, the holding means is positioned to be inclined so that an end of the holding means corresponding to the upstream side in the feeding direction of recording paper is located in a lower level. The fed recording paper is conveyed in the reversed conveying direction so that an upstream end in the recording paper feeding direction abuts against the projecting piece projecting from the holding face, and held by the holding means. By reversing the conveying direction, a length of the apparatus parallel to the recording paper feeding direction is reduced, and an apparatus can be constructed in a compact manner.

The invention is characterized in that:

the stapling apparatus further comprises a belt to which a projecting piece of the alignment means and a projecting piece of the discharge means are attached, located in the side opposite to the holding face of the holding means, and plural rollers about which the belt is wound, the projecting piece of the discharge means is angularly displaceable so as to project from the holding face of the holding means, and the control means drives the rollers so that one of the projecting pieces is positioned so as to project from the holding face of the holding means at a predetermined alignment position, activates the stapling means to form a stapled sheaf of recording papers when a predetermined number of recording papers are held by the holding means, activates the rollers again to allow a projecting piece different from that placed at the alignment position to abut against an upstream end in the conveying direction of the stapled sheaf of recording papers after the stapled sheaf of recording papers is produced, and pushes the stapled sheaf of recording papers for discharging.

According to the invention, the conveying means has a projecting piece similar to that of the alignment means. The projecting piece of the alignment means and the projecting piece of the conveying means are attached to a belt located in the side opposite to the holding face of the holding means. By driving rollers wound about by the belt, one of the projecting piece is so positioned that it projects from the holding face at a predetermined alignment position. The projecting piece serves for aligning a downstream end in the recording paper conveying direction. After a stapled sheaf of recording papers is produced in a similar manner to that described above, the rollers are driven again, and a projecting piece different from that placed at the alignment position abuts against the upstream end in the feeding direction of the sheaf of the recording papers, and pushes the sheaf of the recording papers for discharging. The projecting piece functions as a pusher.

It is not required, therefore, to specifically provide discharge means, and a stapling apparatus can be constructed in a simple manner. Conveying operation of recording paper and a sheaf of recording papers can be also controlled easily. Further, since recording papers to be stapled next can be fed immediately after a stapled sheaf of recording papers is discharged, a stapled sheaf of recording papers can be produced efficiently. By changing a stop position of the belt, a stapling position can also be selected.

The invention is still characterized in that:

the holding means includes a belt having plural through holes to which the projecting piece of the alignment means is attached and plural rollers about which the belt is wound, the discharge means includes air sucking means placed in a space inside the belt wound about the plural rollers for sucking the air outside the belt through the plural through holes in the belt, and the control means drives and positions the rollers so that the projecting piece projects from the holding face of the holding means at a predetermined alignment position, activates the stapling means so that a predetermined number of recording papers are stapled to form a stapled sheaf of the recording papers when the predetermined number of recording papers are held by the holding means, and then activates the air sucking means, while driving the roller again.

According to the invention, the holding means includes a belt having plural through holes to which a projecting piece of the alignment means is attached and plural rollers about which the belt is wound. The conveying means includes air sucking means placed in a space inside the belt wound about the plural rollers for sucking the air outside the belt through the plural through holes. By driving the rollers about which the belt is wound, the projecting piece of the alignment means is positioned so as to project from the holding face of the holding means in a predetermined alignment position. After a stapled sheaf of recording papers is produced in a manner similar to that described above, the projecting piece and the rollers are driven, and the sheaf of recording papers is discharged by being suctioned against the belt.

Accordingly, the belt can be constructed in a simple manner. Conveying operation of recording paper and a sheaf of recording papers is also controlled simply. Further, since recording papers to be stapled next can be fed immediately after a stapled sheaf of recording papers is discharged, efficiently producing a stapled sheaf of recording papers can be attained. By changing a stop position of the belt, a stapling position can also be selected.

BRIEF DESCRIPTION OF THE DRAWINGS

Other and further objects, features, and advantages of the invention will be more explicit from the following detailed description taken with reference to the drawings wherein.

DETAILED DESCRIPTION OF PREFERRED EMBODIMENTS

Figure 1A:
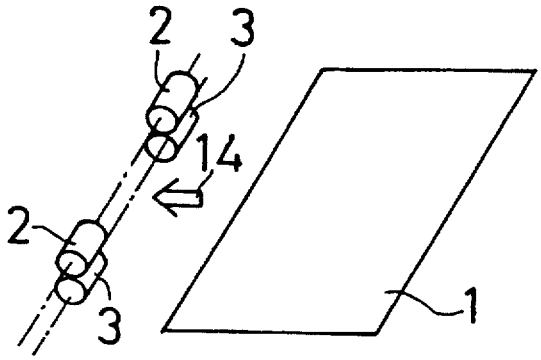
FIGS. 1A to 1C are schematic views for explaining basic operations of a stapling apparatus of the invention in steps.

Now referring to the drawings, preferred embodiments of the invention are described below.

Figure 1B:
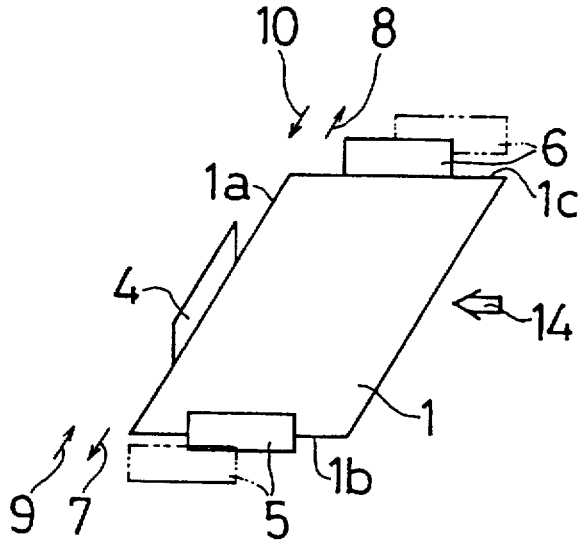
Figure 1C:
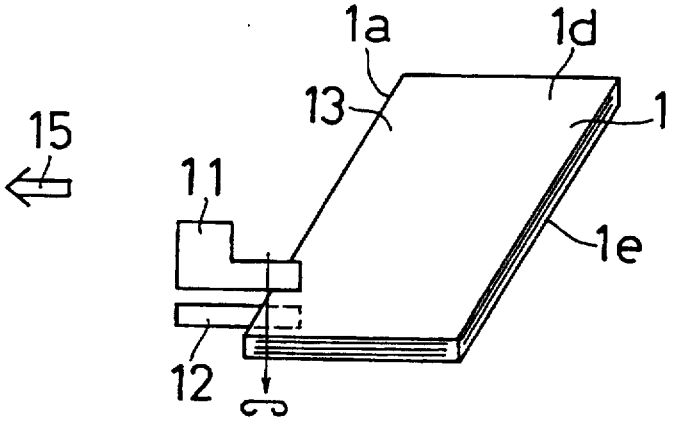

FIGS. 1A to 1C are schematic drawings for explaining basic operations of a stapling apparatus of the invention in steps. The stapling apparatus is used by being attached, for example, to a copying machine, and binds plural recording papers on which characters and images are recorded by a copying process in the copying machine.

A recording paper 1 is fed in the feeding direction 14 to a stapled sheaf production area for producing a stapled sheaf of recording papers by a pair of conveying rollers 2, 3 provided in a conveying path, as shown in FIG. 1A. The recording paper 1 fed to the stapled sheaf production area is aligned so that a downstream end 1*a* of the recording paper 1, orthogonal to a recording paper conveying direction, abuts against a gate 4 shown in FIG. 1B, and mutually opposite ends 1*b*, 1*c* of the recording paper 1 parallel to the conveying direction abut against joggers 5, 6, respectively, which are moved apart from each other in directions 7, 8 and toward each other in directions 9, 10, and the recording papers 1 conveyed sequentially one after another are stacked and held by holding means provided in the stapling apparatus.

A predetermined number of recording papers of the recording papers 1 aligned and held are stapled by an upper stapling unit 11 having a driving member for driving a staple from one surface 1*d* of the plural recording papers 1 and a lower stapling unit 12 having a clinching member for bending a tip portion of the driven staple projecting outside from the other surface 1*e* of the sheaf of the plural recording papers 1, and provided separately from the upper stapling unit 11. A stapled sheaf of recording papers 13 formed by stapling the plural recording papers 1 is discharged from the stapled sheaf production area in the discharging direction 15 parallel to the feeding direction 14 to the stapled sheaf production area.

Figure 2A:
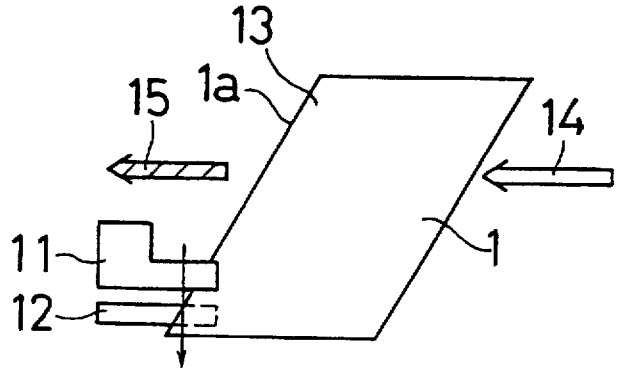
FIGS. 2A and 2B are schematic views for explaining operations of a stapling apparatus of the invention in comparison with those of a stapling apparatus of prior art.
Figure 2B:
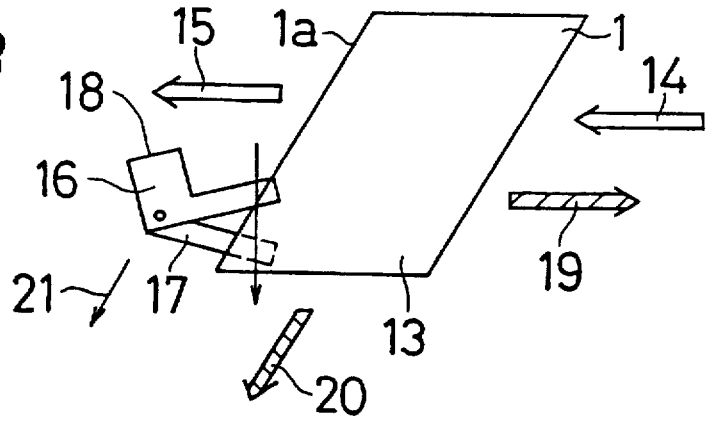
FIG. 2B (PRIOR ART)
Figure 3A:
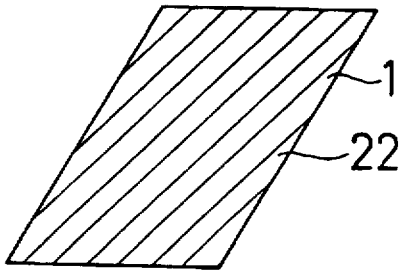
FIGS. 3A and 3B are perspective views showing an area of a recording paper 1 in which a staple can be driven.
Figure 3B:
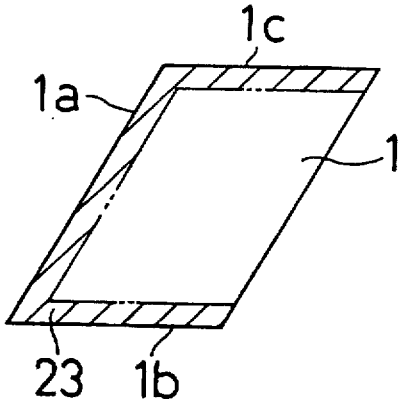

FIGS. 2A and 2B are schematic drawings for explaining operations of the stapling apparatus according to the invention in comparison with those of a stapling apparatus of prior art, and FIGS. 3A and 3B are perspective views showing an area (defined by shading) of the recording paper 1 in which a staple can be driven. As shown in FIG. 2A, in the stapling apparatus according to the invention, the upper and lower stapling units 11, 12 are separately provided, and a gap is formed between the upper and lower stapling units 11, 12. The stapled sheaf of recording papers 13 can be, therefore, discharged in the discharging direction 15 parallel to the feeding direction 14 of the recording paper 1.

The stapling apparatus of prior art shown in FIG. 2B has stapling means 18 into which an upper stapling unit 16 and a lower stapling unit 17 are integrated. In the case such stapling means 18 is so positioned that the recording paper 1 is placed between the units from the side of the downstream end 1*a* in the conveying direction, the sheaf of recording papers 13 cannot be discharged in the discharging direction 15 parallel to the feeding direction 14 as described below without moving the stapling means 18, and it is required to discharge the sheaf in the discharging direction 19 opposite to the feeding direction 14 or the discharging direction 20 orthogonal to the feeding direction 14. Therefore, the rotating direction of conveying roller must be changed, or a conveying rollers for discharge rotating in the direction different from conveying rollers for feeding must be provided, and control of the conveying rollers and conveying mechanism come to be complicated. In order to achieve the discharging direction 15 parallel to the feeding direction 14, similarly to the case of the stapling apparatus according to the invention, it is required to move the stapling means 18, for example, in the retracting direction 21 shown in the figure, and arrangement in the vicinity of the stapling means is complex.

In the stapling apparatus according to the invention, since the discharging direction 15 is parallel to the feeding direction 14, it is not required to change the rotating direction of conveying rollers, control of the conveying rollers are simple, and a conveying mechanism is also simplified.

In the stapling apparatus of prior art, in discharging the sheaf of recording papers 13 in the discharging directions 19, 20, recording papers 1 to be stapled next can be fed only after the sheaf of recording papers 13 has been completely discharged. In the stapling apparatus according to the invention, however, since the discharging direction 15 is parallel to the feeding direction 14, as described above, feeding of recording papers 1 to be stapled next can be started immediately after discharge of the sheaf of recording papers 13 is started. Therefore, the conveying time is reduced, and an efficiency of producing a stapled sheaf of recording papers 13 can be increased.

When a stapling apparatus with the feeding direction selected oppositely to the discharging direction as described is attached to a copying machine capable of producing 60 copies a minute, for stapling every two recording papers discharged from the copying paper, the copying speed of the copying machine must be reduced to 30 copies/min. To the contrary, when the stapling apparatus according to the invention is attached to a similar copying machine, every two recording papers can be stapled, while the copying speed of the copying machine is maintained approximately at 60 copies/min.

In the stapling apparatus according to the invention, a staple can be driven in an area 22 shown by shading in FIG. 3A, that is, an entire area of the recording paper 1. Therefore, according to contents printed on the recording paper, for example, any binding method of left binding (Western binding) for binding a left end, right binding (Japanese binding) for binding a right end and center binding (saddle stitching) for binding the recording paper 1 in a central part thereof can be allowed. On the other hand, in the stapling apparatus of prior art, a staple can be driven only in an area 23 shown by shading in FIG. 3B, that is, in a vicinity of a downstream end 1*a* in the conveying direction of the recording paper 1 and two sides adjacent to the end 1*a*, that is, in the vicinity of ends 1*b*, 1*c*. Thus, the recording paper 1 cannot be bound in a vicinity of its center, and the center binding method employed for weekly magazines, photographic magazines, catalog magazines and the like is unachievable.

As described, with the stapling apparatus of the invention, plural recording papers 1 can be bound at an arbitrary position, and an efficiency of producing the stapled sheaf of recording papers 13 is increased. Embodiments of the invention are described below in detail.

Figure 4:
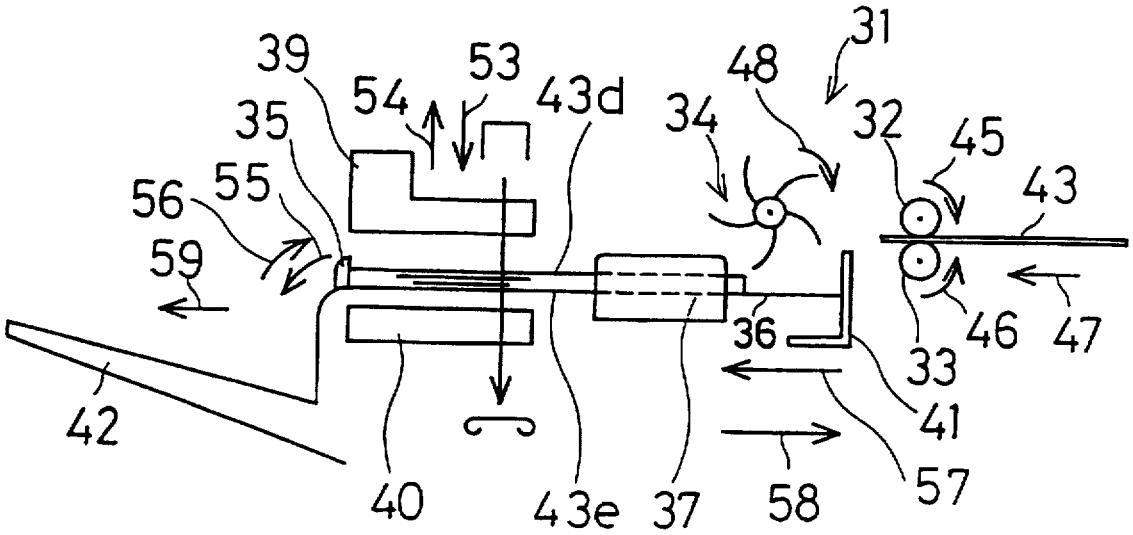
FIG. 4 is a side view showing a construction of a stapling apparatus 31 of a first embodiment of the invention.
Figure 5:
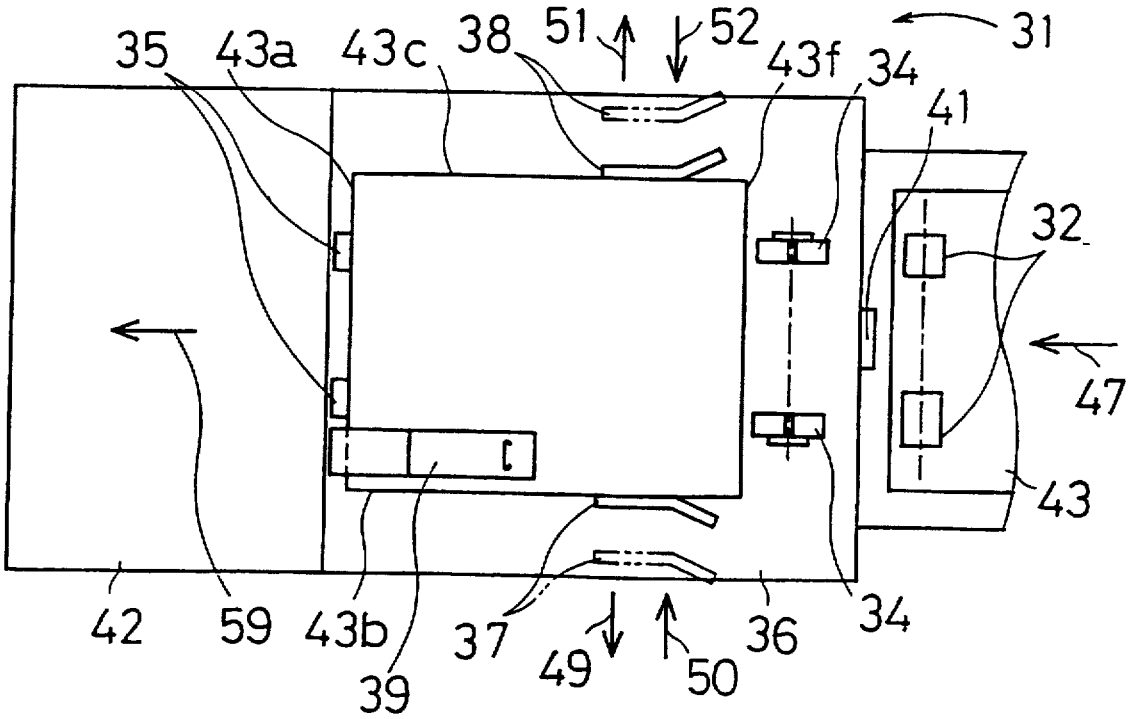
FIG. 5 is a plan view of a stapling apparatus 31.

FIG. 4 is a side view showing a construction of a stapling apparatus of a first embodiment of the invention, and FIG. 5 is a plan view of the same. The stapling apparatus 31 comprises conveying rollers 32, 33, paddler 34, gate 35, support plate 36, joggers 37, 38, upper stapling unit 39, lower stapling unit 40 and pusher 41.

Recording paper 43 subjected to a copying process by a copying machine with the stapling apparatus 31 attached thereto is conveyed along a predetermined conveying path. A pair of conveying rollers 32, 33 provided in the conveying path are rotated in directions 45, 46, respectively, and feed it to a stapled sheaf production area for producing a stapled sheaf of recording papers by clinching the recording paper 43, and conveying it in the feeding direction 47.

The support plate 36 holds the fed recording paper 43. Here, the recording paper 43 is held so that a downstream end 43*a* thereof, orthogonal to the conveying direction abuts against the gate 35 projecting from a holding face of the support plate 36. The paddler 34 is a conveying roller for conveying the recording paper 43 by applying a conveying force sufficiently low to buckling of the recording paper 43, and the recording paper 43 provided with an appropriate conveying speed by the paddler 34 is forced against the gate 35 in an end thereof 43*a*. In such manner, the end 43*a* of the recording paper 43 is aligned. The joggers 37, 38 serve for aligning mutually opposite ends 43*b*, 43*c* paper parallel to the conveying direction of the recording paper 43, respectively. The joggers 37, 38 are movable orthogonally to the conveying direction of the recording paper 43 apart from each other in directions 49, 51 and toward each other in directions 50, 52, respectively. As the joggers 37, 38 are moved toward each other in the directions 50, 52, the ends 43*b*, 43*c* of the recording paper 43 are aligned.

Once a predetermined number of recording papers 43 are stacked and held on the support plate 36, plural recording papers 43 are bound, and a stapled sheaf of recording papers is produced. The upper and lower stapling units 39, 40 are located vertically with the support plate 36 between them. The upper stapling unit 39, for example, comprises a driving member for driving a staple bent in a U-shape by an anvil member from one surface 43*d* of the hold plural recording papers 43. The lower stapling unit 40 comprises a clinching member for bending a tip portion of the staple projecting outside from the other surface 43*e* of the sheaf of the plural recording papers 43.

By lowering the upper stapling unit 39 toward the lower stapling unit 40 in the direction 53, for example, the plural recording papers 43 are clinched by the upper and lower stapling units 39, 40 to prevent displacement, a staple is driven by the driving member, and a tip portion of the driven staple is bent by the clinching member in the direction orthogonal to the driving direction. After the staple is driven and bent, the upper stapling unit 39 is lifted apart from the lower stapling unit 40 in the direction 54.

A stapled sheaf of recording papers produced in such manner is discharged to a discharge tray 42. Here, the gate 35 is angularly displaced in the direction 55 so that it does not project from the holding face of the support plate 36. The pusher 41 is moved in the direction 57, and pushes the sheaf of recording papers from an upstream end 43*f* in the conveying direction of the recording paper 43. By such operation, the sheaf of recording papers is discharged from the stapled sheaf production area in the discharging direction 59 parallel to the feeding direction 47. After the sheaf of recording papers is discharged, the gate 35 is angularly displaced in the direction 56 opposite to the direction 55, and projects again from the holding face of the support plate 36, and the pusher 41 Is moved in the direction 58, and returns to a predetermined home position.

Figure 6:
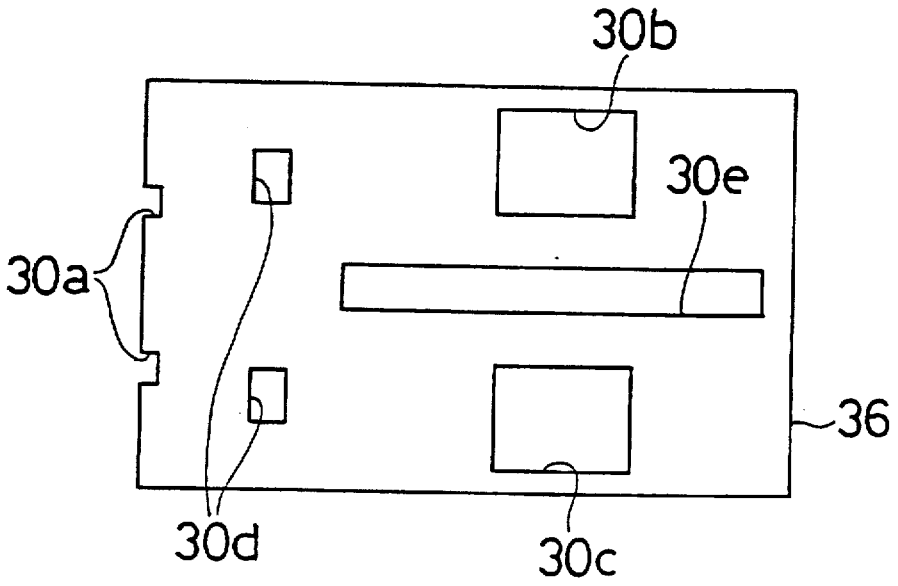
FIG. 6 is a plan view of a support plate 36.

FIG. 6 is a plan view showing the support plate 36. The support plate 36 is provided with a cutout 30*a* for attachment of the gate 35, windows 30*b*, 30*c* for movement of the joggers 37, 38, window 30*d* for binding the recording paper 43 by the upper and lower stapling units 39, 40 and window 30*e* for movement of the pusher 41, respectively. The cutout 30*a* is formed in a side surface of the support plate 36 in a downstream side in the conveying direction of the recording paper 43.

Figure 7:
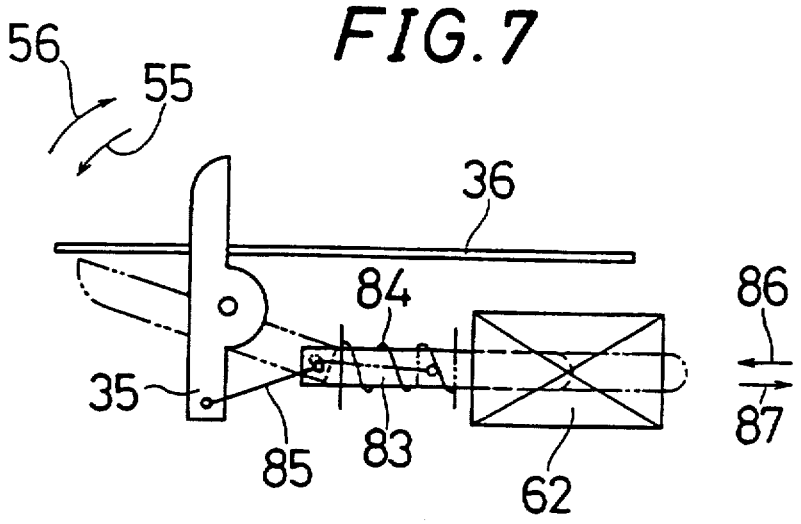
FIG. 7 is a side view for explaining an example of operation principles of a gate 35.

FIG. 7 is a side view for explaining an example of operating principles of the gate 35. The gate 35 is joined by a link 85 with an operative element 83 moved in directions 86, 87 by a solenoid 62. The operative element 83 is biased by a spring 84 so that it is at such position as shown in a solid line that the gate 35 projects from the holding face of the support plate 36, when the solenoid 62 is de-energized, and at such position as shown by a two-dot long and two short dashes line that the gate does not project from the holding face of the support plate 36, when it is energized. Therefore, the gate 35 is angularly displaced in the direction 55 to an open position, when the solenoid 62 is turned "on", and energized, and the gate 35 is angularly displaced in the direction 56 to a closed position, when the solenoid 62 is turned "off", and deenergized. The operating principle of the gate 35 is not limited to that described above, and the gate can be opened and closed also by other methods.

Figure 8:
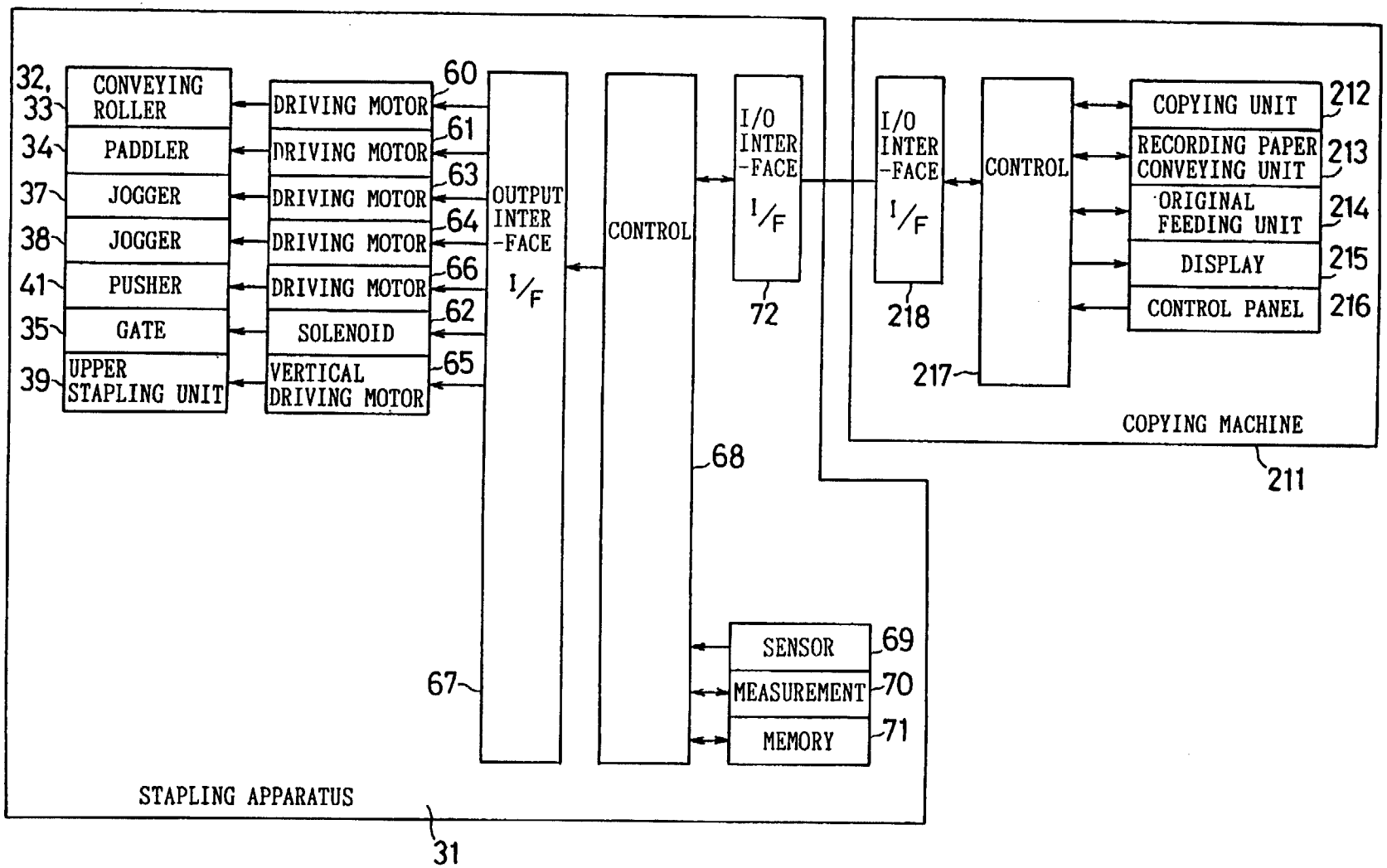
FIG. 8 is a block diagram showing an electrical structure of the stapling apparatus 31.

FIG. 8 is a block diagram showing an electrical structure of the stapling apparatus 31. The stapling apparatus 31 comprises a driving motor 60 for driving the conveying rollers 32, 33, driving motors 61, 63, 64 and 66 for driving the paddler 34, the jogger 37, the jogger 38 and the pusher 41, respectively, a solenoid 62 for driving the gate 35, a vertical driving motor 65 for driving an upper stapling unit 39, which have been already described, a control circuit 68 for controlling the operations of the driving motors 60, 61, 63 to 66 and the solenoid 62, a sensor 69, a measuring circuit 70, a memory circuit 71, an output interface (I/F) circuit 67, and an input/output interface (I/F) circuit 72.

Control signals for controlling operations of the driving motors 60, 61, 63 to 66 and solenoid 62 from the control circuit 68 achieved, for example, by a central processing unit (CPU) are applied through the output interface circuit 67 to the driving motors 60, 61, 63 to 66 and solenoid 62, respectively. The sensor 69 detects such state of the members as positioning. When the upper stapling unit 39 is lowered to a predetermined position, for example, the sensor 69 is turned "on". The control circuit 68 instructs the upper and lower stapling units 39, 40 to initiate the staple driving operation according to a result of detection by the sensor 69. In such manner, timings for initiating and discontinuing operation of the driving motors 60, 61, 63 to 66 and solenoid 62 can be determined according to a result of detection by the sensor 69.

The control circuit 68 is also capable of determining the timings for initiating and discontinuing operation of the driving motors 60, 61, 63 to 66 and solenoid 62 according to a result of measurement by the measuring circuit 70. For example, time required for producing a stapled sheaf of recording papers by such sequential operation of lowering the upper stapling unit 39, driving a staple to the recording paper 43, bending the tip portion of the staple and lifting the upper stapling unit 39 is preset, and measurement of time is started as soon as the upper and lower stapling units 39, 40 are put in action. When the preset time is elapsed, it is determined that the operation is completed, and a stapled sheaf of recording papers is produced, and execution of an operation for discharging the produced sheaf of recording papers is subsequently instructed.

The memory circuit 71 is achieved, for example, by ROM (read only memory) and RAM (random access memory). In the memory circuit 71, an operating program of the entire stapling apparatus 31 is stored, and such data required for producing a stapled sheaf of recording papers input from a copying machine 211 to which the stapling apparatus is attached as number of recording papers for a sheaf of recording papers, copies (books) of the sheaf and stapling position can also be stored. Such data from the copying machine 211 and that to the copying machine 211 are inputted/outputted through the input/output interface circuit 72.

The copying machine 211 to which the stapling apparatus 31 is attached comprises a control circuit 217 for controlling operations of the entire copying machine 211, copying unit 212, recording paper conveying unit 213, original feeding unit 214, display means 215, control panel 216 and input/output interface (I/F) circuit 218.

The copying unit 212 is for reading an image in an original placed on a predetermined image reading section, and copying it to the recording paper, and comprises an exposure lamp for reading the image, optical system including a reflecting mirror and a zoom lens, developing unit for forming a toner image from the image read, and fixing the toner image to a predetermined recording paper, corona discharger for image transfer and fixing unit.

The recording paper conveying unit 213 comprises plural cassettes for containing recording paper of different sizes by paper size, feed rollers, conveying rollers for conveying the recording paper after copying process is completed and the like. The original feeding unit 214 is for conveying originals sequentially to the image reading section, and comprises an original containing mechanism, original feeding mechanism and the like. Such original feeding unit 214 is removable from the copying machine 211, and an operator can place originals to the image reading section one after another for taking copies, in the case the unit is removed. In the embodiment, copies are taken with the original feeding unit 214 attached to the copying machine.

The display means 215 is achieved, for example, by a liquid crystal display, and indicates whether copies can be taken or not. For example, it indicates presence or absence of paper jam and location of such paper jam. In the case of the embodiment, it is indicated that the stapling apparatus 31 is attached for a process of binding the recording papers 43.

The control panel 216 comprises selection keys for selecting whether the image read should be copied to only one side of the recording paper or both sides thereof. An operator can select desired copying conditions through the control panel 216. In the case the stapling apparatus 31 is attached as shown in the embodiment, the number of recording papers for a sheaf and copies of the sheaf are inputted. A stapling position is also selected. Such data required for producing a stapled sheaf of recording papers is outputted through the input/output interface circuit 218 to the stapling apparatus 31. Data from the stapling apparatus 31 is also inputted through the input/output interface circuit 218.

Figure 9:
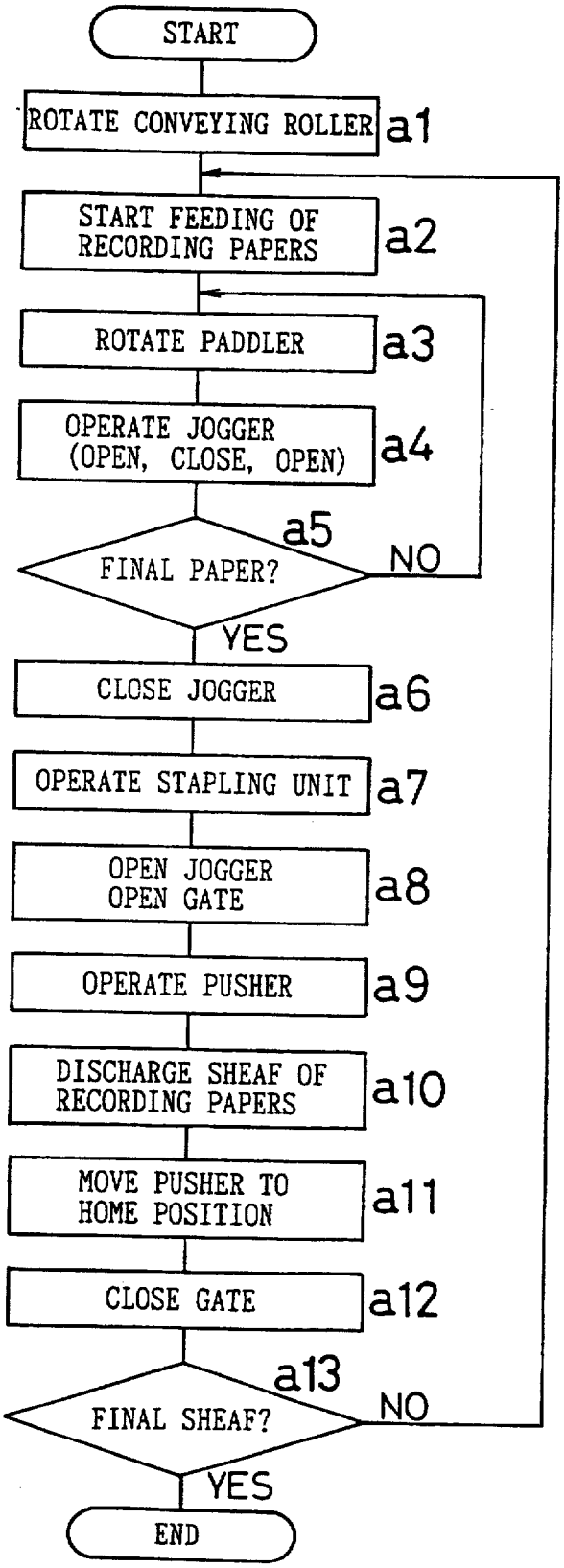
FIG. 9 is a flowchart showing operations of the stapling apparatus 31.

FIG. 9 is a flowchart showing operations of the stapling apparatus 31. FIGS. 10A to 10D are side views showing operations of the stapling apparatus 31 in steps. First, the number of recording papers for a sheaf of recording papers and copies of the sheaf are inputted through the control panel 216 of the copying machine 211. The solenoid 62 is turned "off", and de-energized, and the gate 35 is in the closed state, projecting from the holding face of the support plate 36.

In step a1, the conveying rollers 32, 33 start rotating in the directions 45, 46. This is accomplished in response to an output from a discharge sensor indicating presence of recording paper in the copying machine 211 which has been subjected to a predetermined copying sequence, and should be discharged. In step a2, feeding of the recording paper 43 discharged after being subjected to the predetermined copying sequence in the copying machine 211 is initiated. The recording paper 43 is clinched by the conveying rollers 32, 33, and fed in the feeding direction 47 shown in FIG. 10A.

In step a3, the paddler 34 starts rotating in the direction 48. The paddler 34 is for giving an appropriate conveying speed to the recording paper 43, as described above, and allowing a downstream end 43*a* in the conveying direction thereof to abut against the gate 35 which is in a projecting state. A plurality of rubber fins 34*b*, for example, are formed on a surface of the roller 34*a*.

In step a4, the joggers 37, 38 are put in action. In FIG. 5, first, the joggers 37, 38 are moved apart from each other in the directions 49, 51, and only one of the recording papers 43 is fed in such state (open state). As soon as the recording paper 43 is fed, the joggers 37, 38 are moved toward each other in the directions 50, 52 to be in a closed state, and the ends 43*b*, 43*c* parallel in the conveying direction of the recording paper 43 are aligned. After such alignment, the joggers 37, 38 are moved apart from each other in the directions 49, 51 again to be in the open state.

In step a5, it is determined whether the fed particular recording paper 43 is a final one or not, and step a6 is executed, if it is final, while the steps are repeated from the step a3, if it is not final. The determination whether it is final or not may be based on the number of recording papers for a sheaf of recording papers inputted through the control panel 216 of the copying machine 211, or on an output from a completion sensor for sensing the completion of feeding cycle of a set of originals, if the original feeding unit 214 of the copying machine 211 is provided with such sensor. The completion sensor detects that a complete set of originals contained in the original containing mechanism of the original feeding unit 214 has been fed.

Figure 10A:
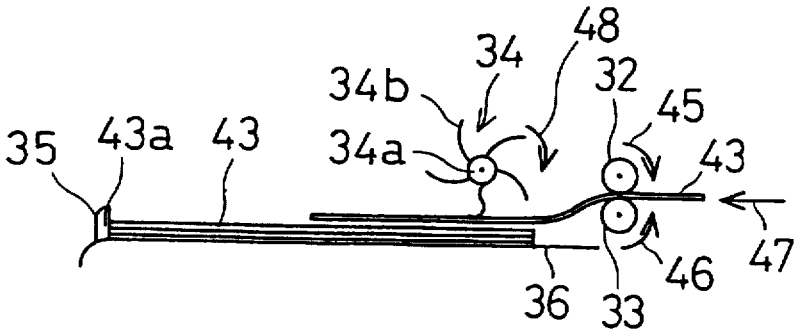
FIGS. 10A to 10D are side views showing operations of the stapling apparatus 31 in steps.
Figure 10B:
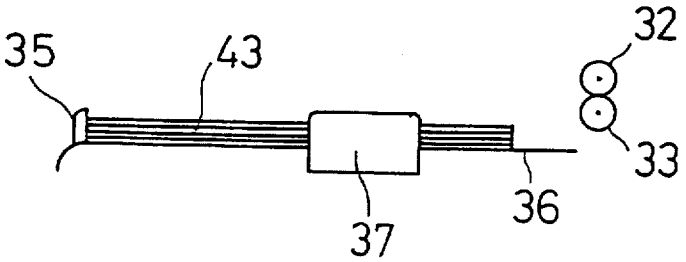
Figure 10C:
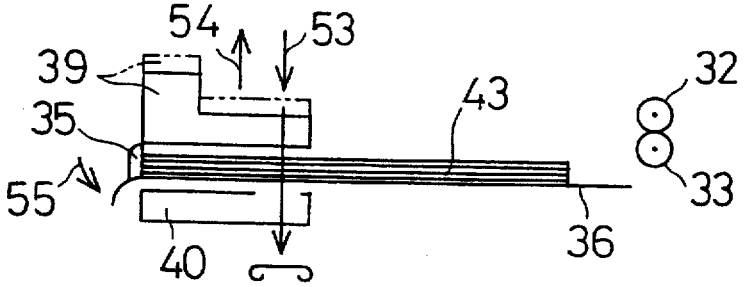

In step a6, the joggers 37, 38 are moved toward each other in the directions 50, 52 to be in the closed state. After a predetermined number of recording papers 43 are aligned and held, as shown in FIG. 10B, in step a7, the stapling units 39, 40 are put in action. That is, as shown in FIG. 10C, the upper stapling unit 39 is lowered in the direction 53, secures the plural recording papers 43 by clinching them in cooperation with the lower stapling unit 40 to avoid misalignment, drives a staple, and bends a tip portion thereof. After the driving and bending operation of the staple is completed, the upper stapling unit 39 is lifted in the direction 54.

In step a8, the joggers 37, 38 are moved apart from each other in the directions 49, 51 to be in the open state, the solenoid 62 is turned "on", and energized, the gate 35 is angularly displaced in the direction 55 to be in the open state, and a stapled sheaf of recording papers 44 can be discharged.

Figure 10D:
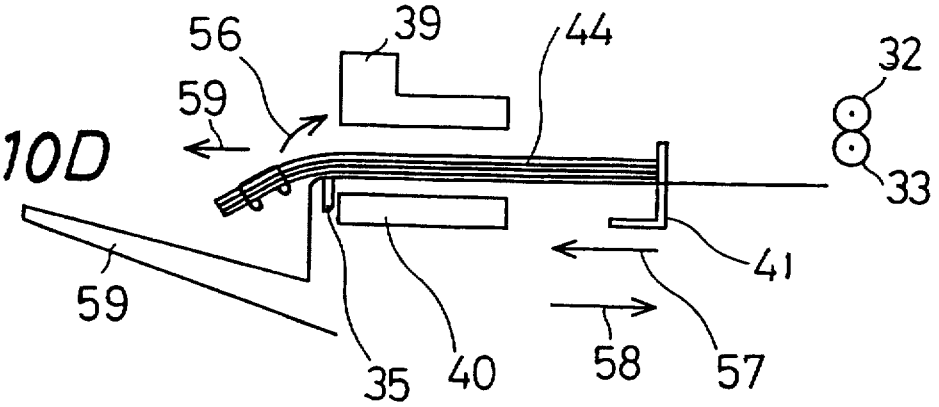

In step a9, the pusher 41 is put in action, and moved in the direction 57. In step a10, the stapled sheaf of recording papers 44 is discharged to the discharge tray 59, as shown in FIG. 10D. The discharging direction 59 of the sheaf of recording papers 44 pushed by the pusher 41 is parallel to the feeding direction 47. In step a11, the pusher 41 is moved in the direction 58 opposite to the direction 57 of pushing the sheaf of recording papers 44, and positioned at a predetermined home position. In step a12, the solenoid 62 is turned "off", and the gate 35 is angularly displaced in the direction 56 opposite to the direction 55, and returns to the closed state, projecting from the holding face of the support plate 36.

In step a13, it is determined whether the particular sheaf of recording papers 44 is a final set (copy) or not, that is, whether a predetermined number of copies have been produced. The operation is discontinued, if it is a final set, and the predetermined number of copies have been produced, and the steps are repeated from the step a2, if the predetermined number of copies have not been produced.

As described above, according to the first embodiment, since the stapled sheaf of recording papers 44 can be discharged in the discharging direction 59 parallel to the feeding direction 47 of the recording paper 43, no complex conveying mechanism is required for switching between the conveying directions. Additionally, since the feeding and discharging directions are parallel to each other, the recording papers 43 to be stapled next can be fed immediately after discharge of the sheaf of recording papers 44 from the stapled sheaf proceeding area is started. Thus, the stapled sheaf of recording papers 44 can be produced without reducing a copying capacity of the copying machine 211, and an efficiency for producing the stapled sheaf of recording papers 44 is increased.

Figure 11:
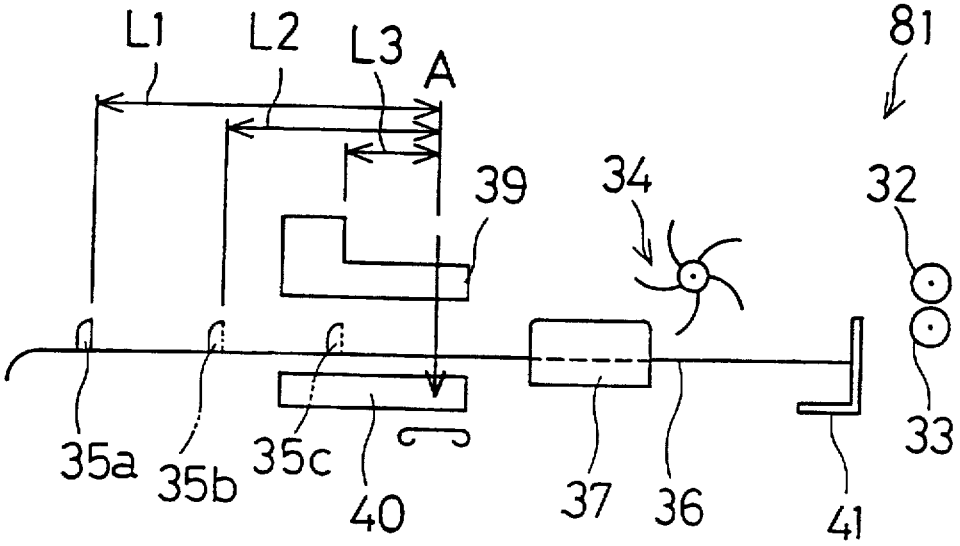
FIG. 11 is a side view showing a construction of a stapling apparatus 81 of a second embodiment of the invention.
Figure 12:
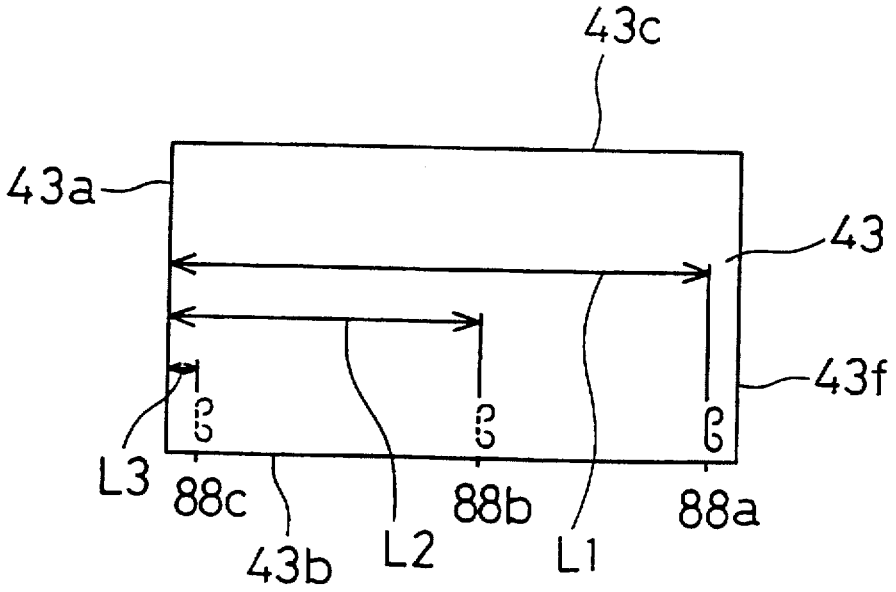
FIG. 12 is a plan view showing stapling positions 88*a* to 88*c* of a recording paper 43.

FIG. 11 is a side view showing a construction of a stapling apparatus 81 of a second embodiment of the invention. Although the stapling apparatus 81 is constructed in a manner similar to that of the stapling apparatus 31, it is characterized in that plural (three in the embodiment) gates 35 are provided. Three gates 35*a* to 35*c* are located at distances L1, L2 and L3 from a position A in the discharging direction of the stapled sheaf of recording papers 44, respectively, where the reference mark A depicts a driving position of a staple in the stapling apparatus 81, when upper and lower stapling units 39, 40 are fixedly provided. The distances L1 to L3 are set according to a distance between a downstream end 43*a* in the conveying direction of the recording paper 43 shown in FIG. 12 and stapling positions 88*a* to 88*c*.

Figure 13:
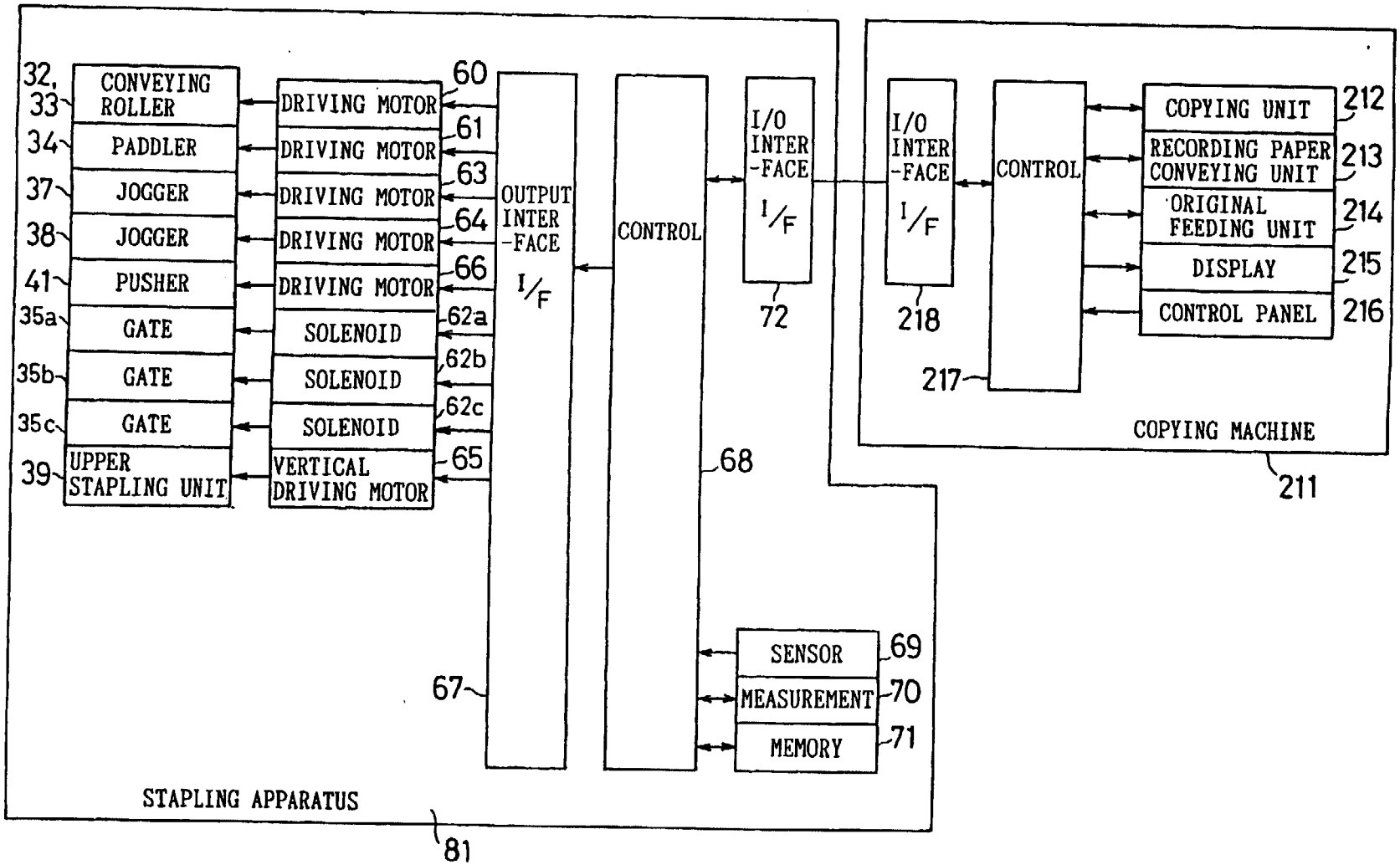
FIG. 13 is a block diagram showing an electrical structure of the stapling apparatus 81.

FIG. 13 is a block diagram showing an electrical structure of the stapling apparatus 81. In the block diagram, the gates 35*a* to 35*c* are provided in place of the gate 35 shown in the block diagram of FIG. 8, solenoids 62*a* to 62*c* in place of the solenoid 62, and the solenoids 62*a* to 62*c* serve for driving the gates 35*a* to 35*c*, respectively.

In Table 1 below, binding methods of the recording paper 43 are shown in relation with on/off state of the solenoids 62*a* to 62*c*. In the case of so-called right binding, the solenoid 62*a* is turned "off", and the solenoids 62*b*, 62*c* are turned "on". Thus, the gate 35*a* is closed, while the gates 35*b*, 35*c* are open, and the recording paper 43 is bound at the stapling position 88*a* shown in FIG. 12. For achieving the right binding by stapling at the position 88*a*, the recording paper 43 is conveyed in such manner that the end 43*f* is positioned in the upper side, and the end 43*a* is positioned in the lower side, so that contents copied to the recording paper 43 are read in the vertical direction.

In the case of the center binding, the solenoids 62*a*, 62*c* are turned "on", and the solenoid 62*b* is turned "off". Thus, the gate 35*b* is closed, while the gates 35*a*, 35*c* are open, and the recording paper is bound at the stapling position 88*b* shown in FIG. 12. For achieving the center binding by stapling at the position 88*b*, the recording paper 43 is conveyed in such manner that the end 43*b* is positioned in the upper side, and the end 43*c* is positioned in the lower side, so that contents copied to the recording paper 43 are read in the horizontal or vertical direction, or the end 43*c* is positioned contrarily in the upper side, and the end 43*b* is positioned in the lower side, so that they are read in the horizontal or vertical direction.

Now, in the case of the left binding, the solenoids 62*a*, 62*b* are turned "on", and the solenoid 62*c* is turned "off". Thus, the gate 35*c* is closed, while the gates 35*a*, 35*b* are open, and the recording paper is bound at the stapling position 88*c* shown in FIG. 12. For achieving the left binding by stapling at the position 88*c*, the recording paper 43 is conveyed in such manner that the end 43*a* is positioned in the upper side, and the end 43*f* is positioned in the lower side, so that contents copied to the recording paper 43 are read in the horizontal direction.

When the stapled sheaf of recording papers 44 is discharged, all solenoids 62*a* to 62*c* are turned "on", and all gates 35*a* to 35*c* are open.

TABLE 1

| Binding methods | Solenoid 62a (Gate 35a) | Solenoid 62b (Gate 35b) | Solenoid 62c (Gate 35c) |
|---|---|---|---|
| Right binding | OFF | ON | ON |
| Center binding | ON | OFF | ON |
| Left binding | ON | ON | OFF |
| (Discharge) | ON | ON | ON |

OFF: Gate closed
ON: Gate opened

As described, according to the second embodiment, a stapling position can be selected in the direction parallel to the conveying direction of the recording paper 43 by controlling the open and closed states of plural gates 35*a* to 35*c* provided according to the distance between the downstream end 43*a* in the conveying direction of the recording paper 43 and the stapling position, and the right binding, center binding, left binding and the like can be selectively achieved.

Figure 14:
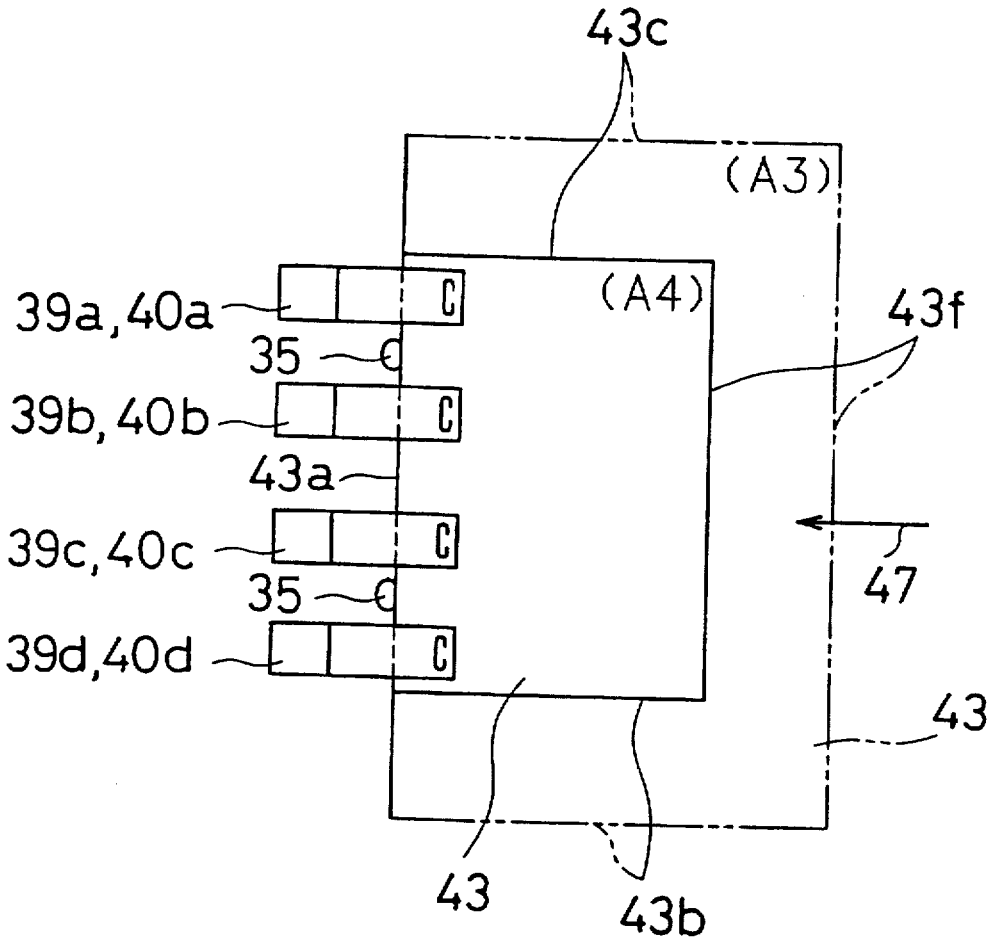
FIG. 14 is a plan view showing stapling means of a stapling apparatus 91 of a third embodiment of the invention.

FIG. 14 is a plan view showing stapling means of a stapling apparatus 91 of a third embodiment of the invention. Although the stapling apparatus 91 of the third embodiment is constructed generally in a similar manner as that of the stapling means 31 of the first embodiment, it is characterized in that plural sets (four sets, in the embodiment) of upper and lower stapling units 39, 40 are provided. Four sets of the stapling units 39*a* to 39*d*, 40*a* to 40*d* are located in four stapling positions set in the direction orthogonal to the conveying direction of the recording paper 43, respectively. The stapling position is set, for example, with an even space between them. Thus, a support plate 36 is formed with four windows 30*d* in correspondence with the four sets of stapling units 39*a* to 39*d*, 40*a* to 40*d*, respectively.

Figure 15:
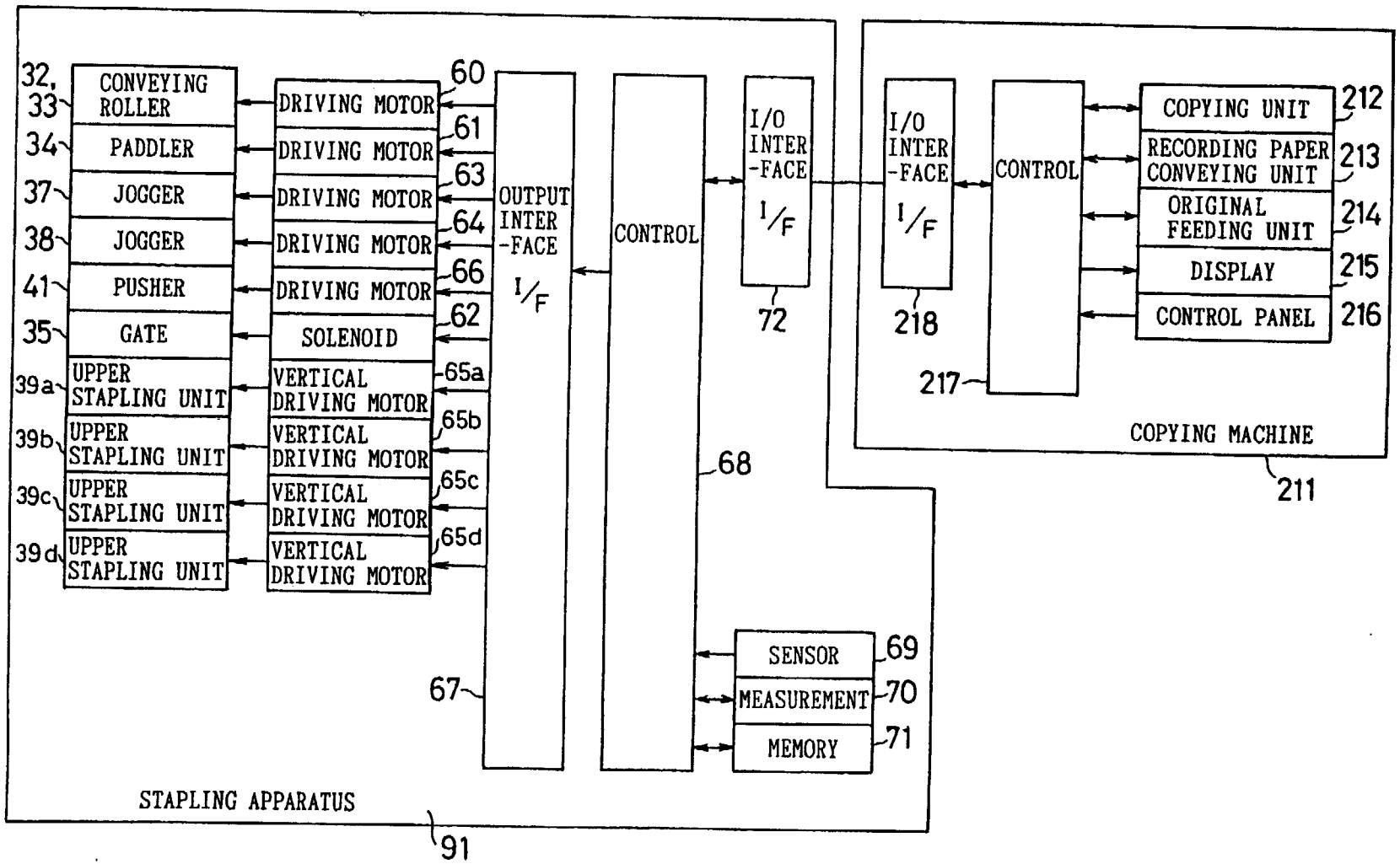
FIG. 15 is a block diagram showing an electrical structure of the stapling apparatus 91.

FIG. 15 is a block diagram showing an electrical structure of the stapling apparatus 91. In the block diagram, the upper stapling units 39*a* to 39*d* are provided in place of the upper stapling unit 39 shown in the block diagram of FIG. 8, driving motors 65*a* to 65*d* in place of the driving motor 65, and the driving motors 65*a* to 65*d* serve for driving the upper stapling units 39*a* to 39*d*, respectively.

In the stapling apparatus 91, a desired stapling position is selected by an operator through a control panel 216 of a copying machine 211. A control circuit 68 applies control signals to the driving motors 65*a* to 65*d* so that the upper and lower stapling units 39*a* to 39*d*, 40*a* to 40*d* at a stapling position corresponding to the stapling position selected are put in action. In such manner, the recording paper 43 is stapled in the desired stapling position.

In Table 2, the upper and lower stapling units 39*a* to 39*d*, 40*a* to 40*d* put in action to achieve various binding methods are shown. For example, when the recording paper 43 is of A4 size, and is desired to be bound in a corner thereof, the stapling units 39*a*, 40*a* are put in action. In such case, the recording paper 43 is conveyed in such manner that the end 43*c* is positioned in the upper side, and the end 43*b* is positioned in the lower side, so that contents copied are read in the horizontal direction.

When the recording paper 43 is of A4 size, and is desired to be bound at two points, the stapling units 39*b*, 40*b* and the stapling units 39*c*, 40*c* are put in action. In such case, the recording paper 43 is conveyed in such manner that the end 43*c* is positioned in the upper side, and the end 43*b* is positioned in the lower side, so that contents copied are read in the horizontal direction.

When the recording paper 43 is of A4 size, and the Japanese binding is desired in a corner thereof, the stapling units 39*d*, 40*d* are put in action. In such case, the recording paper 43 is conveyed in such manner that the end 43*b* is positioned in the upper side, and the end 43*c* is positioned in the lower side, so that contents copied are read in the vertical direction.

When the recording paper 43 is of A3 size, and is desired to be bound at two points, the stapling units 39*a*, 40*a* and the stapling units 39*d*, 40*d* are put in action. In such case, the recording paper 43 is conveyed in such manner that the end 43*c* is positioned in the upper side, and the end 43*b* is positioned in the lower side, so that contents copied are read in the horizontal direction. @102 As described above, according to the third embodiment, a stapling position can be selected in the direction orthogonal to the conveying direction of the recording paper 43 by selectively activating the plural sets of upper and lower stapling units 39*a* to 39*d*, 40*a* to 40*d* provided. The third embodiment is also achievable in combination with the second embodiment.

TABLE 2

| Binding methods | Stapling units 39a, 40a | Stapling units 39b, 40b | Stapling units 39c, 40c | Stapling units 39d, 40d |
|---|---|---|---|---|
| A4 corner binding (Portrait) | 0 | | | |
| A4 two-point binding | | 0 | 0 | |
| A4 Japanese corner binding (Landscape) | | | | 0 |
| A3 two-point binding | 0 | | | 0 |

Figure 16:
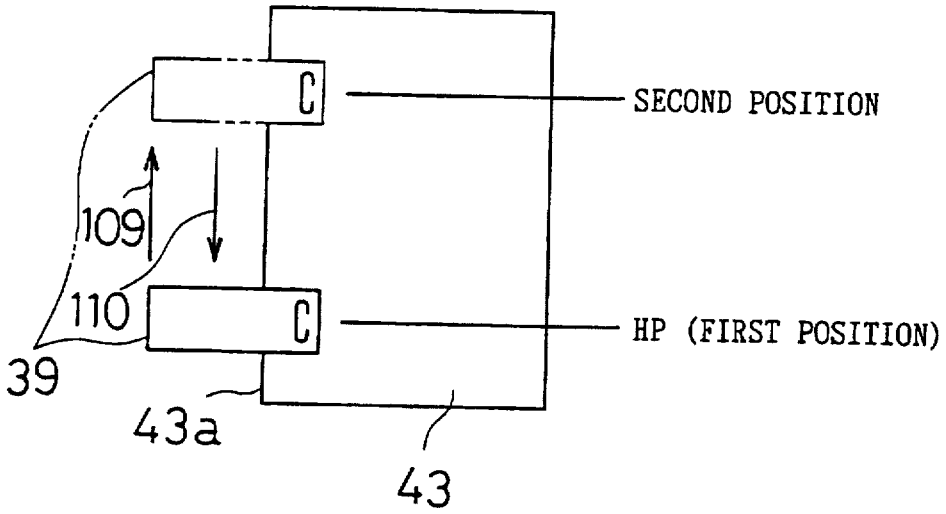
FIG. 16 is a schematic drawing for explaining operations of a stapling apparatus 111 of a fourth embodiment of the invention.

FIG. 16 is a schematic drawing for explaining operations of a stapling apparatus 111 of a fourth embodiment of the invention. Although the stapling apparatus 111 according to the fourth embodiment is constructed generally in a manner similar to that of the stapling apparatus 31 according to the first embodiment, it is characterized in that a set of stapling units 39, 40 are movable synchronously in the direction (horizontal X direction) 109, 110 orthogonal to the conveying direction of the recording paper 43.

Figure 17:
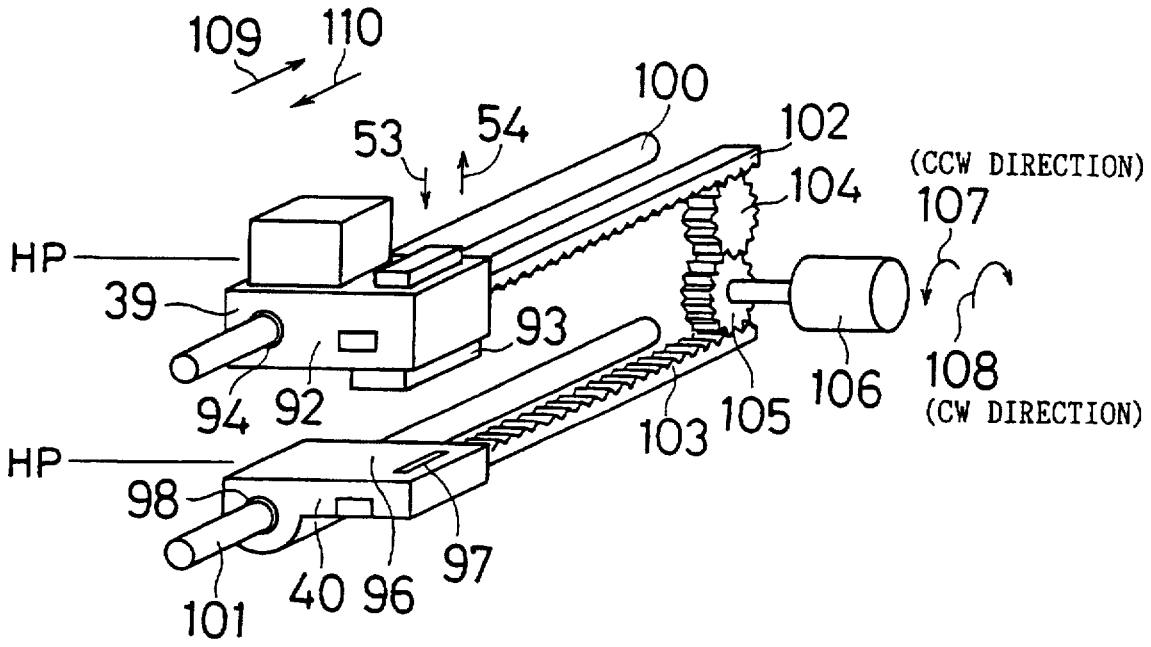
FIG. 17 is a perspective view showing a moving mechanism of upper and lower stapling units 39, 40 of the stapling apparatus 111.

FIG. 17 is a perspective view showing a moving mechanism of the upper and lower stapling units 39, 40 of the stapling apparatus 111. The upper stapling unit 39 comprises an upper main stapling member 92 and an anvil member 93. The anvil member 93 bends a bar-shaped staple positioned in the upper main stapling member 92 into a U-shape. In the upper main stapling member 92, a through hole 94 is formed for allowing a guide 100 to slide therethrough, and a rack 102 formed with a groove is fixed.

The lower stapling unit 40 comprises a lower main stapling member 96. In the lower main stapling member 96, a clinching member 97 is formed for bending a tip portion of a driven staple by abutting against the anvil member 93, when the upper stapling unit 39 is lowered. In the lower main stapling member 96, a through hole 98 is formed additionally for allowing a guide 101 to slide therethrough, and a rack 103 formed with a groove is fixed.

The guides 100, 101 are positioned in the direction orthogonal to the conveying direction of the recording paper 43. They are positioned such that a groove in a gear 104 is engaged with the groove in the rack 102, a groove in the gear 105 is engaged with the groove in the rack 103, and a groove in the gear 104 is engaged with the groove in the gear 105. The gear 105 is rotatable in mutually opposite directions 107, 108 by a driving motor 106, which is achieved, for example, by a pulse motor. By driving the driving motor 106, and rotating the gear 105 in the directions 107, 108, the racks 102, 103 can be moved in synchronization with each other in mutually opposite directions 109, 110, respectively. Thus, the upper and lower stapling units 39, 40 are also moved synchronously in the directions 109, 110.

The support plate 36 is formed, in correspondence with the directions 109, 110 of movement of the stapling units 39, 40, with a window 30*d* communicating in the directions 109, 110. Alternatively, the window can be formed only at such position that the stapling units 39, 40 are stopped for stapling operation.

Figure 18:
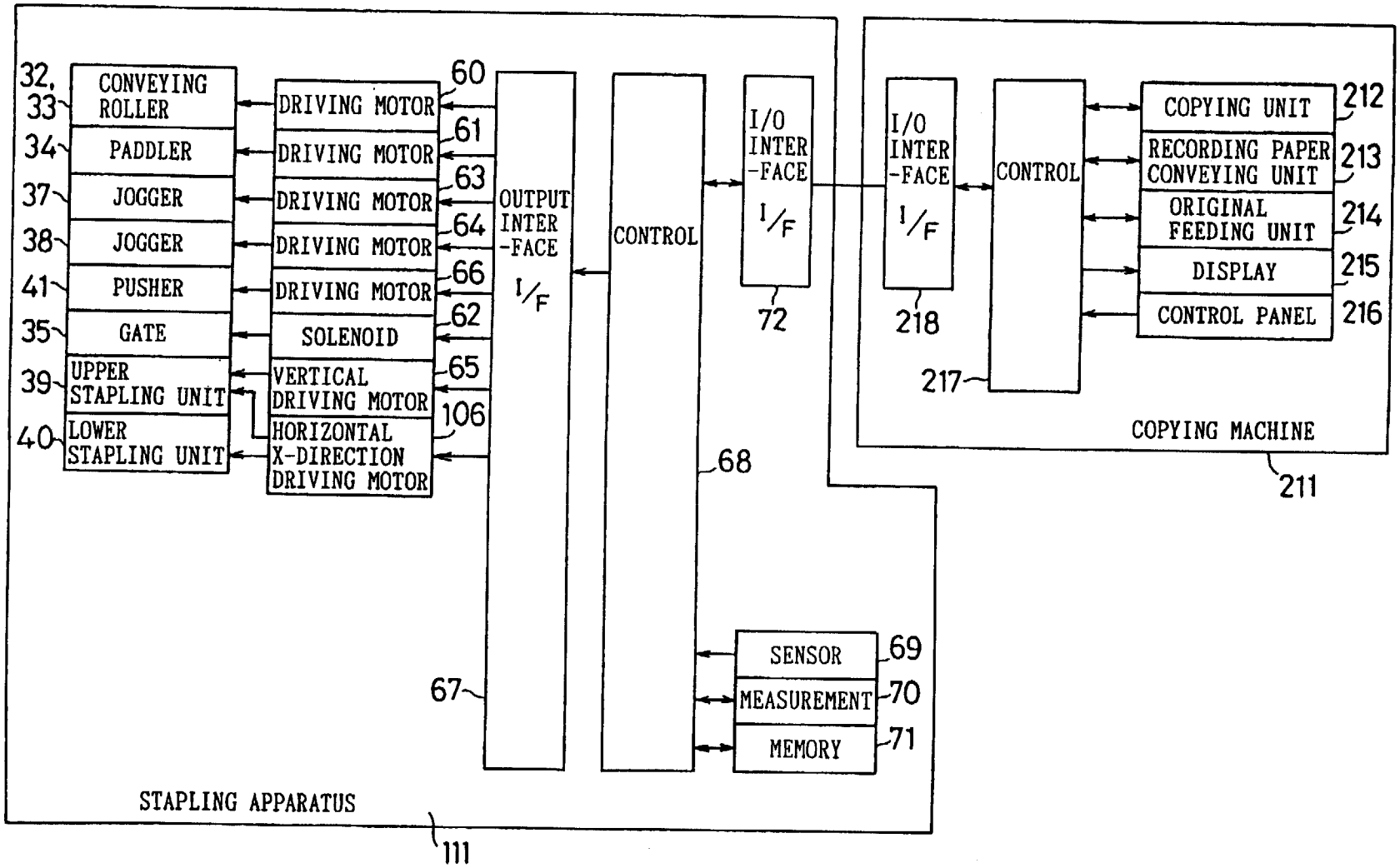
FIG. 18 is a block diagram showing an electrical structure of the stapling apparatus 111.

FIG. 18 is a block diagram showing an electrical structure of the stapling apparatus 111. The block diagram of the figure is identical with the block diagram shown in FIG. 8, except that the lower stapling unit 40 and the driving motor 106 are added. The driving motor 106 moves the upper and lower stapling units 39, 40 in the direction (horizontal X direction) 109, 110 as described above.

In the stapling apparatus 111, a desired stapling position is selected by an operator through a control panel 216 of a copying machine 211. The stapling position is selected from plural stapling positions along the downstream end 43*a* in the conveying direction of the recording paper 43. A control circuit 68 applies control signals to the driving motor 106 so that the upper and lower stapling units 39, 40 are positioned in stapling positions corresponding to the stapling position selected. This is achieved, for example, by applying a predetermined number of pulses. The upper and lower stapling units 39, 40 are moved to the stapling positions selected, and put in action in the stapling positions. That is, the stapling positions are set in correspondence with the plural stapling positions in the direction orthogonal to the recording paper 43 conveying direction. In such manner, the recording paper 43 is bound in the desired stapling position. By repeating such operation, the recording paper 43 can be bound in plural positions.

In the embodiment, the upper and lower stapling units 39, 40 are generally at a home position (HP), which is a first position selected from plural stapling positions, as described below.

Figure 19:
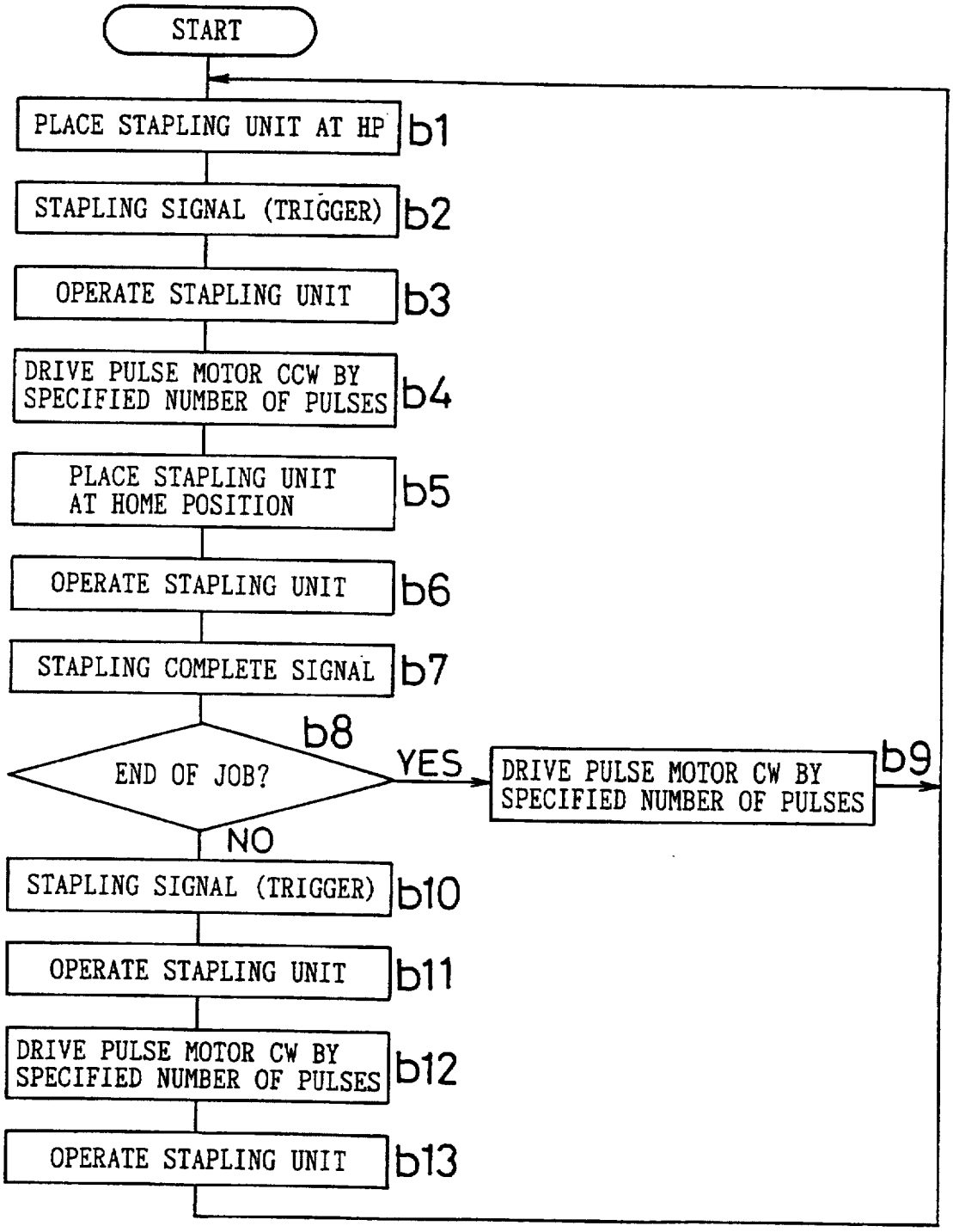
FIG. 19 is a flowchart showing operations of the stapling apparatus 111.

FIG. 19 is a flowchart showing operations of the stapling apparatus 111. The flowchart is based on stapling of the recording paper 43 at two points. First, the number of recording papers forming the sheaf of recording papers 44 and the number of sheaves are inputted through the control panel 216 of the copying machine 211, and stapling positions are selected.

In step b1, the upper and lower stapling units 39, 40 are in the HP. The HP is set at a stapling position corresponding to the stapling position which is often selected, for example, for one-point stapling. Successively, operations similar to the step a1 to step a6 above are carried out, and a stapling signal for instructing initiation of a stapling operation is applied to the driving motor 65 in step b2. In step b3, the upper and lower stapling units 39, 40 are operated in the HP. After the stapling operation is completed, step b4 is started and the driving motor 106 is operated by a predetermined number of pulses in the direction 107 for moving the upper and lower stapling units 39, 40 to a second position selected from plural stapling positions corresponding to the stapling positions selected.

In step b5, the upper and lower stapling units 39, 40 are at the second position. In step b6, the upper and lower stapling units 39, 40 are operated at the second position in a manner similar to that of step b3. In step b7, a completion signal indicating completion of the stapling operation for two-point binding is outputted.

In step b8, it is determined whether the job has been completed or not. In other words, it is determined whether the predetermined number of stapled sheaves of the recording paper 44 have been produced or not. If it is determined that the job has been completed, that is, the predetermined number of stapled sheaves of the recording paper 44 have been produced, step b9 is started, and the driving motor 106 is operated by a predetermined number of pulses in the direction 108 for returning the upper and lower stapling units 39, 40 to the HP. After the operation in step b9 is completed, the sequence returns to step b1. If it is determined in step b8 that the job has not been completed, that is, the predetermined number of stapled sheaves of the recording paper 44 have not been produced, the operations of step b10 are started.

In step b10, after operations similar to those of the step a1 to step a6 are conducted, a stapling signal for instructing initiation of the stapling operation is inputted. In step b11, the upper and lower stapling units 39, 40 are operated at the second position. In step b12, the driving motor 106 is operated by a predetermined number of pulses in the direction 108 in order to return the upper and lower stapling units 39, 40 to the HP. In step b13, similarly to the step b11, the upper and lower stapling units 39, 40 are operated in the HP. After the operation in step b13 is completed, the sequence returns to step b1.

As described, according to the fourth embodiment, since the upper and lower stapling units 39, 40 are movable in synchronization with each other, the stapling position can be selected in the direction orthogonal to the conveying direction of the recording paper 43. Also, since the set of stapling units 39, 40 can be moved synchronously by means of a general moving mechanism, the stapling apparatus 111 can be produced at a low cost. Since the stapled sheaves of recording paper 44 are produced by repetitive operations at the HP, second position, second position, HP, comparing with the case of producing the stapled sheaves by repetitive operations at the HP, second position, HP, second position, movement of the upper and lower stapling units 39, 40 is less, a wear of the grooves in the racks 102, 103 and gears 104, 105 can be reduced, and such problem as vertical offset between the upper and lower stapling units 39, 40 is reduced. Further, only the upper stapling unit 39 is refilled with staples, the controllability is increased.

It is also possible to combine the fourth embodiment with the second embodiment.

Figure 20:
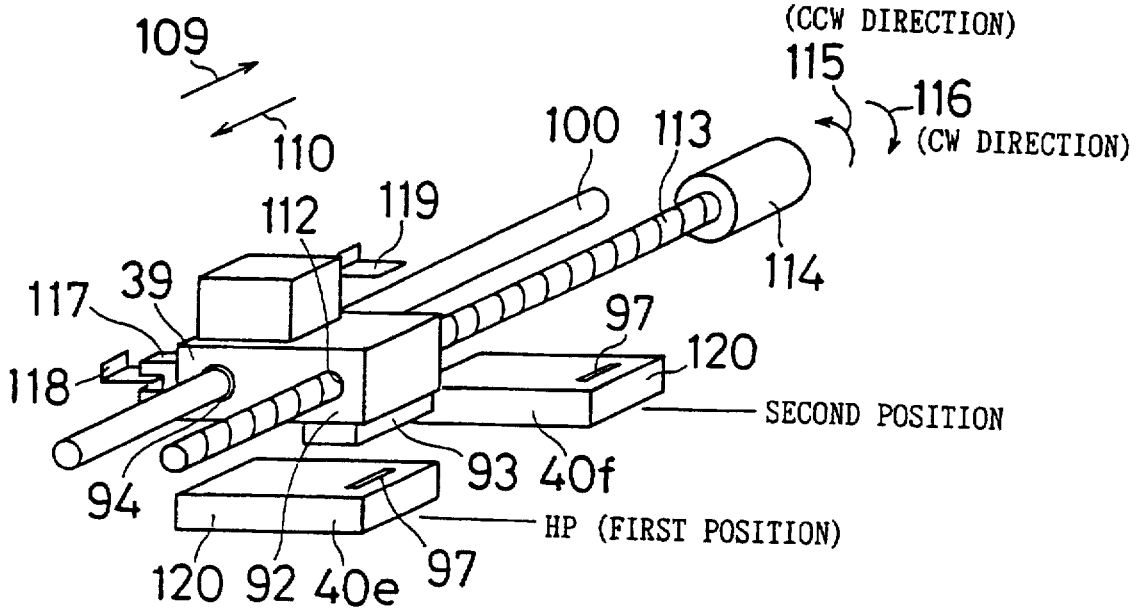
FIG. 20 is a perspective view showing a moving mechanism of an upper stapling unit 39 of a stapling apparatus 121 of a fifth embodiment of the invention.

FIG. 20 is a perspective view showing a moving mechanism for an upper stapling unit 39 of a stapling apparatus 121 of a fifth embodiment of the invention. Although the stapling apparatus 121 according to the fifth embodiment is generally constructed similarly to the stapling apparatus 31 according to the first embodiment, it is characterized in that only the upper stapling unit 39 is movable in the directions 109, 110, and lower stapling units **40*e*, 40*f* are provided in plural (two, in the embodiment) positions set in the direction orthogonal to the conveying direction of the recording paper 43**, respectively.

The upper stapling unit 39 comprises, similarly to that of the fourth embodiment, an upper main stapling member 92 and an anvil member 93, and a through hole 94 for allowing a guide 100 to slide therethrough and a through hole 112 having a groove for allowing a lead screw 113 to slide therealong are formed in the upper main stapling member 92. The lead screw 113 is rotated in mutually opposite directions 115, 116 by a driving motor 114 such as a DC (direct current) motor. By rotating the read screws 113 in the directions 115, 116 by operating the driving motor 114, the upper stapling unit 39 can be moved in the directions 109, 110.

A position detecting sensor 117 having, for example, a light emitting device and a light receiving device is attached to the upper main stapling member 92. At stapling positions corresponding to the position at which two lower stapling units **40*e*, 40*f* are provided, sensor plates 118, 119 are provided, respectively. The position detecting sensor 117 detects if the upper stapling unit 39 is at the stapling position by means of presence or absence of the sensor plates 118, 119** between the light emitting device and light receiving device.

The lower stapling units **40*e*, 40*f* have a lower main stapling member 120 formed, respectively, with a clinching member 97 similar to that described above. One lower stapling unit 40*e* is located at a home position (HP), that is, a first position, while the other lower stapling unit 40*f* is located at a second position. For the HP, a stapling position corresponding to a stapling position which is often selected for one-point binding, for example, is selected. The second position is selected according to a size of the recording paper 43**.

A support plate 36 is formed with two windows **30*d* in correspondence with the positions in which the lower stapling units 40*e*, 40*f* are provided. Alternatively, single communicating window 30*d* may be formed in correspondence with the positions in which the lower stapling units 40*e*, 40*f*** are provided.

Figure 21:
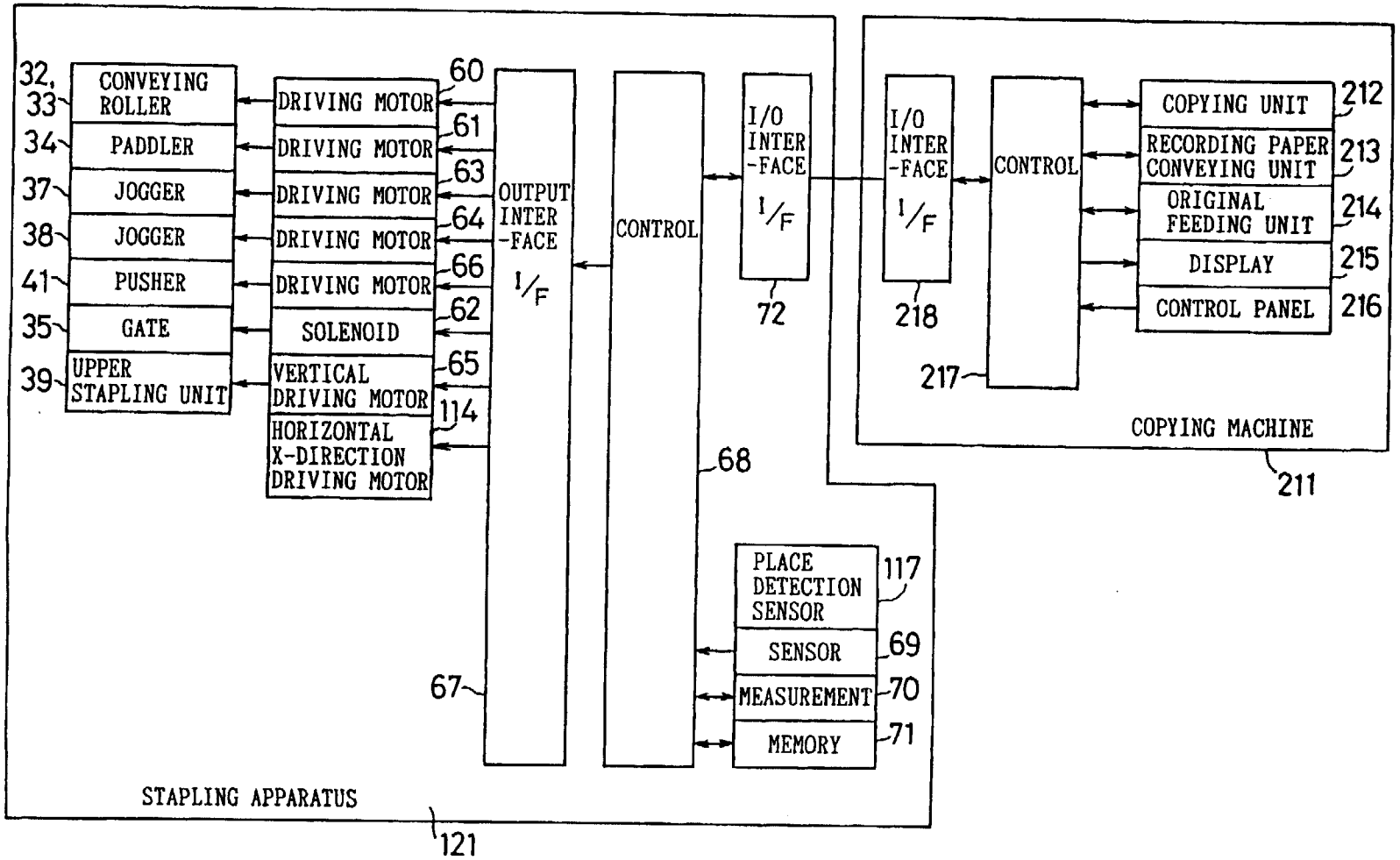
FIG. 21 is a block diagram showing an electrical structure of the stapling apparatus 121.

FIG. 21 is a block diagram showing an electrical structure of the stapling apparatus 121. The block diagram shown corresponds to the block diagram of FIG. 8 with a driving motor 114 added thereto. The driving motor 114 serves for moving the upper stapling unit 39 in the directions 109, 110 (horizontal X direction) as described above. In the embodiment, the lower stapling units **40*e*, 40*f* are fixed in position, it is not required for an operator to select a desired stapling position through a control panel 216 of a copying machine 211**.

A control circuit 68 applies a control signal to the driving motor 114 for moving the upper stapling unit 39. When the position detecting sensor 117 is turned "on", the control circuit 68 determines that the upper stapling unit 39 has been moved to a predetermined position, and the control circuit 68 activates the lower stapling units **40*e*, 40*f* at the position where the upper stapling unit 39 is located and the upper stapling unit 39 which has been moved. In such manner, the recording paper 43 is stapled at a predetermined stapling position. By repeating such operation, the recording paper 43 can be stapled in plural positions. In the embodiment, the upper stapling unit 39** is generally in the HP.

Figure 22:
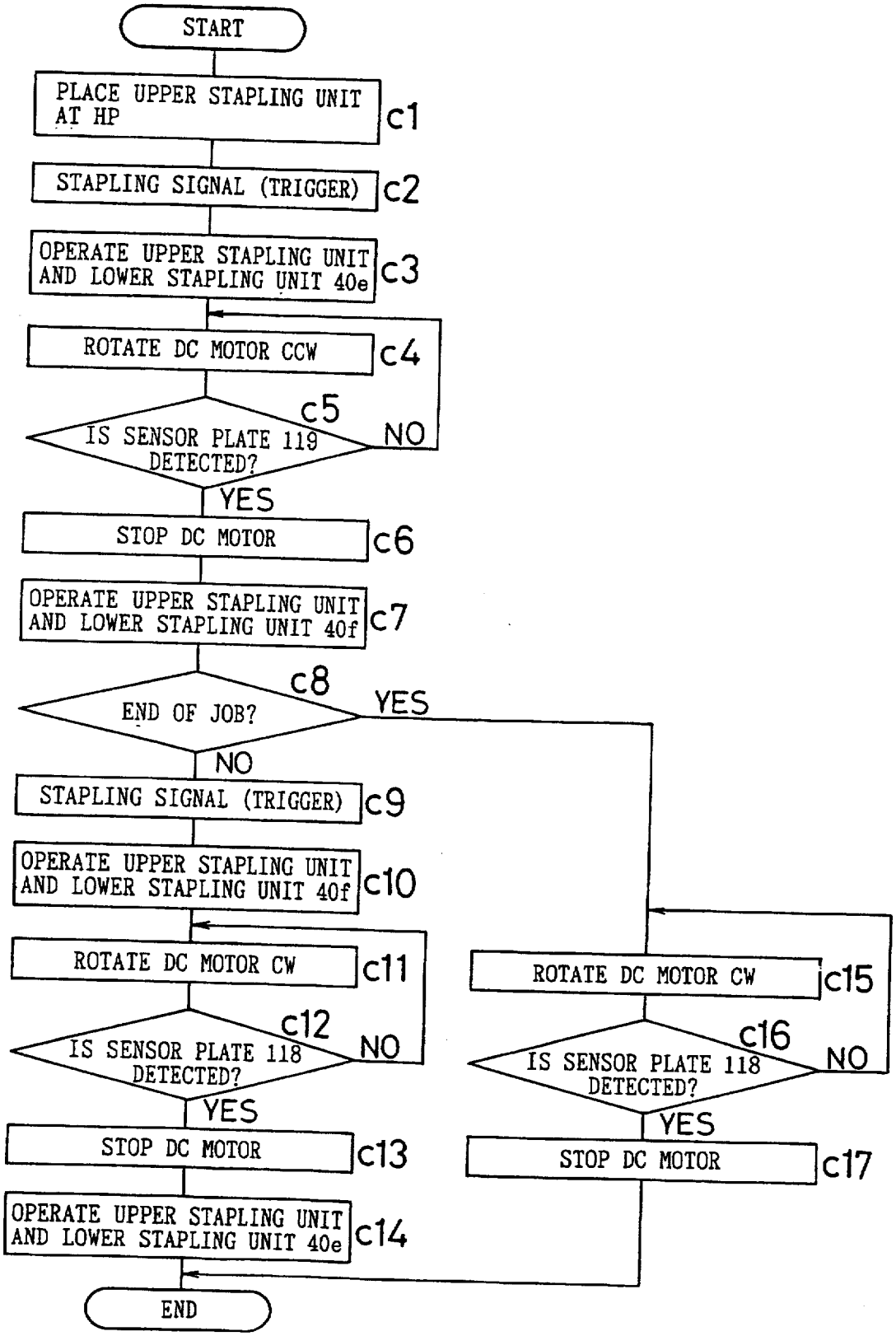
FIG. 22 is a flowchart showing operations of the stapling apparatus 121.

FIG. 22 is a flowchart showing operations of the stapling apparatus 121. First, the number of the recording papers forming a sheaf of recording papers 44 and the number of sheaves are inputted. According to the embodiment, since the recording paper 43 is stapled in stapling positions corresponding to two positions in which the lower stapling units **40*e*, 40*f*** are located, although it is not required to select stapling positions for two-point binding, one-point binding is also possible by selecting either one of the stapling positions.

In step c1, the upper stapling unit 39 is positioned in the HP. Successively, operations similar to the step a1 to step a6 above are conducted, and a stapling signal is inputted in step c2. In step c3, the upper stapling unit 39 and the lower stapling unit 40*e* in the HP are put in action. In step c4, the driving motor 114 is rotated in the direction 115.

In step c5, it is determined whether the sensor plate 119 is detected by the position detecting sensor 117 or not. If it is detected, the sequence is proceeded to step c6, and if not, it is returned to step c4. In step c6, the rotation of driving motor 114 is discontinued. In step c7, the upper stapling unit 39 and the lower stapling unit 40*f* in the second position are put in action.

In step c8, it is determined whether the job has been completed or not, the sequence is proceeded to step c15, if it has been completed, and the driving motor 114 is rotated in the direction 116. In step c16, it is determined whether the sensor plate 118 is detected by the position detecting sensor 117 or not. The sequence is proceeded to step c17, if it is detected, and returned to step c15, if not. In step c17, the rotation of driving motor 114 is discontinued.

If it is determined in step c8 that the job has not been completed, a stapling signal is inputted in step c9. In step c10, the upper stapling unit 39 and the lower stapling unit 40*f* at the second position are put in action. In step c11, the driving motor 114 is rotated in the direction 116. In step c12, it is determined whether the sensor plate 118 is detected by the position detecting sensor 117 or not. The sequence is proceeded to step c13, if it is detected, and returned to step c11, if not. In step c13, the rotation of driving motor 114 is discontinued. In step c14, the upper stapling unit 39 and the lower stapling unit 40*e* in the HP are put in action.

As described, according to the fifth embodiment, since the upper stapling unit 39 is movable, and two lower stapling units 40*e*, 40*f* are provided, the recording paper 43 can be stapled in two positions orthogonal to the conveying direction of the recording paper 43. Stapling in more positions is possible by increasing the number of lower stapling units.

According to the sequence of movement of the upper stapling unit 39 in the embodiment, a wear of the through hole 112 and lead screw 113 having grooves can be reduced, similar to the case of the fourth embodiment, and a vertical offset between the upper and lower stapling units 39, 40*e*, 40*f* can be reduced. Further, only the upper stapling unit 39 is refilled with staples, the controllability is increased.

The fifth embodiment can be achieved also in combination with the second embodiment.

Figure 23:
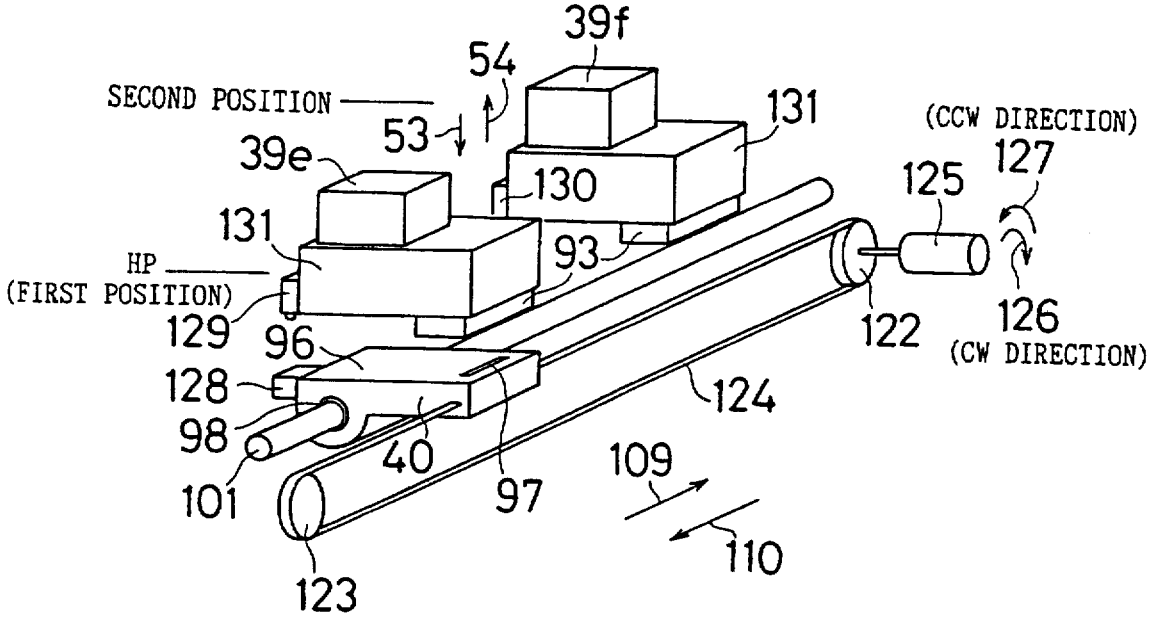
FIG. 23 is a perspective view showing a moving mechanism of a lower stapling unit 40 of a stapling apparatus 132 of a sixth embodiment of the invention.

FIG. 23 is a perspective view showing a moving mechanism of a lower stapling units 40 of a stapling apparatus 132 of a sixth embodiment of the invention. The stapling apparatus 132 according to the sixth embodiment is characterized in that the lower stapling unit 40 is moved in the directions 109, 110, and upper stapling units 39*e*, 39*f* are provided in plural (two, in the embodiment) positions, respectively, which are set in the direction orthogonal to the conveying direction of the recording paper 43, contrarily to the stapling apparatus 121 according to the fifth embodiment.

The lower stapling unit 40 comprises a lower main stapling member 96 formed with a clinching member 97, similarly to the fourth embodiment. In the lower main stapling member 96, a through hole 98 for allowing a guide 101 to slide therethrough Is formed. By rotating a driving motor 125 such as a DC motor in the mutually opposite directions 126, 127, a pulley 122 on the drive side is also rotated in the same directions. A wire 124 is wound about the pulley 122 and a pulley 123 on the drive side. The lower main stapling member 96 of lower stapling unit 40 is fixedly attached to the wire 124. Therefore, by operating the driving motor 125, and rotating the pulley 122 in the directions 126, 127, the lower stapling unit 40 can be moved in the directions 109, 110.

A position detecting sensor 128 achieved, for example by a light receiving device is also attached to the lower main stapling member 96.

The upper stapling units 39*e*, 39*f* have an upper main stapling member 131 and an anvil member 93 similar to that described above, respectively. Light emitting devices 129, 130 are attached to the upper main stapling member 131, respectively. One upper stapling unit 39*e* is located at a home position, that is, a first position set in a manner similar to that of the fifth embodiment, and the other upper stapling unit 39*f* is located at a second position. A position detecting sensor 128 attached to the lower main stapling member 96 receives a light from the light emitting devices 129, 130, and detects that the lower stapling unit 40 is at the position.

A support plate 36 is formed with two windows 30*d* in correspondence with the positions in which the upper stapling units 39*e*, 39*f* are provided, respectively. Alternatively, single communicating window 30*d* may be provided in correspondence with the positions in which the upper stapling units 39*e*, 39*f* are provided.

Figure 24:
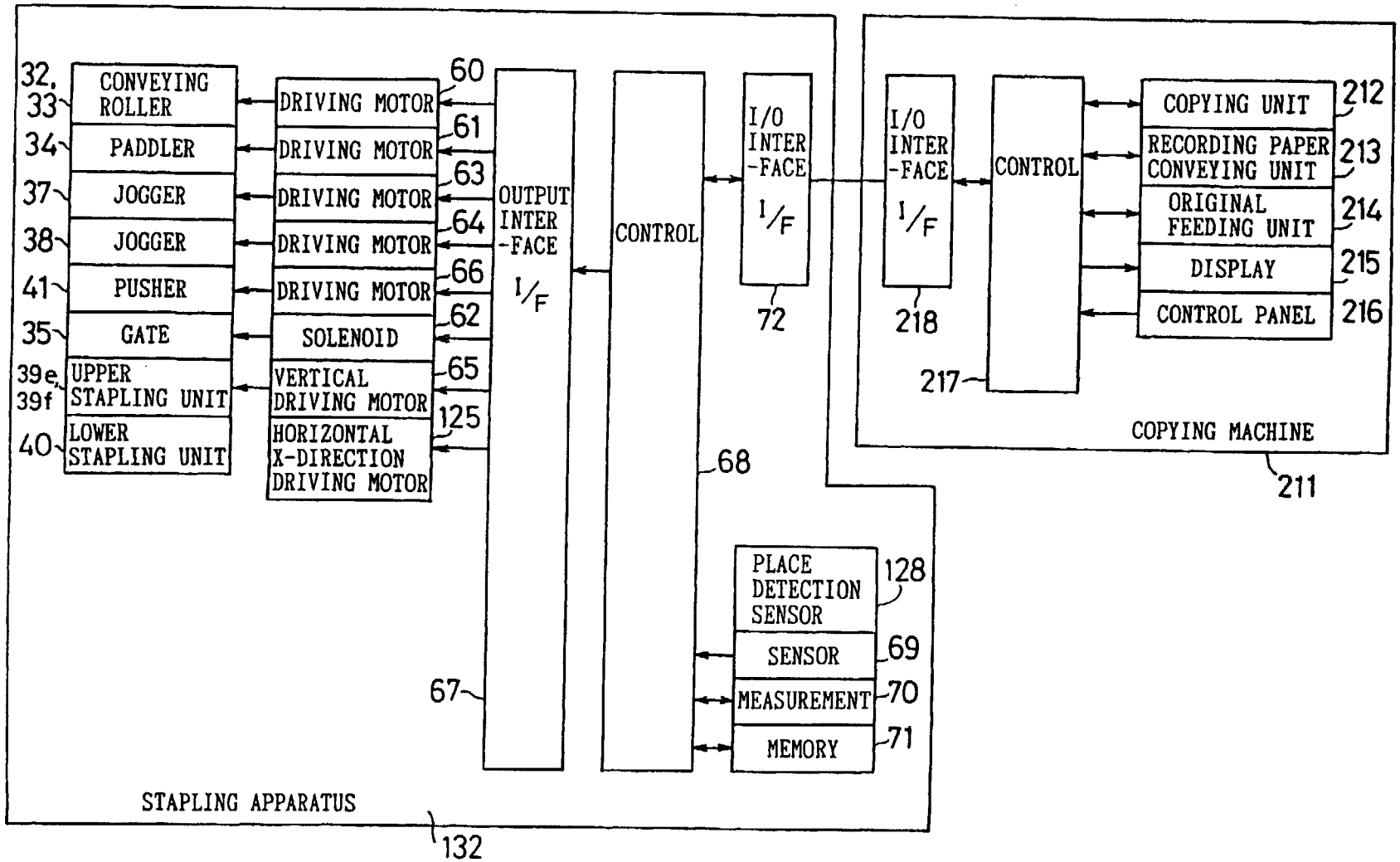
FIG. 24 is a block diagram showing an electrical structure of the stapling apparatus 132.

FIG. 24 is a block diagram showing an electrical structure of the stapling apparatus 132. The block diagram shown corresponds to the block diagram of FIG. 8 with the upper stapling unit 39 replaced by the upper stapling units 39*e*, 39*f*, and the lower stapling unit 40 and a driving motor 125 added thereto. The driving motor 125 moves the lower stapling unit 40 in the directions 109, 110 (horizontal X direction) as described above. In the embodiment, since the upper stapling units 39*e*, 39*f* are fixed in position, it is not required for an operator to select a desired stapling position through a control panel 216 of a copying machine 211 for two-point stapling. A stapling position may be selected for placing the lower stapling unit 40 at either position. In such manner, one-point binding can be also achieved.

A control circuit 68 applies a control signal to the driving motor 125 for moving the lower stapling unit 40. When the position detecting sensor 128 is turned "on", the control circuit 68 determines that the lower stapling unit 40 is at a predetermined stapling position, and the control circuit 68 activates corresponding upper stapling unit 39*e*, 39*f* and the lower stapling unit 40 which has been moved. In such manner, the recording paper 43 is stapled at a predetermined stapling position. By repeating such operations, the recording paper 43 can be stapled in plural positions.

Figure 25:
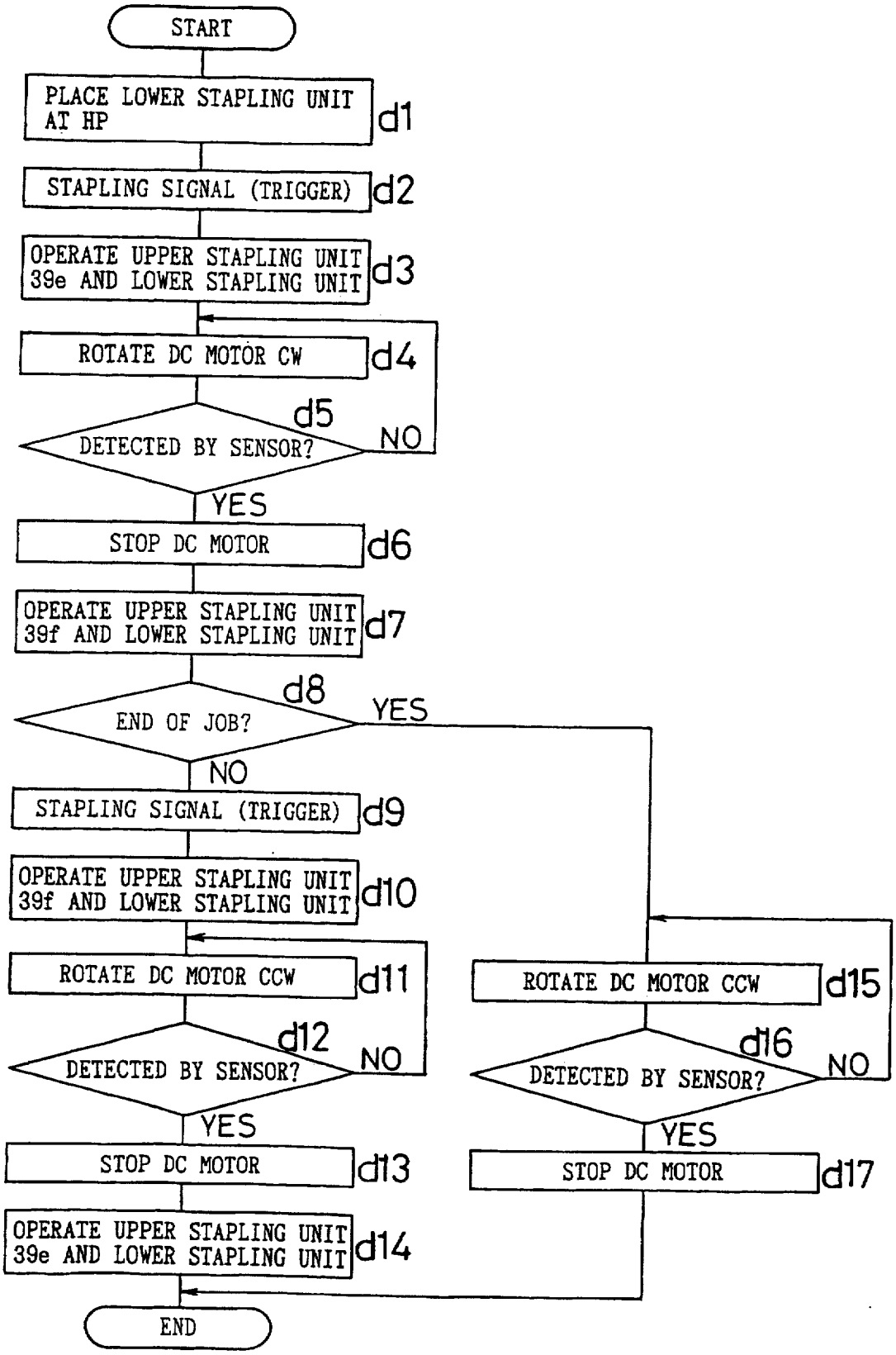
FIG. 25 is a flowchart showing operations of the stapling apparatus 132.

FIG. 25 is a flowchart showing operations of the stapling apparatus 132. First, the number of recording papers for one sheaf of recording papers 44 and the number of sheaves are inputted through the control panel 216 of the copying machine 211.

In step d1, the lower stapling unit 40 is located in the HP. A stapling signal is inputted in step d2 after operations similar to those of step a1 to step a6 have been conducted. In step d3, the upper stapling unit 39*e* and the lower stapling unit 40 in the HP are put in action. In step d4, the driving motor 125 is rotated in the direction 126.

In step d5, it is determined whether a light from the light emitting device 130 is received by the position detecting sensor 128. The sequence is proceeded to step d6, if it is determined that the light is received, and the lower stapling unit 40 is at the second position, and the sequence is returned to step d4, if it is determined that no light is received, and the lower stapling unit 40 is not at the second position. In step d6, operation of the driving motor 125 is discontinued. In step d7, the upper stapling unit 39*f* at the second position and the lower stapling unit 40 are put in action.

In step d8, it is determined whether the job has been completed. If it has been completed, the sequence is proceeded to step d15. In step d15, the driving motor 125 is rotated in the direction 127, and the lower stapling unit 40 is moved in the direction 110. In step d16, it is determined whether a light from the light emitting device 129 is received by the position detecting sensor 128 or not. In other words, it is determined whether the lower stapling unit 40 is in the HP or not. The sequence is proceeded to step d17, if the light is determined to be received, and it is returned to step d15, if the light is determined to be unreceived.

If it is determined in step d8 that the job has not been completed, a stapling signal is inputted in step d9, and the upper stapling unit 39*f* at the second position and the lower stapling unit 40 are put in action in step d10. In step d11, the driving motor 125 is rotated in the direction 127, and the lower stapling unit 40 is moved in the direction 110. In step dl2, it is determined whether a light from the light emitting device 129 is received by the position detecting sensor 128 or not. The sequence is proceeded to step d13, if the light is determined to be received, and the sequence is returned to step d11, if it is determined to be unreceived. In step d13, operation of the driving motor 125 is discontinued. In step d14, the upper stapling unit 39*e* in the HP and the lower stapling unit 40 are put in action.

As described, according to the sixth embodiment, since the lower stapling unit 40 is movable, and two upper stapling units 39*e*, 39*f* are provided, the recording paper 43 can be stapled in two positions orthogonal to the conveying direction of the recording paper 43. By using more upper stapling units, stapling in more positions is possible. In the sixth embodiment, since the lower stapling unit 40 lighter than the upper stapling unit 39 is moved, the inertial force is lower, the driving power is reduced, and reduction in power consumption can be achieved.

The sixth embodiment can be also achieved in combination with the second embodiment.

Figure 26A:
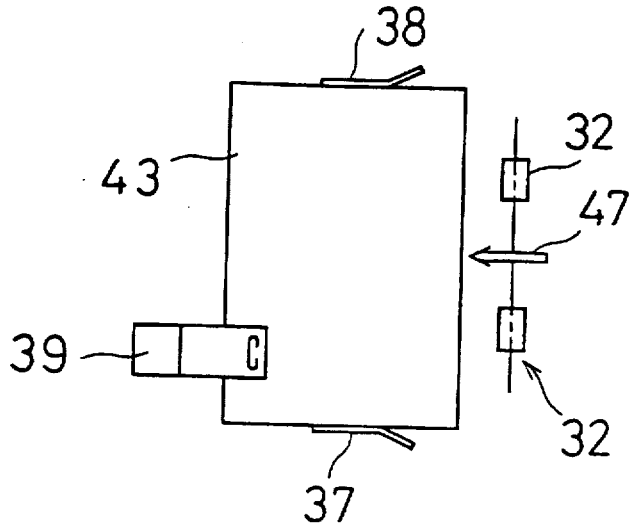
FIGS. 26A and 26B are schematic drawings for explaining operations of a stapling apparatus 160 of a seventh embodiment of the invention.
Figure 26B:
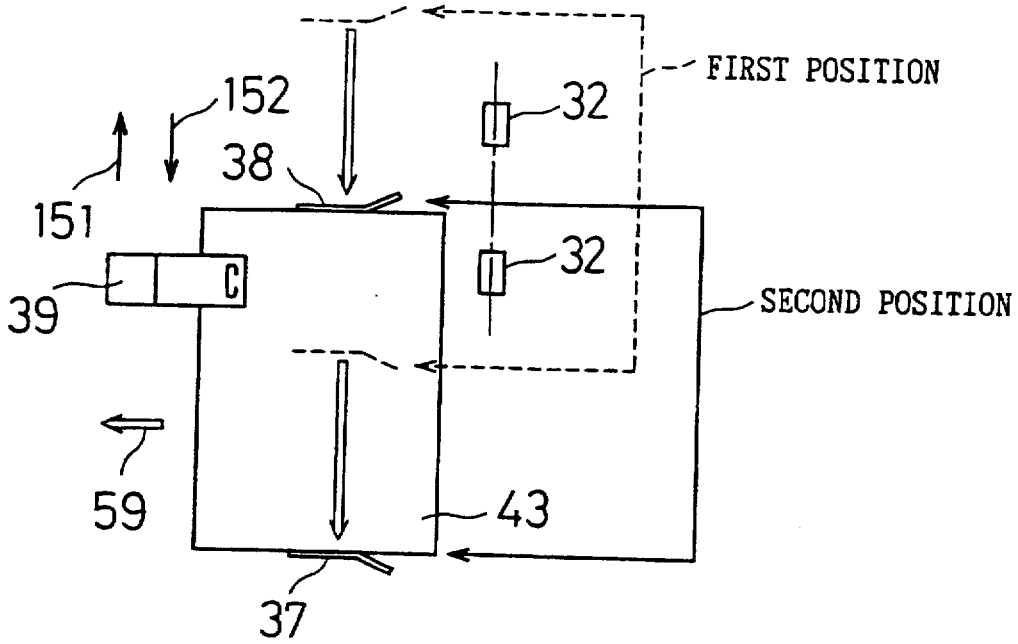

FIGS. 26A, 26B are schematic drawings for explaining operations of a stapling apparatus 160 according to a seventh embodiment of the invention. Although the stapling apparatus 160 according to the seventh embodiment is generally constructed in a manner similar to the stapling apparatus 31 according to the first embodiment, it is characterized in that joggers 37, 38 are moved in an identical direction.

The joggers 37, 38 are movable apart from each other in the directions 49, 51 and toward each other in the directions 50, 52, as described above, for aligning ends 43*b*, 43*c* of the recording paper 43 held on a supporting plate 36. The joggers 37, 38 of the embodiment also serve for aligning recording paper 36 at a first position shown in FIG. 26A, and the joggers 37, 38 moved to a second position in an identical direction 152, as shown in FIG. 26B, after a stapling operation at the first position is completed. By the movement of the joggers 37, 38, the recording paper 36 held on the support plate 36 is also moved. After a stapling operation at the second position is completed, a stapled sheaf of recording papers 44 is discharged in the discharging direction 59. As the sheaf of recording papers 44 is discharged, the joggers 37, 38 are moved in the direction 151 opposite to the direction 152.

Figure 27:
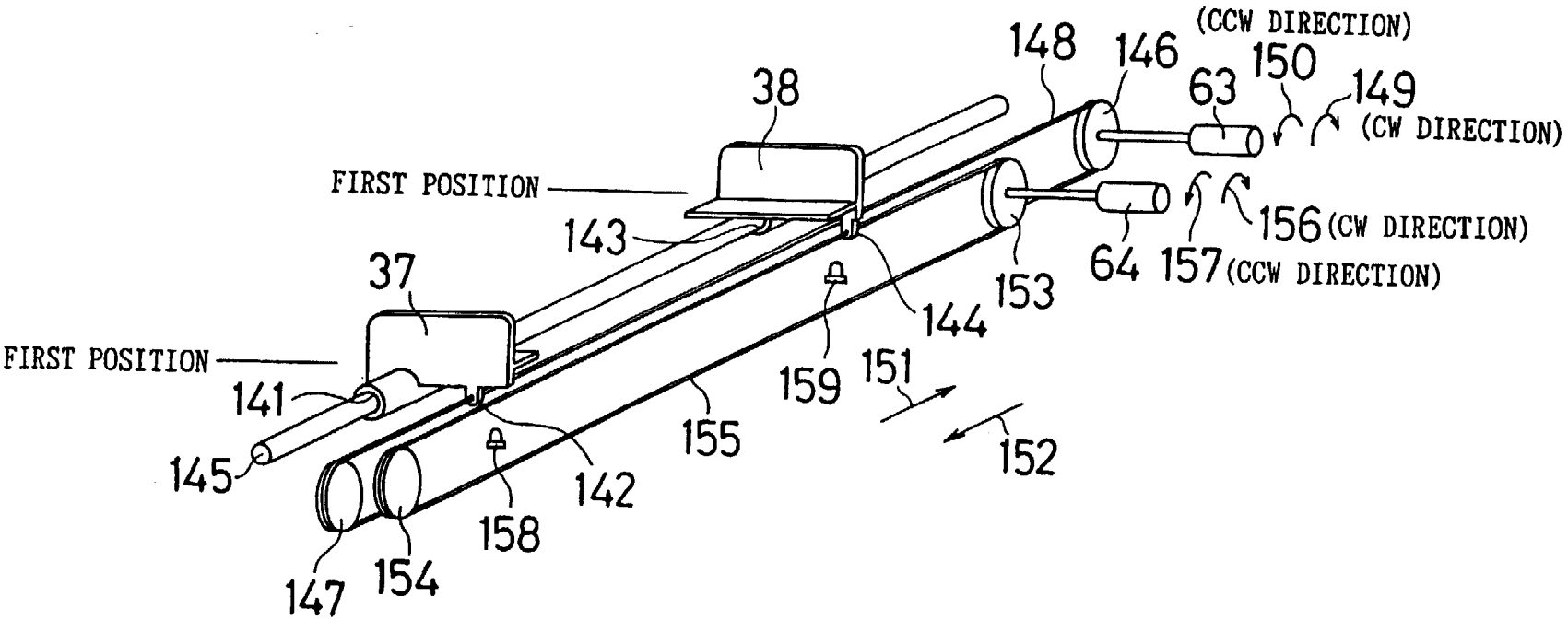
FIG. 27 is a perspective view showing a moving mechanism of joggers 37, 38 of the stapling apparatus 160.

FIG. 27 is a perspective view showing a moving mechanism of the joggers 37, 38 in the stapling apparatus 160. The joggers 37, 38 have through holes 141, 143 for allowing a guide 145 to slide therethrough, respectively. The guide 145 is positioned in the direction orthogonal to the conveying direction of the recording paper 43. The joggers 37, 38 also have projecting pieces 142, 144, respectively.

By rotating a driving motor 63 such as a stepping motor in mutually opposite directions 149, 150, a pulley 146 on the drive side is rotated in the same directions. A wire 148 is wound about the pulley 146 and a pulley 147 on the drive side. The projecting piece 142 of the jogger 37 is fixedly attached to the wire 148. Thus, by operating the driving motor 63, and rotating the pulley 146, the jogger 37 is moved in mutually opposite directions 151, 152.

This applies to the jogger 38 as well. In other words, by rotating a driving motor 64 such as a stepping motor in mutually opposite directions 156, 157, a pulley 153 on the drive side is also rotated in the same directions. A wire 155 is wound about the pulley 153 and a pulley 154 on the drive side. The projecting piece 144 of the jogger 38 is fixedly attached to the wire 155. Thus, by operating the driving motor 64, and rotating the pulley 153, the jogger 38 is moved in mutually opposite directions 151, 152.

A home position (HP) sensor 158 is placed at a position corresponding to a first position of the jogger 37 for detecting that the jogger 37 is at the first position, while a home position (HP) sensor 159 is placed at a position corresponding to a first position of the jogger 38 for detecting that the jogger 38 is at the first position.

Figure 28:
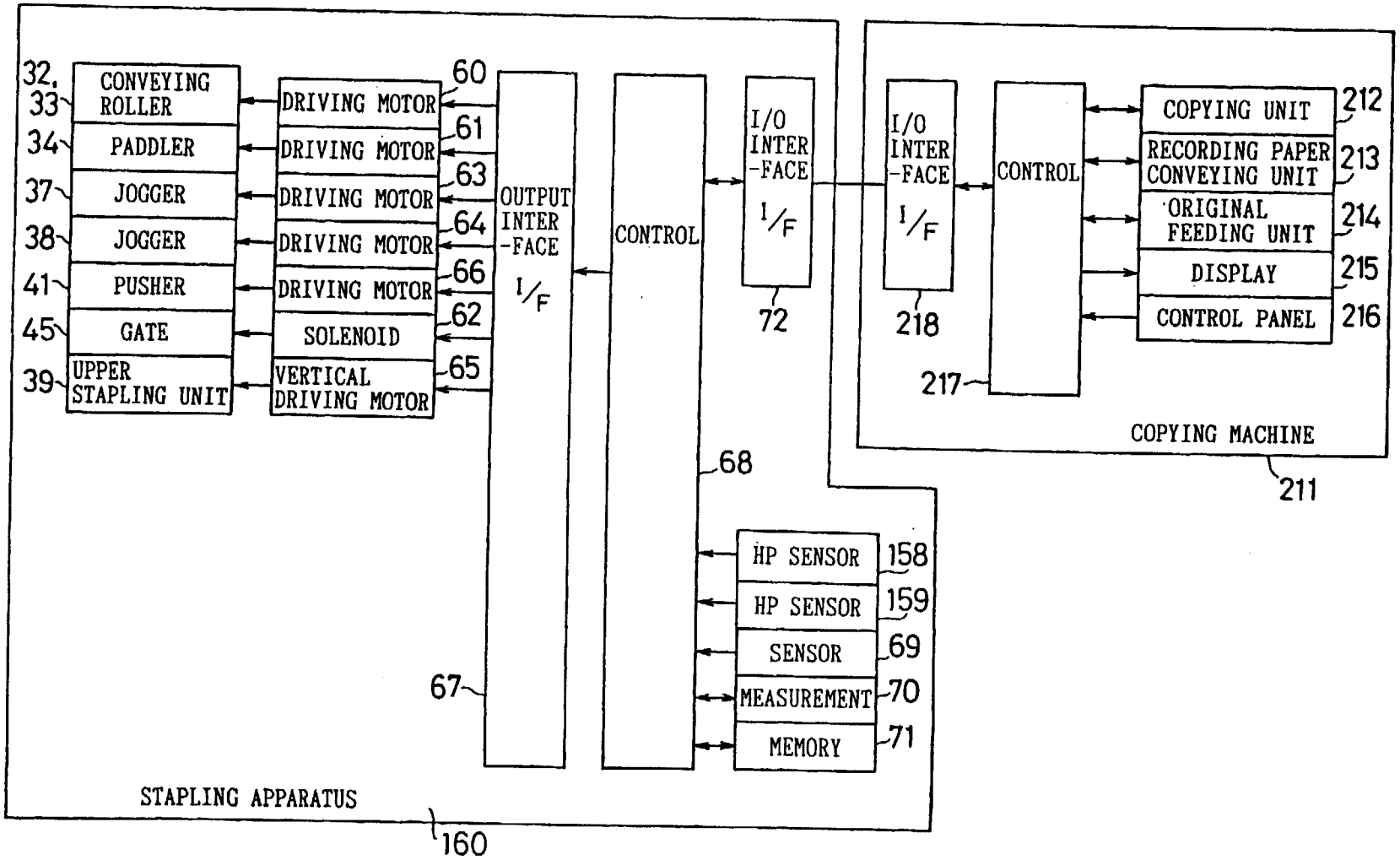
FIG. 28 is a block diagram showing an electrical structure of the stapling apparatus 160.

FIG. 28 is a block diagram showing an electrical structure of the stapling apparatus 160. The block diagram corresponds to the block diagram of FIG. 8 with the HP sensors 158, 159 added thereto. A control circuit 68 applies a control signal to the driving motors 63, 64 according to a stapling position selected through a control panel 216 of a copying machine 211 by an operator, and moves the joggers 37, 38. Specifically, the control circuit 68 controls the diving motors 63, 64 such that the joggers 37, 38 are moved apart from each other and toward each other for aligning, and they are moved in the same directions 151, 152 for moving the recording paper 43. Positioning of the joggers 37, 38 in the respective first positions is detected by "on"-state of the HP sensors 158, 159.

In the embodiment, a stapling operation is generally conducted after the joggers 37, 38 are placed in the first positions, and the recording paper 43 is aligned in those positions. In the embodiment, although the stapling operation is conducted in two positions for two-point binding, by more finely moving the joggers 37, 38, the stapling operation can be conducted in three or more positions for stapling the recording paper.

Figure 29:
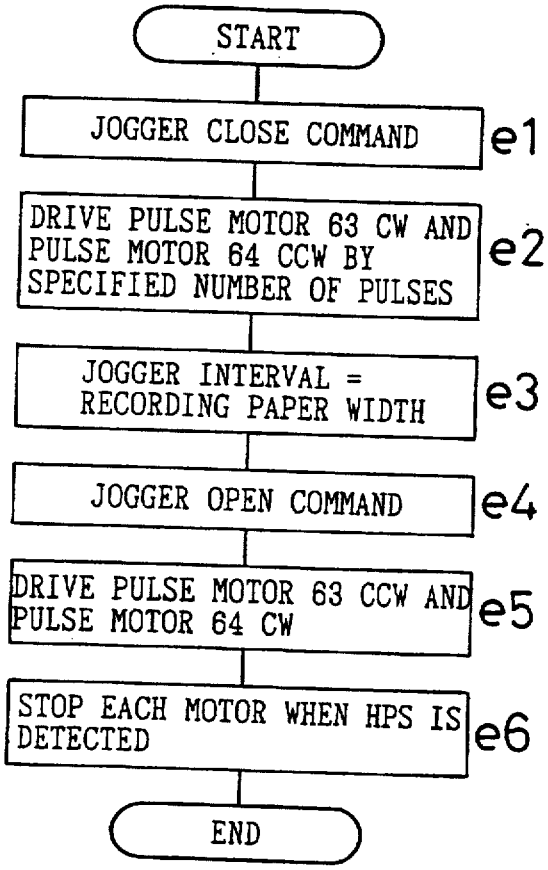
FIG. 29 is a flowchart showing operations for aligning recording paper 43 by the joggers 37, 38.

FIG. 29 is a flowchart showing an operation for aligning the recording paper 43 by the joggers 37, 38. In step e1, only one recording paper 43 is fed, and a control signal indicating closure of the joggers 37, 38 is outputted from the control circuit 68. In step e2, the driving motors 63, 64 are operated by a predetermined number of pulses. The driving motors 63 and 64 are rotated in the directions 149 and 157, respectively. In step e3, operation of the driving motors 63, 64 are discontinued when a distance between the joggers 37, 38 is identical with a width defined by the ends 43*b*, 43*c* of the recording paper 43. In such manner, the ends 43*b*, 43*c* are aligned.

In step e4, a control signal indicating opening of the joggers 37, 38 are outputted from the control circuit 68. In step e5, the driving motors 63, 64 are operated by a predetermined number of pulses. The driving motors 63 and 64 are rotated in the directions 150 and 156, respectively. In step e6, operation of the driving motors 63, 64 is discontinued when the HP sensors 158, 159 are turned "on".

Figure 30:
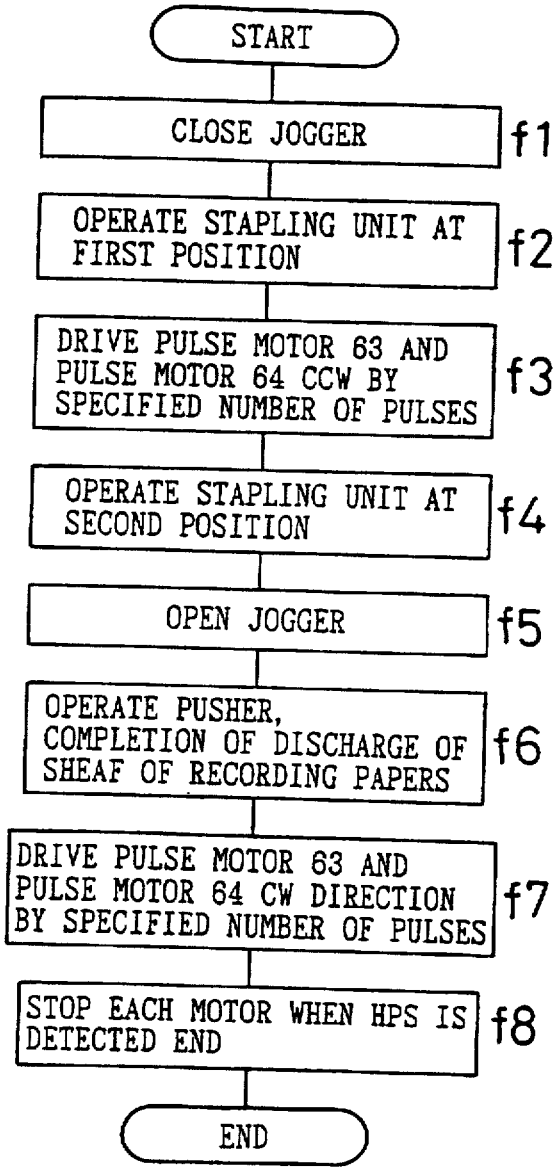
FIG. 30 is a flowchart showing an operation for moving the joggers 37, 38 in a same direction.

FIG. 30 is a flowchart showing an operation for moving the joggers 37, 38 in a same direction. In step fl, a control signal indicating closure of the joggers 37, 38 is outputted from the control circuit. In step f2, after operations similar to those of steps e2, e3 are conducted, the stapling units 39, 40 are put in action. In the operation, the joggers 37, 38 are in the first positions. In step f3, the driving motors 63, 64 are operated by a predetermined number of pulses. Here, the driving motors 63, 64 are rotated in the same directions 150, 157. Thus, the joggers 37, 38 are placed in the second positions.

In step f4, the stapling units 39, 40 are put in action. In step f5, a control signal indicating opening of the joggers 37, 38 is outputted from the control circuit 68. In step f6, the pusher 41 is put in action, and a stapled sheaf of recording papers 44 is discharged in the discharging direction 59. After the sheaf of recording papers 44 is discharged, the sequence is proceeded to step f7, and the diving motors 63, 64 are operated by a predetermined number of pulses. The driving motors 63, 64 are rotated together in the same directions 149, 156. In step f8, operation of the driving motors 63, 64 is discontinued when the HP sensors 58, 59 are turned "on".

As described, according to the seventh embodiment, as the upper and lower stapling units 39, 40 are fixedly provided, and the joggers 37, 38 are movable, the recording paper 43 can be moved in the direction orthogonal to the conveying direction. Therefore, the third to sixth embodiments can be achieved only by controlling an amount of movement of the joggers 37, 38, the construction is simplified, and a cost for producing the stapling apparatus is reduced. In addition, Although a vertical alignment at an accuracy of about 1/10 mm is required, in the case of moving the stapling units 39, 40, since the stapling units 39, 40 are stationary according to the embodiment, the accuracy of such alignment is out of question. In the embodiment, a stapling position of the recording paper 43 is allowed to be offset by about 1 mm, for example, in plural sheaves of recording paper 44.

Figure 31A:
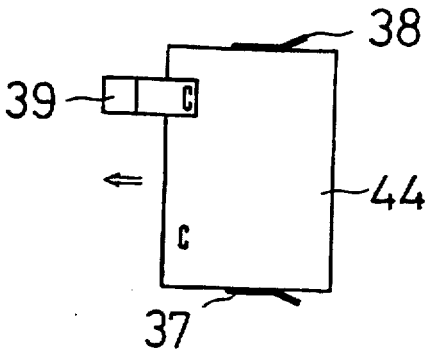
FIGS. 31A to 31C are schematic drawings for explaining operations of a stapling apparatus of a eighth embodiment of the invention.
Figure 31B:
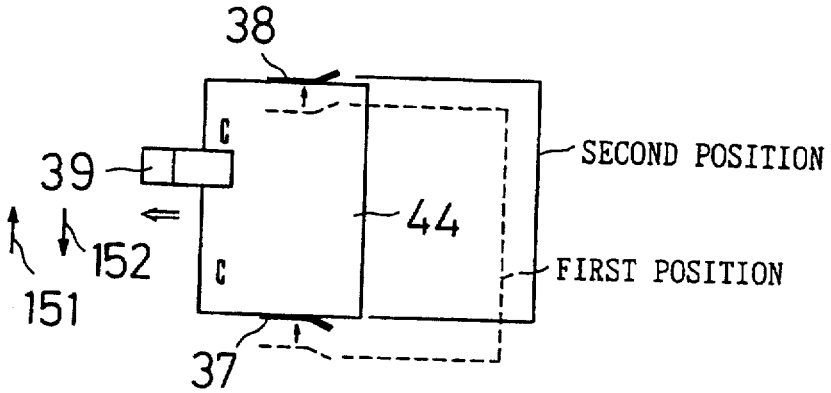
Figure 31C:
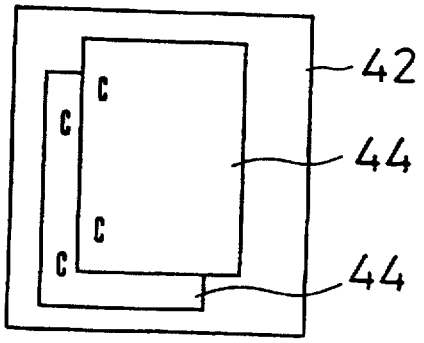

FIGS. 31A to 31C are schematic drawings for explaining operations of a stapling apparatus according to a eighth embodiment of the invention. The stapling apparatus according to the eighth embodiment is constructed similarly to the stapling apparatus 160 of the seventh embodiment, and is characterized in that joggers 37, 38 are moved in a same direction for discharging a stapled sheaf of recording papers 44.

For example, when an even-numbered sheaf of recording papers 44 is discharged, the joggers 37, 38 are placed in the first positions shown in FIG. 31A for discharging the sheaf of recording papers 44. In discharging an odd-numbered sheaf of recording papers 44, the joggers 37, 38 are placed in the second positions shown in FIG. 31B for discharging the sheaf of recording papers 44. Thus, the joggers 37, 38 are moved in the directions 151, 152, similarly to those of the seventh embodiment. A moving mechanism can be achieved, for example, in a manner similar to that of the seventh embodiment.

By discharging the sheaf of recording papers 44 in such manner, stapling positions in succeeding sheaves of recording paper 44 are never overlapped by each other on a discharge tray 42, as shown in FIG. 31C. The second positions in the eighth embodiment need not be selected identically with the second positions in the seventh embodiment.

Figure 32:
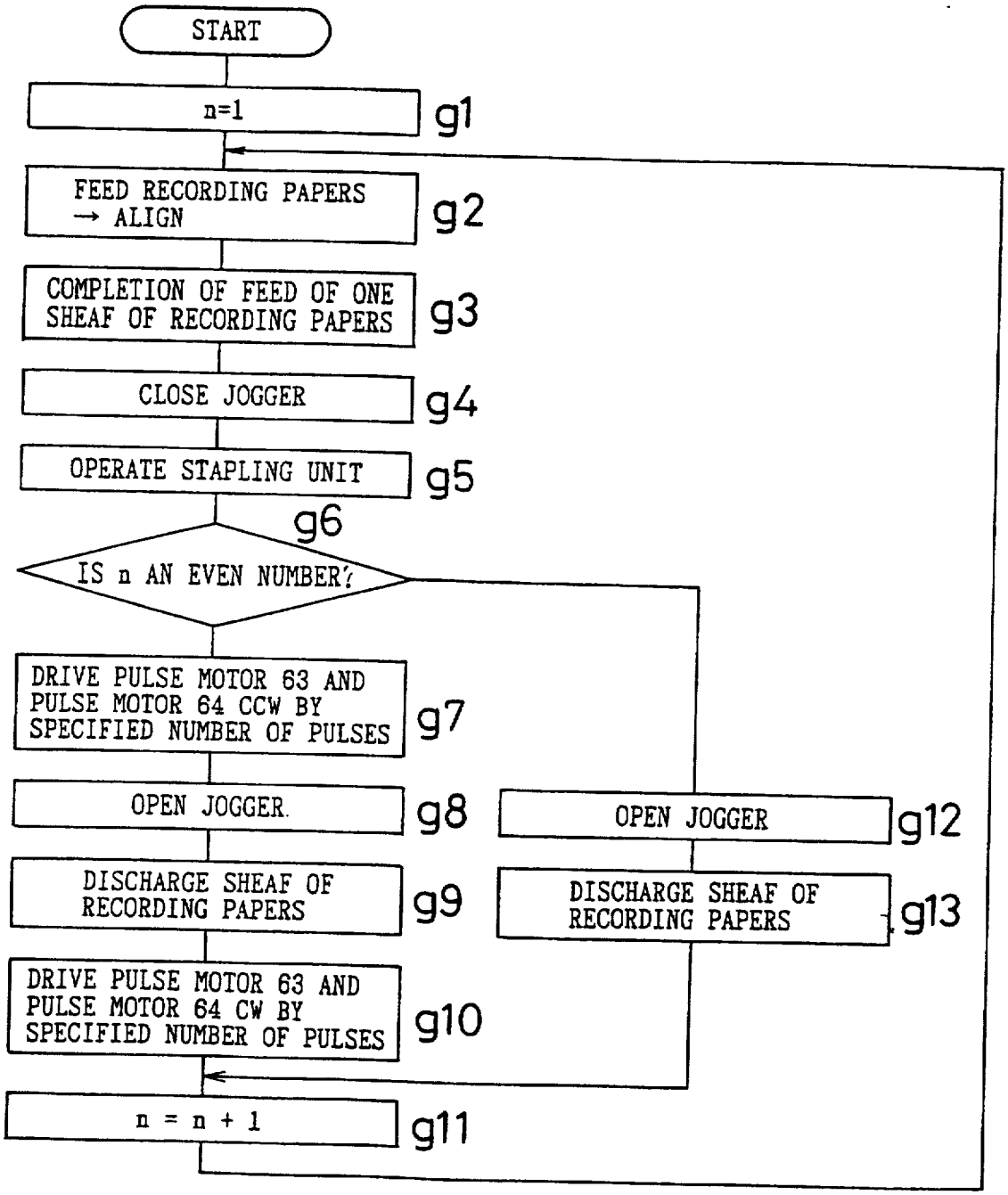
FIG. 32 is a flowchart showing operations of the stapling apparatus of the eight embodiment of the invention.

FIG. 32 is a flowchart showing operations of the stapling apparatus of the eighth embodiment. In step g1, a count n of a counter in a measuring circuit 70 is at 1, for example. In step g2, the recording paper 43 is fed, aligned, and held by the support plate 36. In step g3, recording papers 43 for a sheaf are completely fed. In step g4, the joggers 37, 38 are in a closed state. In step g5, the stapling units 39, 40 are put in action, and a stapled sheaf of recording papers 44 is produced.

In step g6, it is determined whether the count n is an even number or not, and the sequence is proceeded to step g7, if it is an even number, and the driving motors 63, 64 are operated by a predetermined number of pulses. The driving motors 63, 64 are rotated together in the same directions 150, 157. In step g8, the joggers 37, 38 are opened, and the stapled sheaf of recording papers 44 is discharged in step g9. In step g10, the driving motors 63, 64 are operated by a predetermined number of pulses. The driving motors 63, 64 are rotated together in the same directions 149, 156. In step g11, the count n of the counter is increased to n+1, and the sequence is returned to the step g2.

If it is determined that the count n is not an even number in the step g6, the sequence is proceeded to step g12, and the joggers 37, 38 are opened. In step g13, the stapled sheaf of recording papers 44 is discharged, and the sequence is returned to the step g11.

As described, according to the eighth embodiment, the stapled sheaf of recording papers 44 is discharged in such manner that stapling positions are not overlapped with each other between succeeding sheaves of recording paper 44. Thus, the discharge is never interfered by tangling between staples. Although a dedicated offset tray with a discharge tray constructed movably in the direction orthogonal to the discharging direction of the stapled sheaf of recording papers 44 has been conventionally provided for achieving such discharging operation, such offset tray requires a motor and a complicated moving mechanism for moving the discharge tray which holds the sheaves of recording paper discharged, for example, about 500 to 1000 recording papers (weighing approximately 10 kg or more), and a relatively high electric power is required for driving the motor. This results in a high cost. According to the embodiment, however, the operation is achieved by controlling movement of the joggers 37, 38. Therefore, the discharging operation can be achieved at a low cost without using an expensive dedicated offset tray.

Figure 33A:
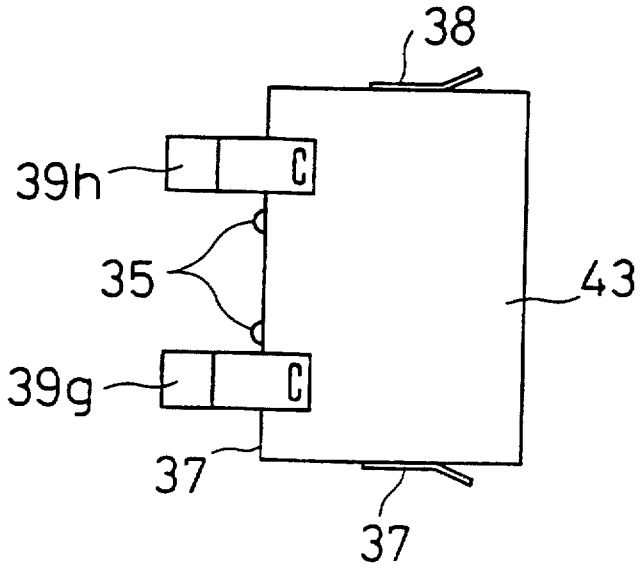
FIGS. 33A and 33B are schematic drawings for explaining operations of a stapling apparatus 173 of a ninth embodiment of the invention.
Figure 33B:
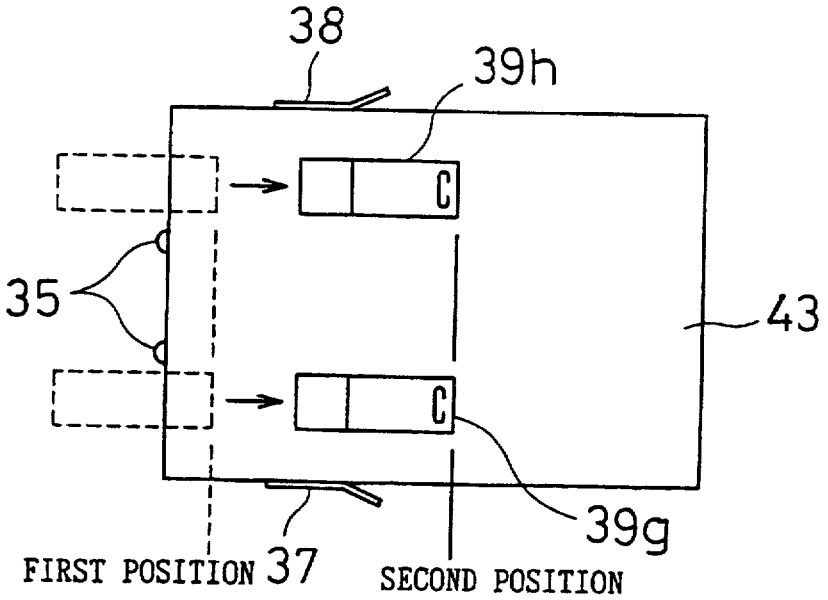

FIGS. 33A, 33B are schematic drawings for explaining operation of a stapling apparatus 173 according to a ninth embodiment of the invention. The stapling apparatus 173 according to the ninth embodiment is characterized in that plural sets (two sets, in the embodiment) of upper and lower stapling units 39*g*, 40*g*; 39*h*, 40*h* are provided in the direction orthogonal to the recording paper conveying direction 43, and two sets of stapling units are moved in synchronization with each other parallel to the conveying direction.

Two sets of stapling units 39*g*, 40*g*; 39*h*, 40*h* are placed at a first position shown in FIG. 33A, and conduct a stapling operation in that position for two-point binding. In the case of center binding, they are moved parallel to the recording paper 43 conveying direction to a second position shown in FIG. 33B, and conduct a stapling operation at that position.

Figure 34:
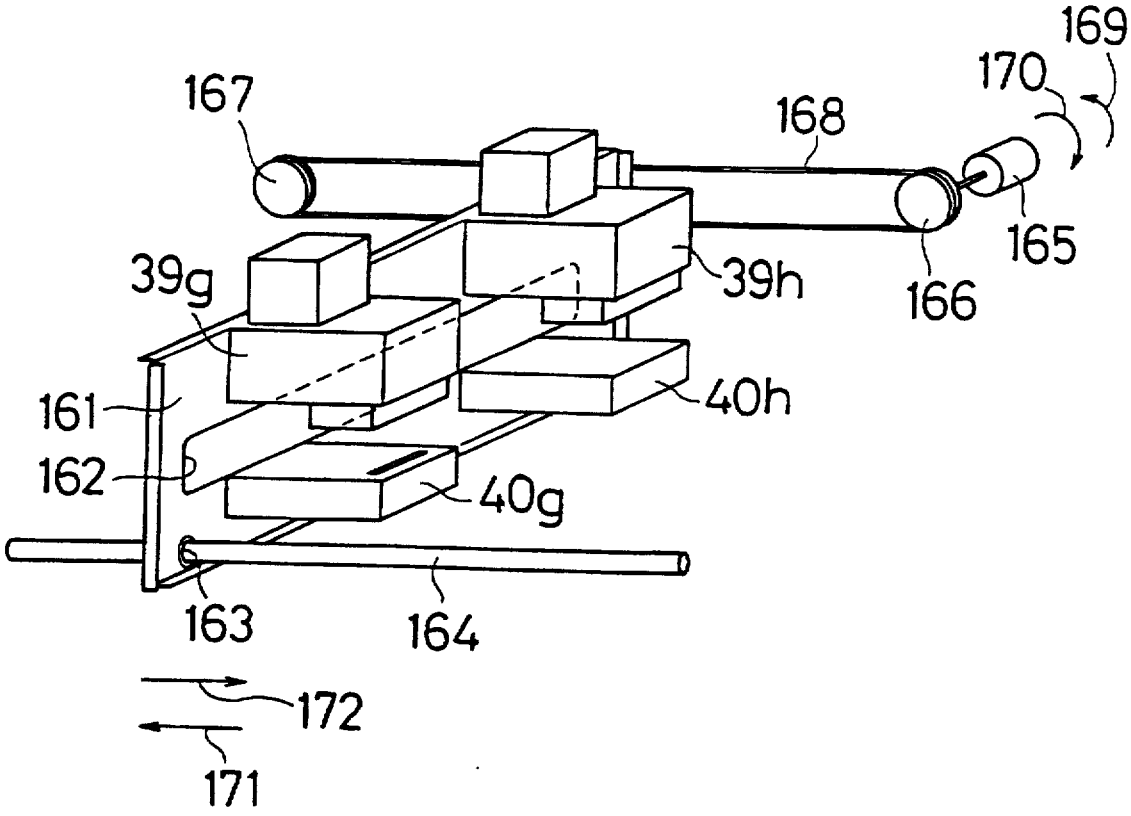
FIG. 34 is a perspective view showing a moving mechanism of stapling units 39*g*, 40*g*; 39*h*, 40*h*.

FIG. 34 is a perspective view showing a moving mechanism of the stapling units 39*g*, 40*g*; 39*h*, 40*h*. Both sets of stapling units 39*g*, 40*g*; 39*h*, 40*h* are fixedly attached to an attachment board 161. In the attachment board 161, a window 162 for inserting the recording paper 43 between the upper and lower stapling units is formed. The attachment plate 161 is also formed with a through hole 163 for allowing a guide 164 to slide therethrough. The guide 164 is positioned parallel to the conveying direction of the recording paper 43.

By rotating a driving motor 165 in mutually opposite directions 169, 170, a pulley 166 on the drive side is also rotated in the same directions. A wire 168 is wound about the pulley 166 and a pulley 167 on the drive side. An attachment board 161 is fixedly attached to the wire 168. Therefore, by operating the driving motor 165, and rotating the pulley 166, two sets of staple units 39*g*, 40*g*; 39*h*, 40*h* are moved synchronously together with the attachment plate 161 in mutually opposite directions 171, 172.

A support plate 36 is formed with two windows 30*d* corresponding to positions in which two sets of stapling units 39*g*, 40*g*; 39*h*, 40*h* are located, respectively, and the windows 30*d* are formed in a communicating manner in the direction of movement of the stapling units. Alternatively, the windows 30*d* may be formed, that is, four windows 30*d* may be provided in the first positions and second positions, respectively.

Figure 35:
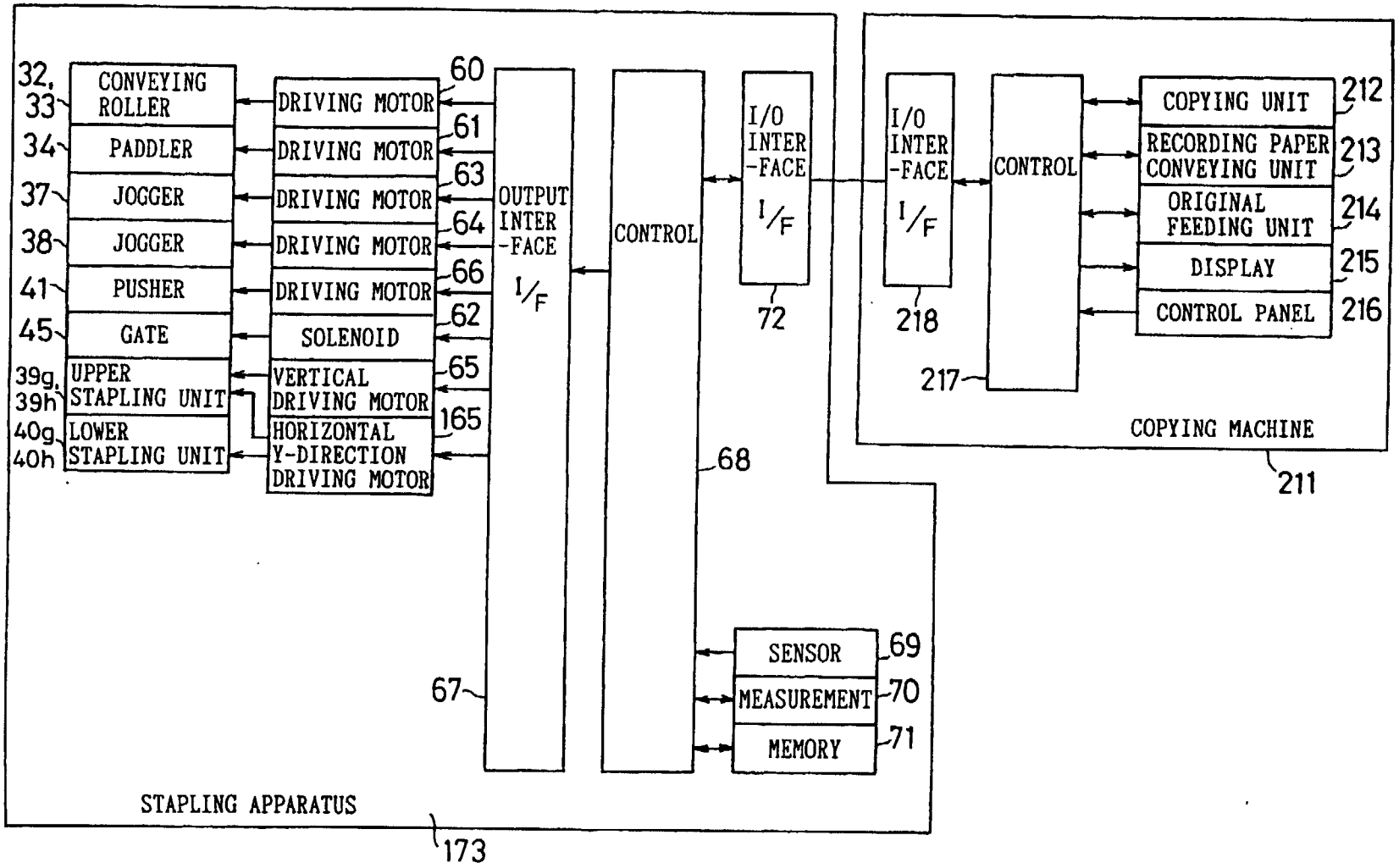
FIG. 35 is a block diagram showing an electrical structure of the stapling apparatus 173.

FIG. 35 is a block diagram showing an electrical structure of the stapling apparatus 173. The block diagram shown corresponds to the block diagram of FIG. 8 with the upper stapling unit 39 replaced by the upper stapling units 39*g*, 39*h* and the lower stapling units 40*g*, 40*h* and driving motor 165 added thereto.

A control circuit 68 applies a control signal to the driving motor 165 such as a pulse motor according to a stapling position selected through a control panel 216 of a copying machine 211 by an operator. By applying a predetermined number of pulses, the upper and lower stapling units 39*g*, 40*g*; 39*h*, 40*h* are moved in the directions 171, 172.

As described, according to the ninth embodiment, a set of the stapling units can bind the recording paper 43 in plural positions in the direction parallel to the recording paper 43 conveying direction. In the embodiment, although two sets of stapling units 39*g*, 40*g*; 39*h*, 40*h* are provided, by employing more sets of stapling units, stapling can be achieved in more positions in the direction orthogonal to the conveying direction.

A moving mechanism for synchronously moving the stapling units can be achieved in a simple manner without combining a lot of components such as the gears 104, 105 and racks 102, 103 as in the case of the fourth embodiment, and construction in the vicinity of the stapling units comes to be compact.

Figure 36A:
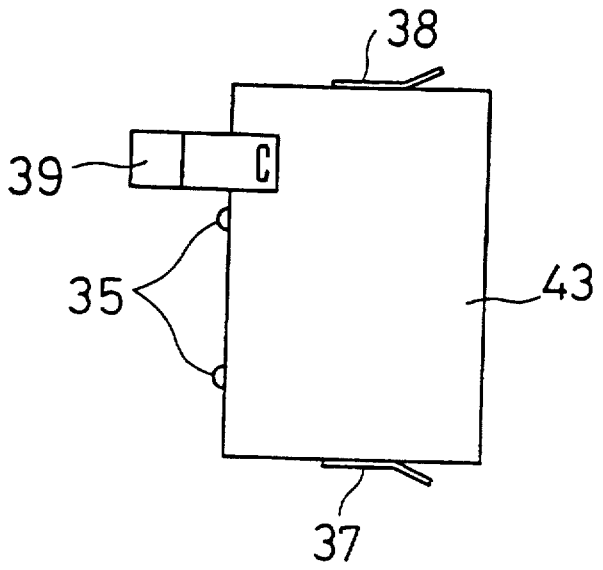
FIGS. 36A and 36B are schematic drawings for explaining operations of a stapling apparatus 203 of a tenth embodiment of the invention.
Figure 36B:
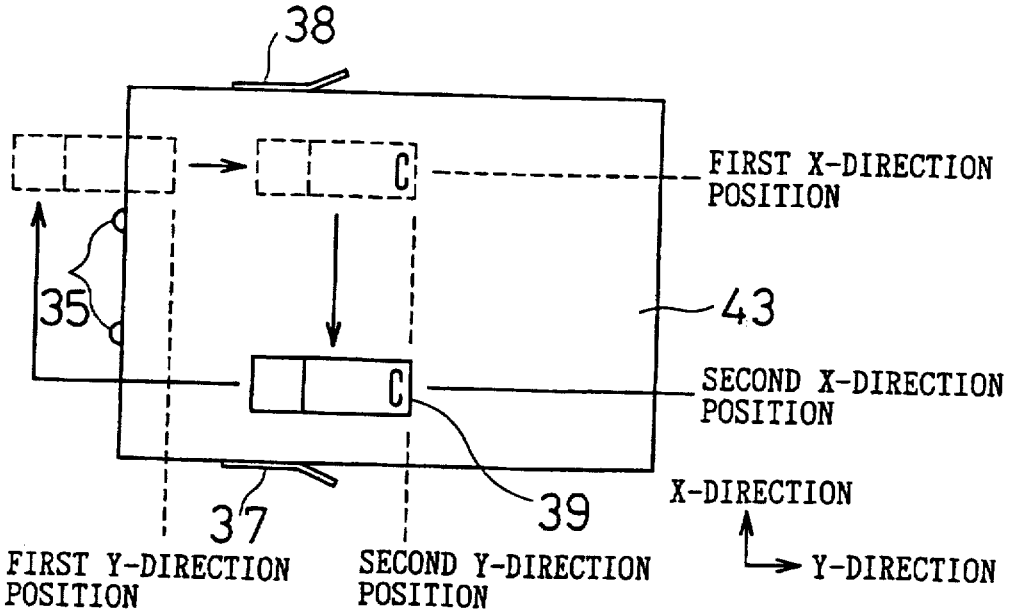

FIGS. 36A, 36B are schematic drawings for explaining operations of a stapling apparatus 203 according to a tenth embodiment of the invention. The stapling apparatus 203 according to the tenth embodiment is characterized in that upper and lower stapling units 39, 40 are synchronously moved in the directions parallel and orthogonal to the recording paper 43 conveying direction.

A set of stapling units 39, 40 are located at first position in the X and Y directions shown in FIG. 36A, and conduct a stapling operation at that position for corner binding, and a stapled sheaf of recording papers 44 is discharged. In the case of center binding, they are located at a second position in the Y direction, while the position in the X direction is unchanged, and conduct a stapling operation at that position. Successively, they are located at a second position in the X direction, while the position in the Y direction is unchanged, and conduct a stapling operation at that position. After the stapling operations in two positions are completed, a stapled sheaf of recording papers 44 is discharged, and the stapling units 39, 40 are returned to the first position in the X and Y directions.

Figure 37:
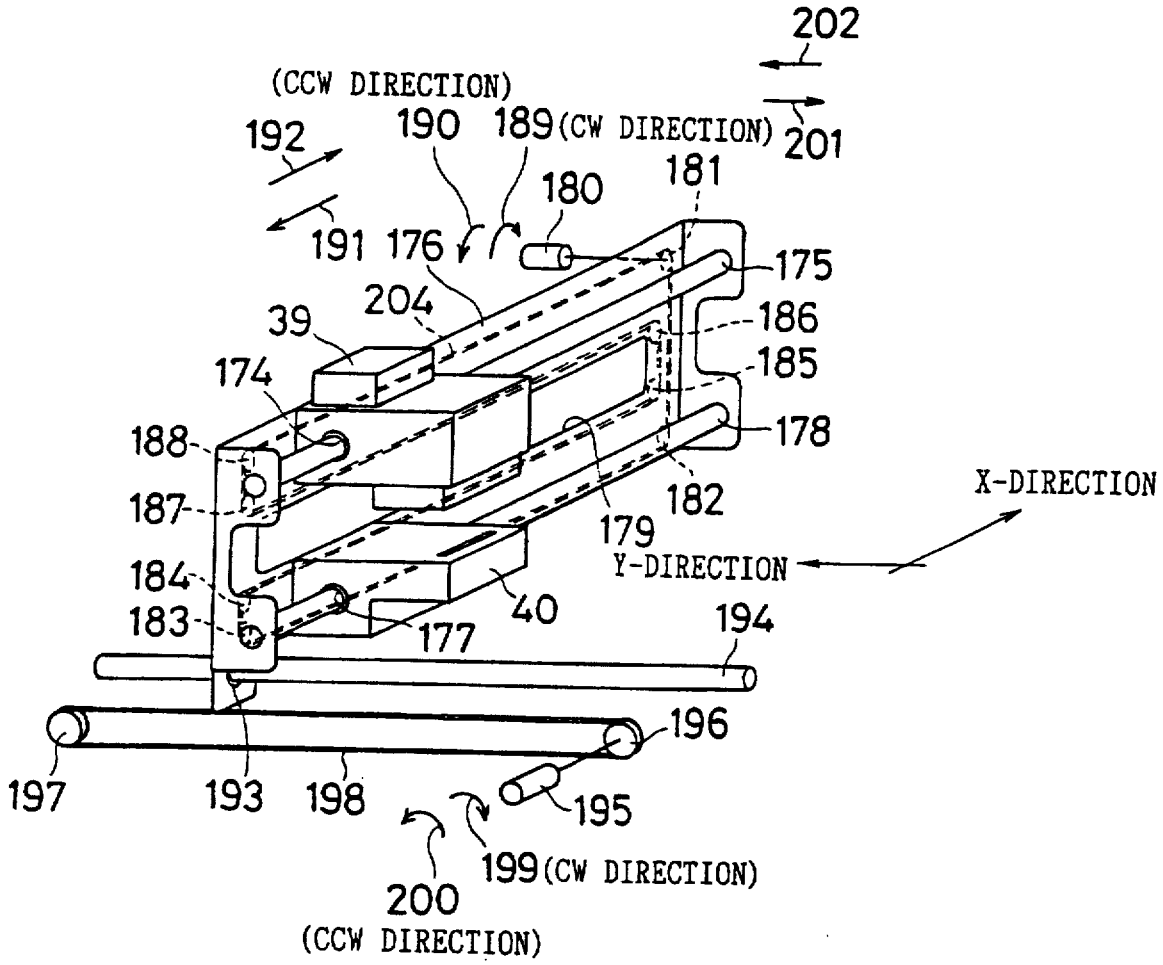
FIG. 37 is a perspective view showing a moving mechanism of stapling units 39, 40.

FIG. 37 is a perspective view showing a moving mechanism of the stapling units 39, 40. Through holes 174, 177 for allowing guides 175, 178 to slide therethrough are formed, respectively, in main stapling members of the upper and lower stapling units 39, 40. The guides 175, 178 are positioned in the direction orthogonal to the conveying direction of the recording paper 43. The upper and lower stapling units 39, 40 and the guides 175, 178 are attached to an attachment board 176. The attachment board 176 is formed with a window 179 for inserting the recording paper 43.

By rotating a driving motor 180 in mutually opposite directions 189, 190, a pulley 181 on the drive side is also rotated in the same directions. A wire 204 is wound about the pulley 181 and plural (seven, in the embodiment) pulleys 182 to 188 on the drive side provided along a surface of the attachment board 176. The upper and lower stapling units 39, 40 are fixedly attached to a portion of the wire 204 arranged to move in a same direction. Therefore, by operating the driving motor 180, and rotating the pulley 181, the upper and lower stapling units 39, 40 are moved in mutually opposite directions 191, 192.

The attachment board 176 is further formed with a through hole 193 for allowing a guide 194 to slide therethrough. The guide 194 is positioned parallel to the conveying direction of the recording paper 43. By rotating a driving motor 195 in mutually opposite directions 199, 200, a pulley 196 on the drive side is also rotated in the same directions. A wire 198 is wound about the pulley 196 and a pulley 197 on the drive side. An attachment board 176 is fixedly attached to the wire 198. Thus, by operating the driving motor 195, and rotating the pulley 196, the upper and lower stapling units 39, 40 are moved in mutually opposite directions 201, 202.

A support plate 36 is formed with a big window 30*d* communicating in the direction of movement of the stapling units 39, 40. Alternatively, the windows 30*d* may be formed in such positions that the stapling units 39, 40 are stopped.

Figure 38:
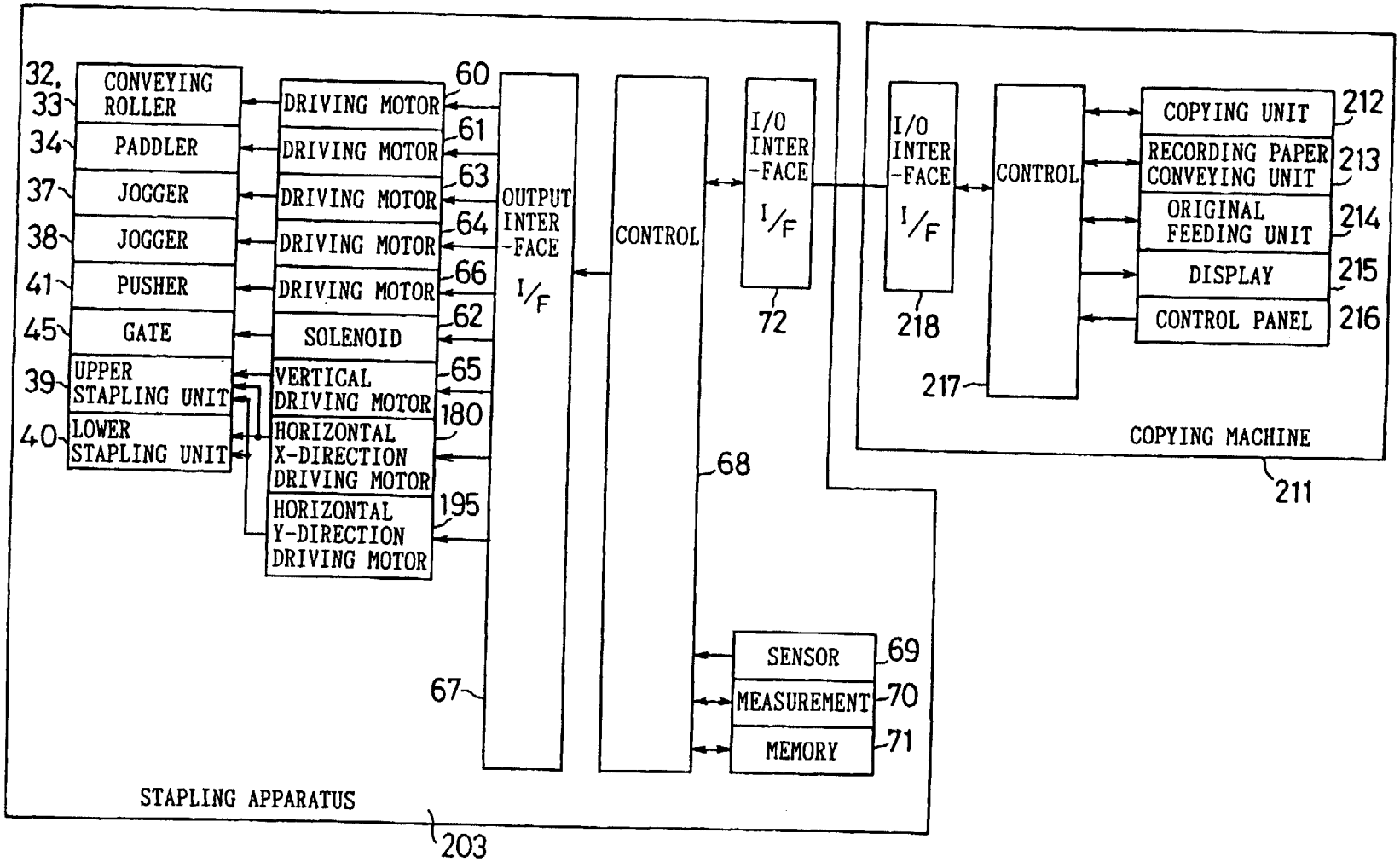
FIG. 38 is a block diagram showing an electrical structure of the stapling apparatus 203.

FIG. 38 is a block diagram showing an electrical structure of the stapling apparatus 203. The block diagram shown corresponds to the block diagram of FIG. 8 with the lower stapling unit 40 and driving motors 180, 195 added thereto.

A control circuit 68 applies a control signal, respectively, to the driving motors 180, 195 such as pulse motors according to a stapling position inputted through a control panel 216 of a copying machine 211 by an operator. By applying a predetermined number of pulses, for example, the upper and lower stapling units 39, 40 are moved in the directions 191, 192; 201, 202.

In the embodiment, the set of stapling units 39, 40 are generally located at the first position in the X direction and the first position in the Y direction.

Figure 39:
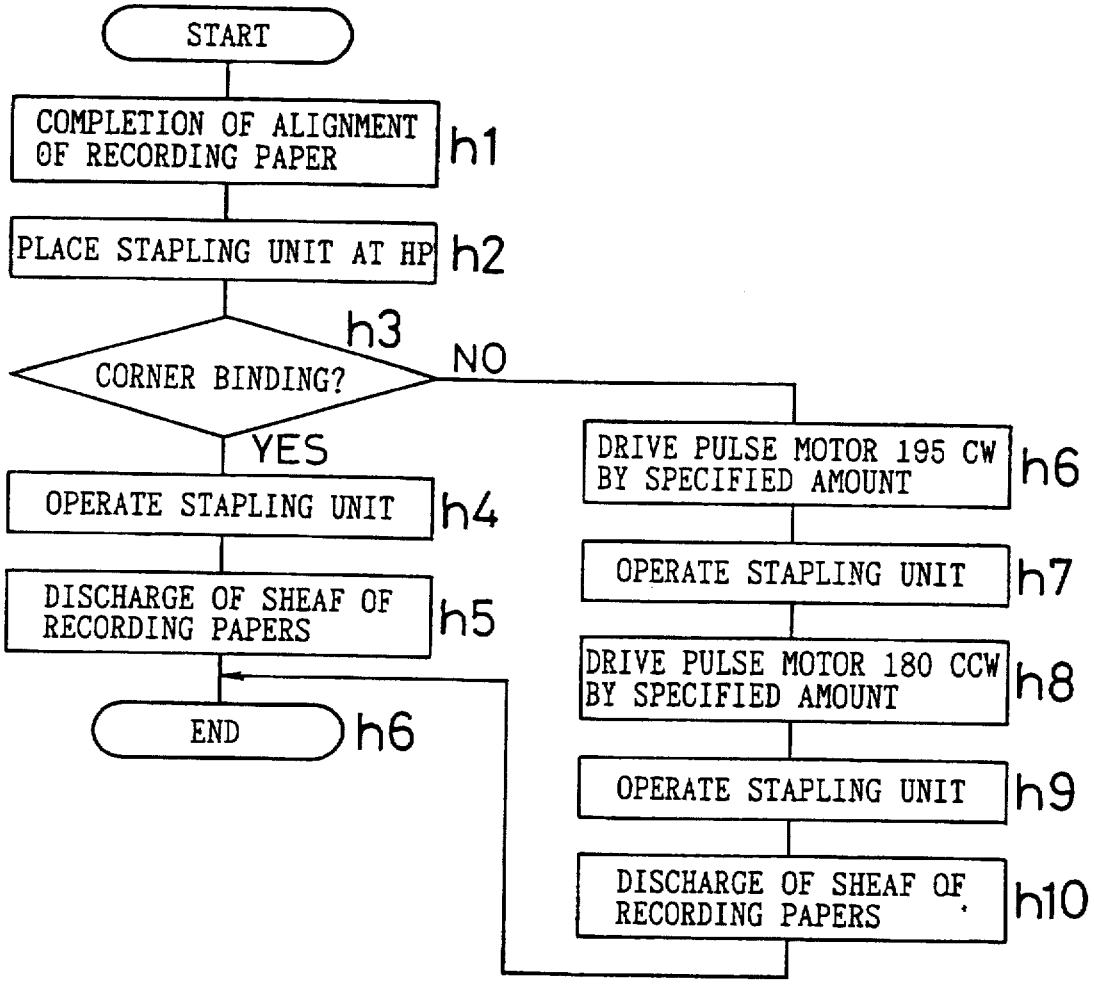
FIG. 39 is a flowchart showing operations of the stapling apparatus 203.

FIG. 39 is a flowchart showing operations of the stapling apparatus 203. The flowchart is for the case of selecting between corner binding and center binding. In step h1, a predetermined number of recording papers 43 are aligned, and held on the support plate 36. In step h2, the stapling units 39, 40 are at a home position, that is, at the first position in the X direction and the first position in the Y direction. In step h3, it is determined whether the corner binding should be conducted or not, and the sequence is proceeded to step h4, if the corner binding should be conducted. In step h4, the stapling units 39, 40 are put in action, and a stapled sheaf of recording papers 44 is produced. In step h5, the stapled sheaf of recording papers 44 is discharged.

If it is determined in step h3 that the corner binding should not be conducted, the sequence is proceeded to step h6, and the driving motor 195 is operated by a predetermined number of pulses. The driving motor 195 is rotated in the direction 199, and the stapling units 39, 40 are thereby placed at the first position in the X direction and second position in the Y direction. In step h7, the stapling units 39, 40 are put in action.

In step h8, the driving motor 180 is operated by a predetermined number of pulses. The driving motor 180 is rotated in the direction 190. The stapling units 39, 40 are thereby placed at the second position in the X direction and second position in the Y direction. In step h9, the stapling units 39, 40 are put in action. Thus, a sheaf of sheets of recording paper 44 stapled in the center is produced. In step h10, the stapled sheaf of recording papers 44 is discharged.

As described, according to the tenth embodiment, the recording paper 43 can be bound in plural positions in the directions parallel and orthogonal to the conveying direction of the recording paper 43 by using the set of stapling units 39, 40. It means that the recording paper 43 can be bound at any position in the entire surface thereof. A moving mechanism for synchronously moving the set of stapling units 39, 40 can be achieved in a simple manner similarly to the case of the ninth embodiment, and construction in the vicinity of the stapling units comes to be compact.

In all embodiments illustrated above, although the stapling apparatus is described, by way of example, as a postprocessing apparatus (generally called a finishing apparatus) used with such apparatus that produces copies one after another in the order of pages, and repeats the copying operation until required sets of copies are obtained in a so-called on-line processing system, it may be provided as a so-called off-line postprocessing apparatus used in connection with such apparatus as a print machine or similar apparatus which produces required prints from a page at a time, and repeats the printing operation for given pages. In the latter case, recording papers are once stored by pages in a sorter, then bound after they are collected in the order of pages by a collector.

Figure 40:
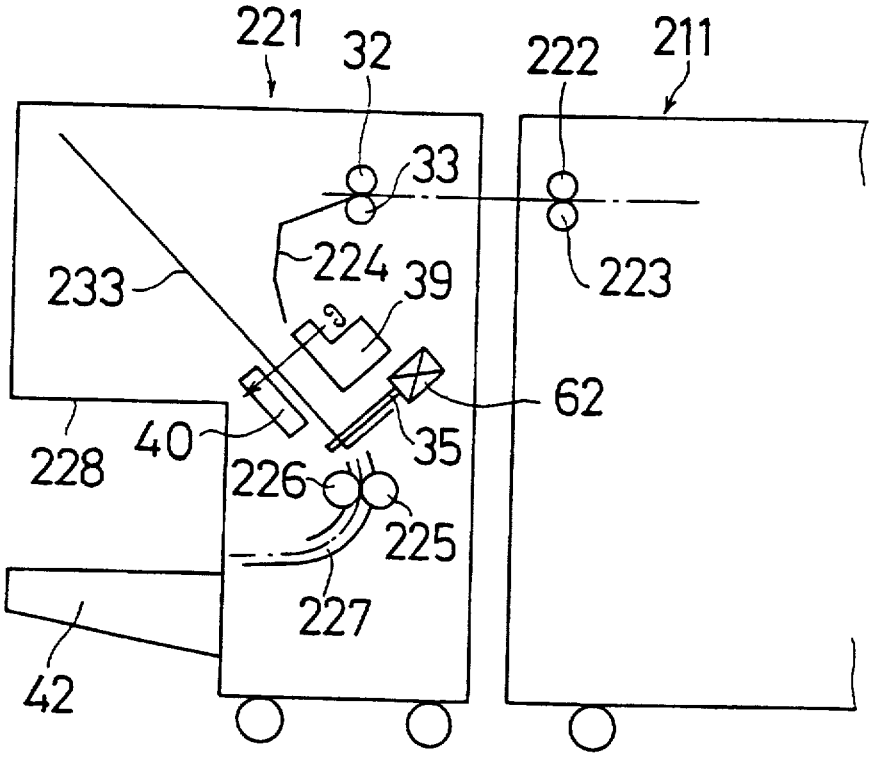
FIG. 40 is a side view showing a construction of a finishing apparatus 221 of an eleventh embodiment of the invention.

FIG. 40 is a side view showing a construction of a finishing apparatus 221 of an eleventh embodiment of the invention. Although a stapling position in the eleventh to thirteenth embodiments is located oppositely to that of the first to tenth embodiments, stapling at a desired stapling position can be achieved by reversing the direction of originals set in a copying machine 211 or reversing the discharging direction of recording paper from the copying machine 211.

The finishing apparatus 221 comprises conveying rollers 32, 33, gate 35, upper stapling unit 39 and lower stapling unit 40 similar to those of the stapling apparatus 31 described in the first embodiment, and further comprises discharge rollers 225, 226 and collection tray 233.

Recording paper 43 discharged by discharge rollers 222, 223 of a copying machine 211 to which the finishing apparatus 221 is attached is conveyed by the conveying rollers 32, 33 of the finishing apparatus 221, and fed along a guide plate 244 to a stapled sheaf production area for producing a stapled sheaf of recording papers 44.

The collection tray 233 in the stapled sheaf production area is positioned at a predetermined angle to the horizontal direction of, for example, a bottom surface of housing 228, preferably at such predetermined angle that an end corresponding to a upstream side in the conveying direction of the recording paper is located at a lower level. The angle is selected, for example, to be 45° or more. A depth of the collection tray 233 is selected such that an upstream side in the conveying direction of the recording paper 43 transferred thereto is placed above the recording paper 43 already collected by the collection tray 233. The gate 35 is attached in a manner movable toward/apart from a holding face of the collection tray 233, and positioned in the vicinity of the holding face, when the recording paper 43 is transferred thereto. The gate 35 is driven by a solenoid 62.

The gate 35 is positioned orthogonal to the holding face of the collection tray 233 below the collection tray 233, and provided in such manner that it is moved toward/apart from the holding face by the solenoid 62. The fed recording paper 43 is conveyed with the conveying direction reversed (switched back) so that an upstream end in the conveying direction thereof abuts against the gate 35 in the vicinity of the holding face, and held by the collection tray 233.

The upper and lower stapling units 39, 40 positioned above and below the collection tray 233 between them, respectively, are put in action when the recording papers 43 held reaches a predetermined number of recording papers, and produce a stapled sheaf of recording papers 44 by stapling the recording paper 43.

As the stapled sheaf of recording papers 44 is produced, the gate 35 driven by the solenoid 62 is moved apart from the collection tray 233. Thus, the sheaf of recording papers 44 falls downward by its own weight, is conveyed along a conveying path 227 by the discharge roller 225, 226, and discharged to a discharge tray 42 through an outlet below an inlet of the recording paper 43. The conveying rollers 32, 33, guide plate 224, collection tray 233, upper stapling unit 39, lower stapling unit 40, gate 35, solenoid 62, conveying rollers 225, 226 and conveying path 227 are enclosed in a housing 228. The housing 228 is provided at least with an inlet for feeding the recording paper 43 and an outlet for discharging the stapled sheaf of recording papers 44.

The finishing apparatus 221 is provided with joggers 37, 38 similar to those of the first embodiment, although they are not shown.

Figure 41:
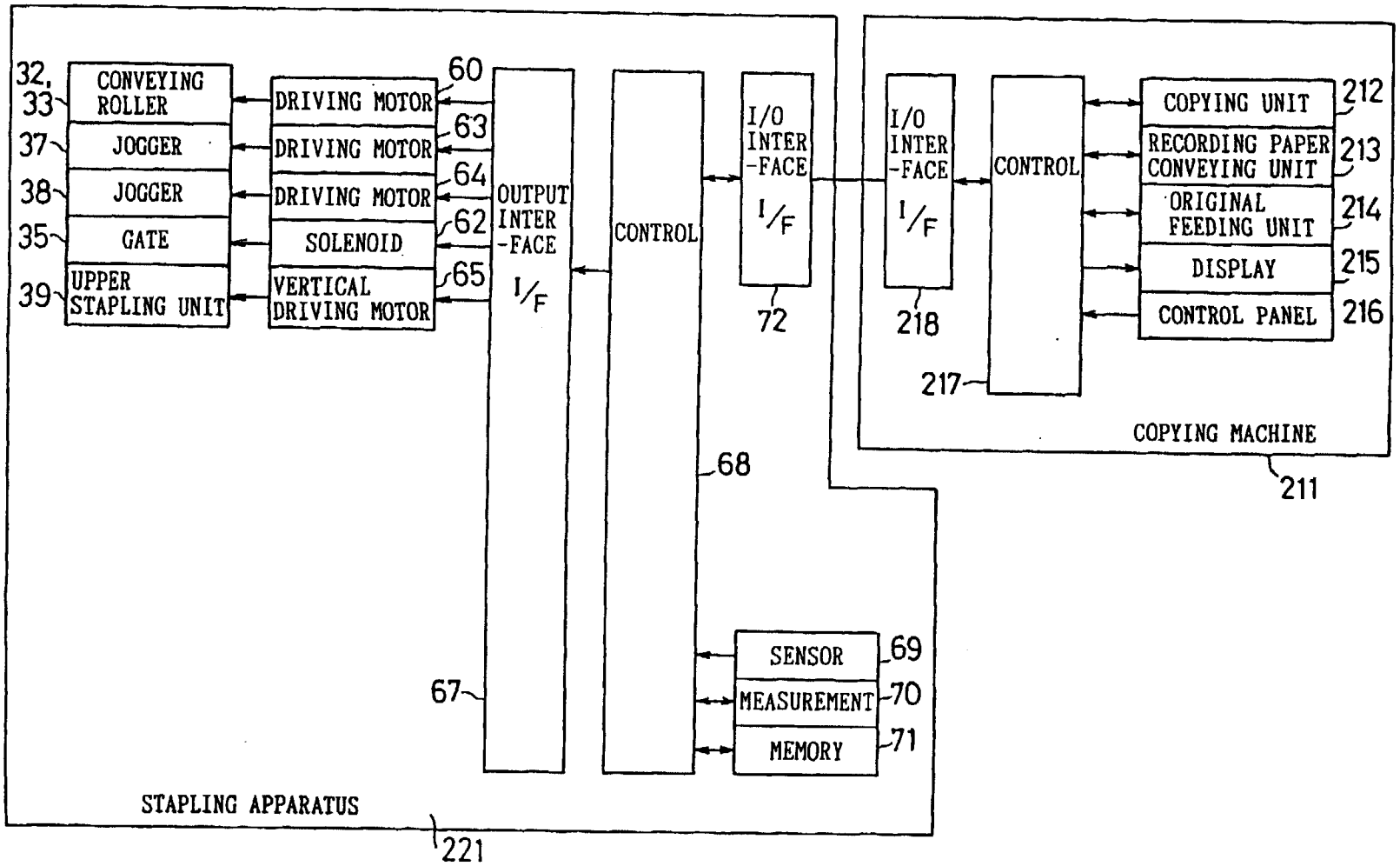
FIG. 41 is a block diagram showing an electrical structure of the finishing apparatus 221.

FIG. 41 is a block diagram showing an electrical structure of the finishing apparatus 221. The finishing apparatus 221 is generally constructed similarly to the stapling apparatus 31, and includes driving motors 60, 63, 64, solenoid 62 and driving motor 65 for driving the conveying rollers 32, 33, joggers 37, 38, gate 35 and upper stapling unit 39, respectively, while the paddler 34, pusher 41 and driving motors 61, 66 for driving them, provided in the stapling apparatus 31, are eliminated. Otherwise, it is constructed similarly to the stapling apparatus 31, and similar members are shown by identical reference numerals.

Figure 42:
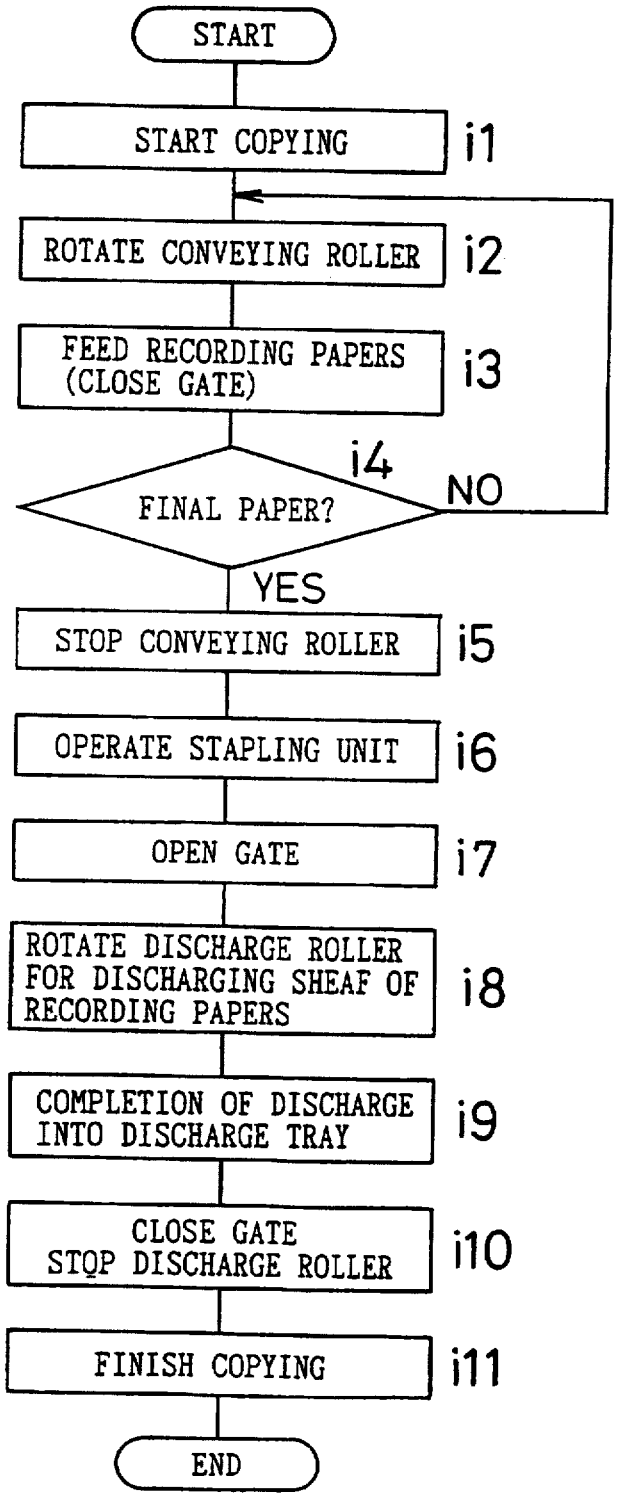
FIG. 42 is a flowchart showing operations of the finishing apparatus 221.

FIG. 42 is a flowchart showing operations of the finishing apparatus 221. FIGS. 43A to 43E are side views showing operations of the finishing apparatus 221 in steps. In step i1, initiation of copying operation is instructed through a control panel 216 of a copying machine 211, and the copying operation is initiated. In step i2, the conveying rollers 32, 33 of the finishing apparatus 221 start rotating in the directions 45, 46 shown in FIG. 43A.

Figure 43A:
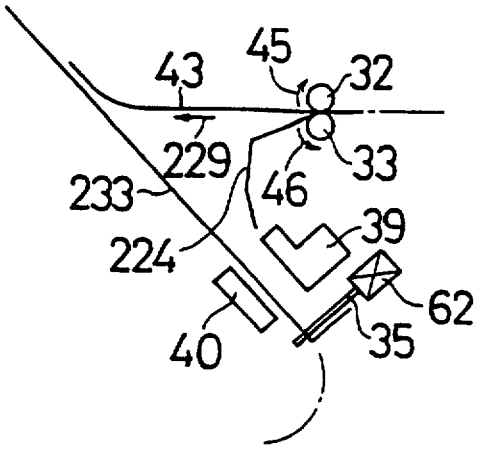
FIGS. 43A to 43E are side views showing operations of the finishing apparatus 221 in steps.
Figure 43D:
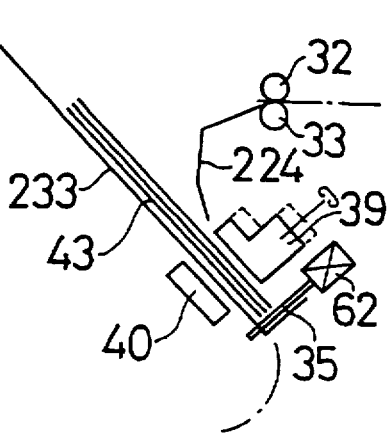
Figure 43B:
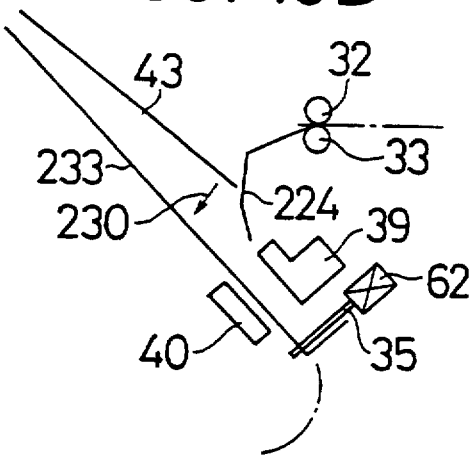
Figure 43E:
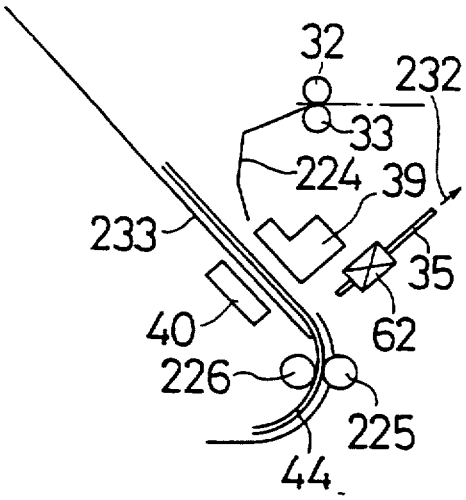
Figure 43C:
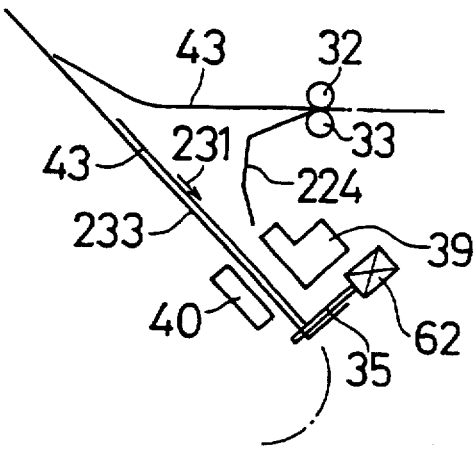

In step i3, the recording paper 43 is fed. The recording paper 43 is clinched by the conveying rollers 32, 33, and conveyed in the direction 229 shown in FIG. 43A. At this time, the gate 35 is in a closed state in the vicinity of the collection tray 233. The recording paper 43 is conveyed along the guide plate 224 in such manner that an upstream end in the feeding direction is in a level lower than a downstream end in the feeding direction thereof. Successively, as shown in FIG. 43B, the upstream end in the feeding direction falls in the direction shown by an arrow 230 toward the collection tray 233, drops in the downward direction 231, as shown in FIG. 43C, and is held as it is abutted by the gate 35. Thus, the upstream end in the feeding direction of the recording paper turns to be a downstream end in the discharging direction, and the conveying direction is reversed.

In step 14, It is determined whether the fed recording paper 43 is a final one or not, and the sequence is proceeded to step i5, if it is a final sheet, while the sequence is returned to step i2, if not. In step i5, rotation of the conveying rollers 32, 33 is discontinued. In step i6, as shown in FIG. 43D, the upper and lower stapling units 39, 40 are put in action, and a stapled sheaf of recording papers 44 is produced. In step i7, the gate 35 is moved apart from the collection tray 233 to an open state.

In step i8, the discharge rollers 225, 226 for discharging the sheaf of recording papers 44 are rotated. The sheaf of recording papers 44 falls down by its own weight, as shown in FIG. 43E, conveyed along the conveying path 227 by the discharge rollers 225, 226, and discharged to the discharge tray 42. In step i9, discharge of the sheaf of recording papers 44 to the discharge tray 42 is completed. In step i10, the gate 35 is closed. Rotation of the discharge rollers 225, 226 is discontinued. In step i11, the copying operation of the copying machine 211 is completed.

As described, according to the eleventh embodiment, the pusher 41 for discharging the sheaf of recording papers 44 and the paddler 34 for aligning the recording paper 43 with the gate 35 as described in the first to tenth embodiments are not required, and construction of the finishing apparatus 221 is simplified. Also, since the collection tray 233 is positioned at an inclination and a storage space is effectively used, a space for a conveying system can be reduced. Since the recording papers 43 to be stapled next can be fed immediately after the sheaf of recording papers 44 is discharged, conveying time is shortened, and the stapled sheaf of recording papers 44 can be efficiently produced.

Besides, by using such construction that the conveying direction is reversed as shown in the embodiment, a length parallel to the feeding direction of the apparatus is reduced, and the apparatus is realized in a compact size.

The collection tray 233 may be positioned at a predetermined angle so that an end corresponding to the downstream side in the feeding direction of the recording paper is located in a lower level. Even in the case of such construction, a length parallel to the feeding direction of the apparatus is reduced, and the apparatus can be realized in a compact size.

The stapling units 39, 40 of the finishing apparatus 221 can be placed in a side of general operation by an operator by selecting the recording paper conveying direction or the arrangement of originals set in the copying machine 211, such operation as refilling of staples and maintenance can be easily conducted. Such effect is obtained, however, only in the case single stapling units 39, 40 are provided, and the home position is selected in the side of one or the other end of the support plate 36 in the direction orthogonal to the conveying direction of the recording paper. Although the size of an apparatus can be reduced by angularly positioning the collection tray 233 as described, the controllability is reduced, because the stapled sheaf of recording papers is discharged from a lower part of the apparatus.

The finishing apparatus 221 according to the embodiment can also be achieved in combination with the stapling apparatuses according to the second to tenth embodiments. In other words, it is possible to provide plural gates 35 in the finishing apparatus 221, provide plural upper and lower stapling units 39, 40, allow the upper stapling unit 39 to move, allow the lower stapling unit 40 to move, and allow the joggers 37, 38 to move.

Figure 44:
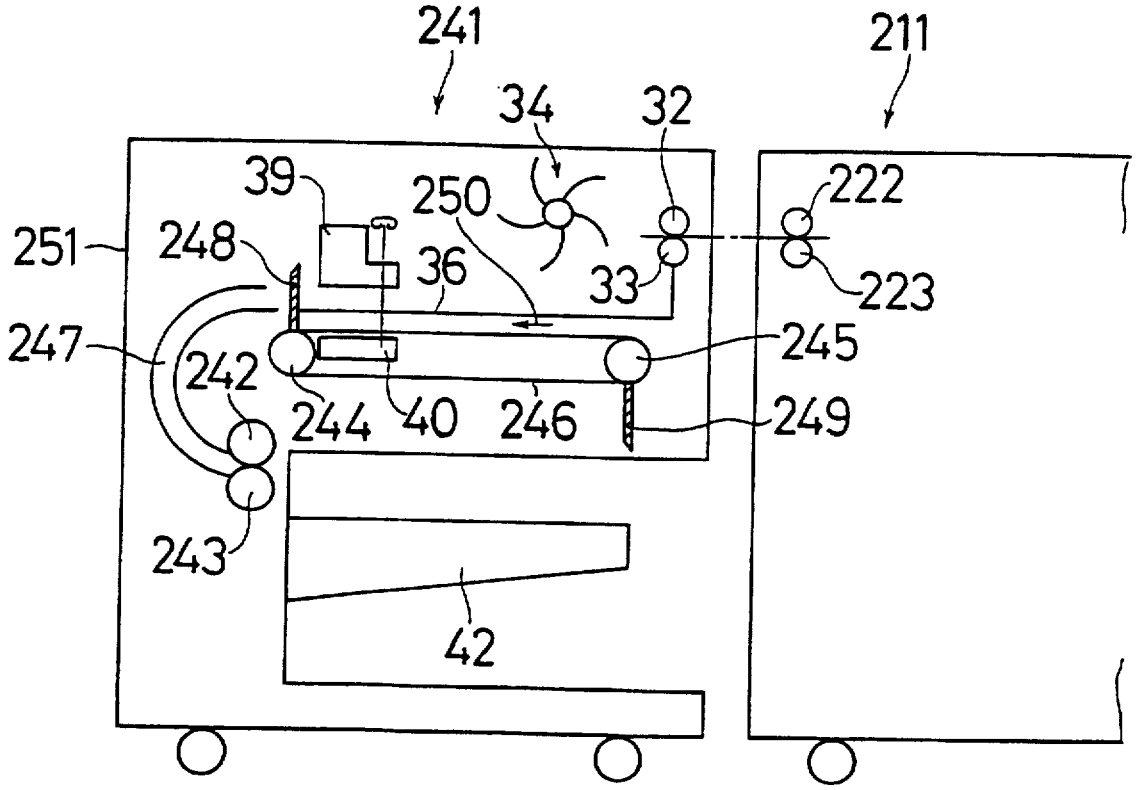
FIG. 44 is a side view showing a construction of a finishing apparatus 241 of a twelfth embodiment of the invention.
Figure 45:
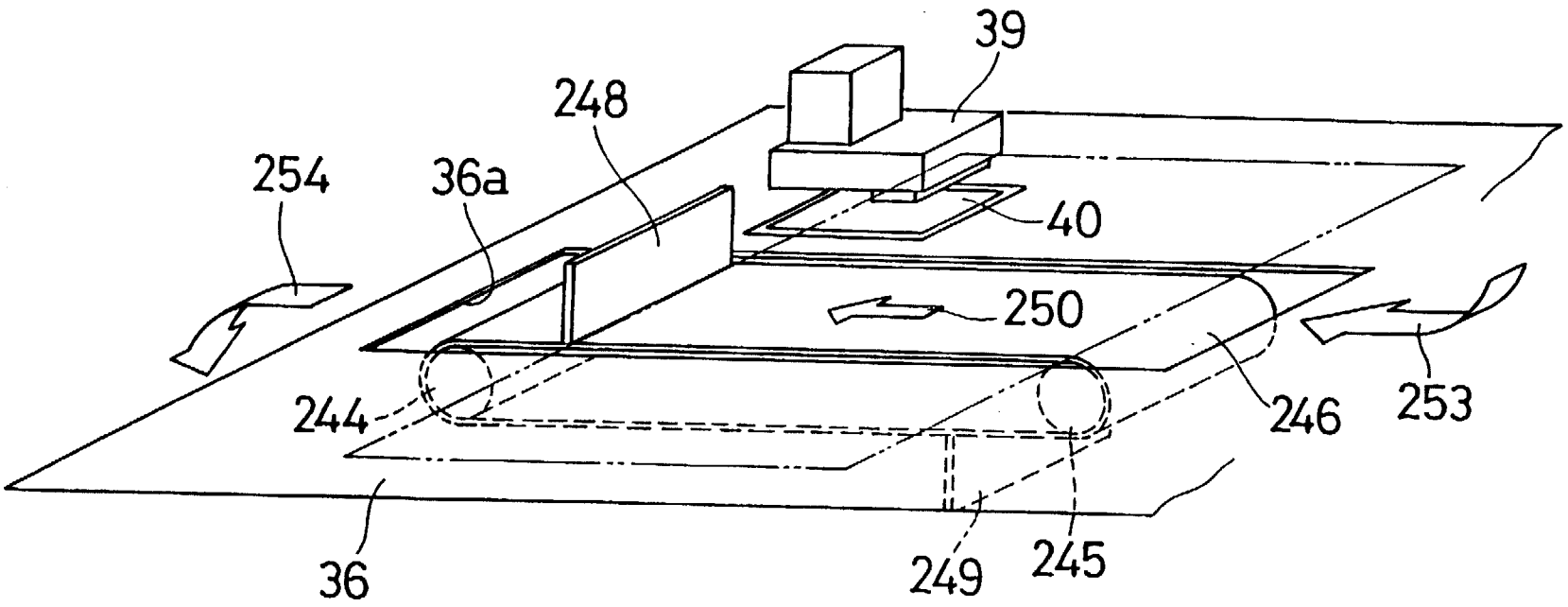
FIG. 45 is a magnified partial perspective view showing a belt 246 to which a gate 35 is attached.

FIG. 44 is a side view showing a construction of a finishing apparatus 241 of a twelfth embodiment of the invention. FIG. 45 is a magnified partial perspective view showing a belt 246 to which the gate 35 is attached.

The finishing apparatus 241 according to the embodiment comprises conveying rollers 32, 33, paddler 34, support plate 36, upper stapling unit 39 and lower stapling unit 40 similar to those of the stapling apparatus 31 described in the first embodiment, and further comprises discharge rollers 242, 243, belt 246 to which two projecting pieces 248, 249 are attached and rollers 244, 245. The projecting pieces 248, 249 in the embodiment serve as a gate and pusher. When a projecting piece 248 serves as a gate, the other projecting piece 249 serves as a pusher. The belt 246 is wound about the rollers 244, 245.

Recording paper 43 discharged by discharge rollers 222, 223 of a copying machine 211 to which the finishing apparatus 241 is attached is conveyed by the conveying rollers 32, 33 and paddler 34 of the finishing apparatus 241, and fed to a stapled sheaf production area for producing a stapled sheaf of recording paper 44. The recording paper 43 fed thereto is held by the support plate 36. The support plate 36 is formed with a window **36*a* for allowing the projecting pieces 248, 249 to project from a support surface of the support plate 36. A downstream end in the conveying direction of the recording paper 43 abuts against a projecting piece 248 projecting through the window 36*a*, aligned, and held. In such operation, the other projecting piece 249 projects from a surface opposite to the support surface of the support plate 36. The upper and lower stapling units 39, 40 positioned above and below the support plate 36 between them, respectively, are put in action when the number of the recording paper 43 held reaches a predetermined number, and produce a stapled sheaf of recording papers 44 by stapling the recording papers 43**.

After the stapled sheaf of recording papers 44 is produced, the rollers 244, 245 are rotated, and the belt 246 is moved in the direction 250. Thus, an upstream end in the conveying direction of the recording paper 44 on the support plate 36 abuts against the projecting piece 249. By further movement of the belt 246, the sheaf of recording papers 44 is pushed by the projecting piece 249 serving as a pusher. The sheaf of recording papers 44 is conveyed along the conveying path 247 so curved that the sheaf of recording papers 44 is conveyed in the direction 254 opposite to the feeding direction 253 of the recording paper 43, and discharged to the discharge tray 42 by the discharge rollers 242, 243.

A length of the belt 246 and position of the projecting pieces 248, 249 are selected according to a size of the recording paper 43. In other words, they are designed such that the other projecting piece 249 does not project form the support surface, when a projecting piece 248 projects from the support surface, considering a maximum size of recording paper 43 to be bound. Further, the projecting pieces 248, 249 are attached to such positions that the belt 246 is evenly divided lengthwise. As a result, sufficient function as a gate and that as a pusher can be achieved.

The conveying rollers 32, 33, support plate 36, upper stapling unit 39, lower stapling unit 40, belt 246 with the projecting pieces 248, 249, rollers 244, 245, discharge rollers 242, 243 and conveying path 247 described above are covered by a housing 251. The housing 251 is provided at least with an inlet for feeding the recording paper 43 and an outlet for discharging the sheaf of recording papers 44.

The finishing apparatus 241 is further provided with joggers 37, 38 similar to those of the first embodiment, although they are not shown. A home position sensor for detecting whether the projecting pieces 248, 249 are in predetermined positions and a driving motor for driving the roller 244 are also provided.

The support plate 36 is formed with windows 30*b*, 30*c* for movement of the joggers 37, 38 and a window 30*d* for the stapling units 39, 40.

Figure 46:
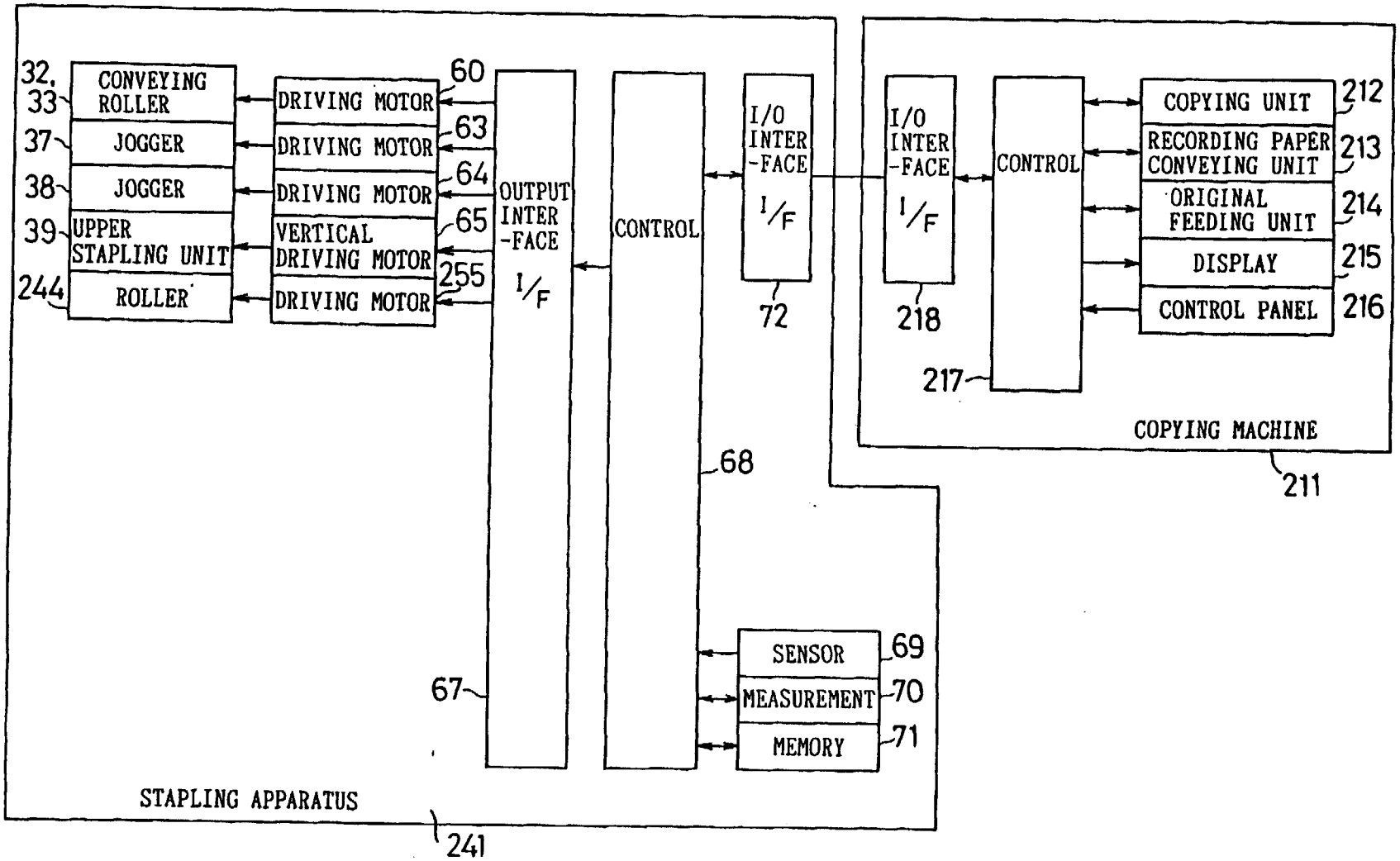
FIG. 46 is a block diagram showing an electrical structure of the finishing apparatus 241.

FIG. 46 is a block diagram showing an electrical structure of the finishing apparatus 241. The finishing apparatus 241 is generally constructed similarly to the stapling apparatus 31, comprises a driving motor 60, 63 to 65 for driving, respectively, the conveying rollers 32, 33, joggers 37, 38 and upper stapling unit 39 described above, and further comprises a driving motor 255 for driving a driving roller of the rollers 244, 245, for example, the roller 244. The paddler 34, gate 35, pusher 41, driving motor 61, solenoid 62 and driving motor 66 for driving them are not included. Otherwise, it is constructed similarly to the stapling apparatus 31, and similar members are shown by identical reference numerals.

Figure 47:
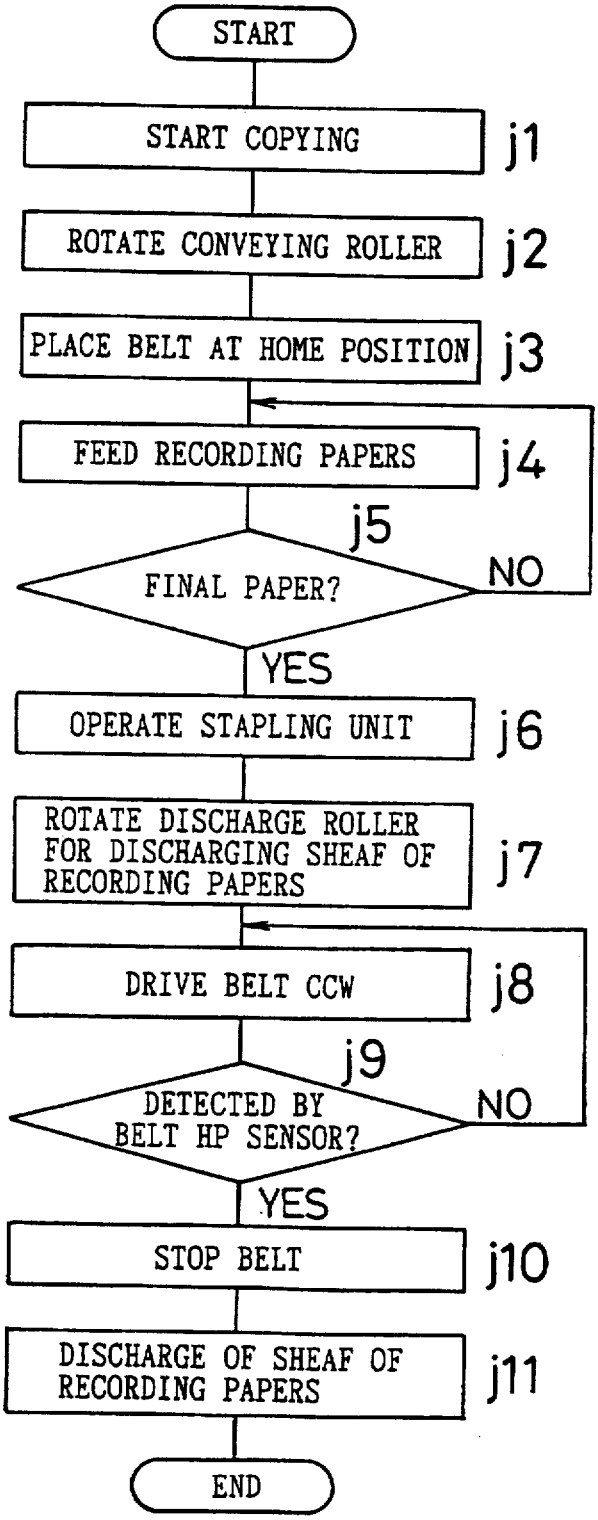
FIG. 47 is a flowchart showing operations of the finishing apparatus 241.

FIG. 47 is a flowchart showing operations of the finishing apparatus 241. In step jl, initiation of a copying operation is instructed through a control panel 216 of a copying machine 211, and the copying operation is initiated. In step j2, the conveying rollers 32, 33 of the finishing apparatus 241 start rotating. In step j3, the belt 246 is moved, and the projecting pieces 248, 249 attached to the belt 246 are placed at predetermined home positions.

In step j4, recording paper 43 is fed. In step j5, it is determined whether the fed recording paper 43 is a final one or not, and the sequence is proceeded to step j6, if it is a final one, while the sequence is returned to step j4, if it is not. In step j6, the upper and lower stapling units 39, 40 are put in action, and a stapled sheaf of recording papers 44 is produced. In step j7, the discharge rollers 242, 243 for discharging the sheaf of recording papers 44 are rotated. In step j8, the roller 244 is rotated, and the belt 246 is moved in the direction 250. In step j9, it is detected whether the belt 246 is moved over a predetermined length. The sequence is proceeded to step j10, if it is moved, while the sequence is returned to step j8, if it isn't. In step j10, rotation of the roller 244 is discontinued, and movement of the belt 246 is stopped. In step jll, the sheaf of recording papers 44 is discharged to the discharge tray 42.

As described, according to the twelfth embodiment, use of the pusher 41 described in the first to tenth embodiments is not required, and a reciprocating movement of the pusher 41 in the first to tenth embodiments is eliminated, because the projecting piece 249 functioning as a pusher for discharging the sheaf of recording papers 44 acts as a gate for producing the next stapled sheaf of recording papers 44 after the stapled sheaf of recording papers 44 is discharged. Thus, construction of the finishing apparatus 241 is simplified, the projecting pieces 248, 249 functioning as a gate and pusher can be operated only by controlling rotation of the roller 244, and a simple control is achieved. The recording paper 43 and the sheaf of recording papers 44 can be conveyed efficiently as in the case of the embodiments. A stapling position of the recording paper 43 can be also selected simply by changing positions of the projecting pieces 248, 249.

Although two projecting pieces 248, 249 are attached to the belt 246 in the embodiment, three or more projecting pieces may be employed. The number of such projecting pieces are determined by a length along the conveying direction of the recording paper and a length of the belt 246, and the length along the conveying direction of the recording paper constitutes a minimum interval between the projecting pieces. In the case of providing three projecting pieces, for example, feeding of the recording paper and discharge of the sheaf of recording papers can be efficiently achieved.

Figure 48:
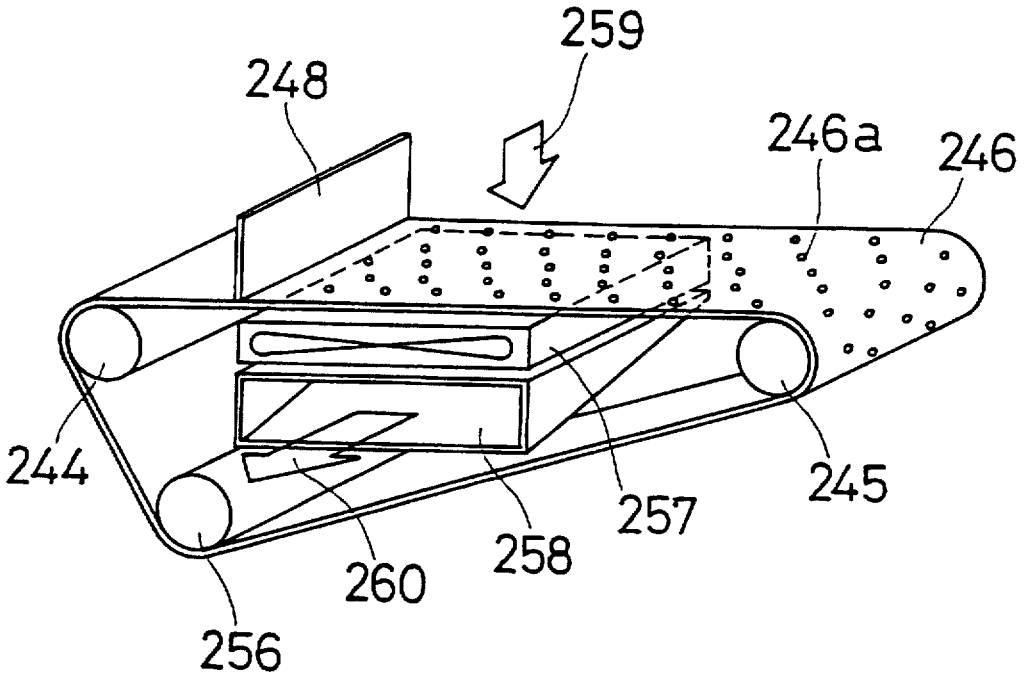
FIG. 48 is a perspective view showing another example of the belt 246 of a thirteenth embodiment of the invention.

FIG. 48 is a perspective view showing another example of the belt 246, which constitutes a thirteenth embodiment of the invention. The belt 246 has a projecting piece 248 attached thereto, and plural through holes 246*a* are formed therein. The belt 246 is wound about three rollers 244, 245, 256. An air fan 257 and an air duct 258 are provided between the belt 246 wound about the rollers 244, 245, 256. The air fan 257 suctions the air through the through hole 246*a* in the direction shown by an arrow 259, that is, from outside toward inside of the belt 246. The air duct 258 discharges the suctioned air in the direction shown by an arrow 260, that is, toward outside of the belt 246.

Figure 49:
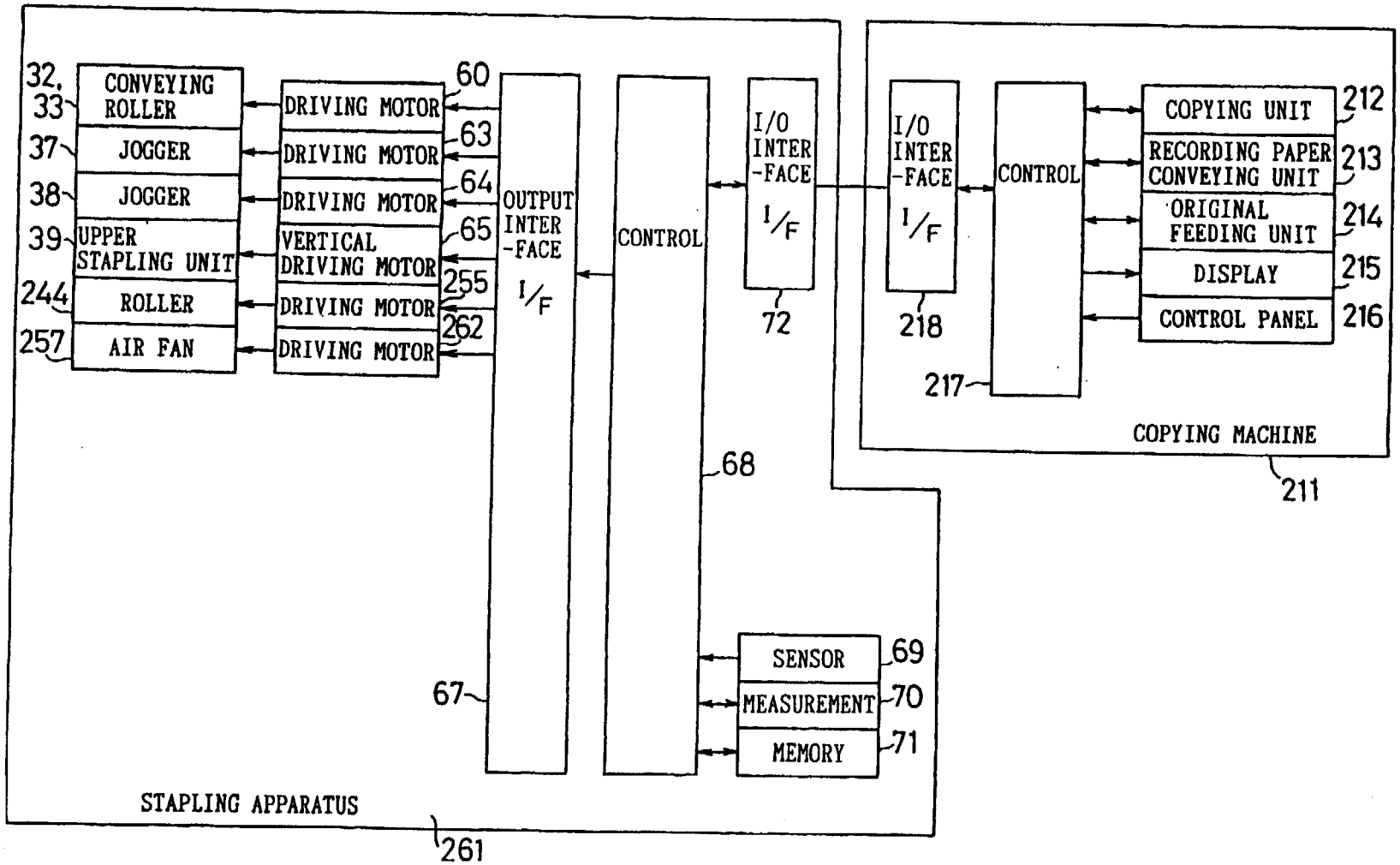
FIG. 49 is a block diagram showing an electrical structure of a finishing apparatus 261 with the belt 246.

FIG. 49 is a block diagram showing an electrical structure of a finishing apparatus 261 with the belt 246. The finishing apparatus 261 corresponds to the finishing apparatus 241 with the air fan 257 and driving motor 262 for driving the fan added thereto.

Figure 50:
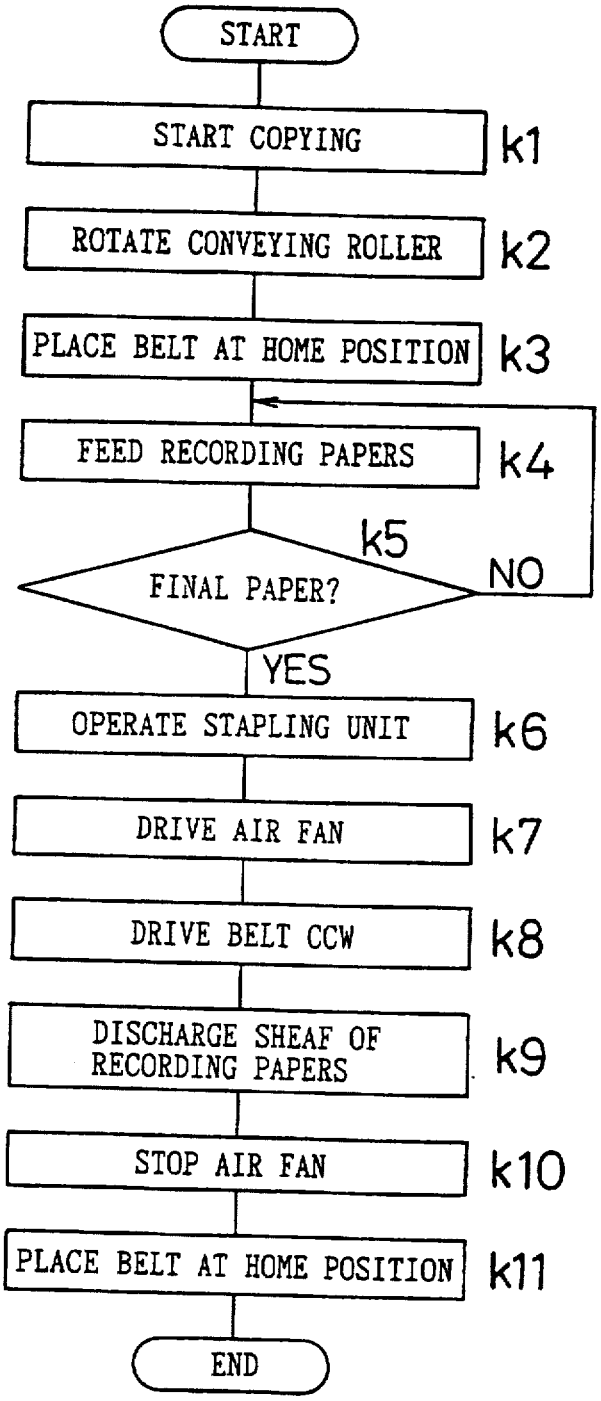
FIG. 50 is a flowchart showing operations of the finishing apparatus 261.
Figure 51:
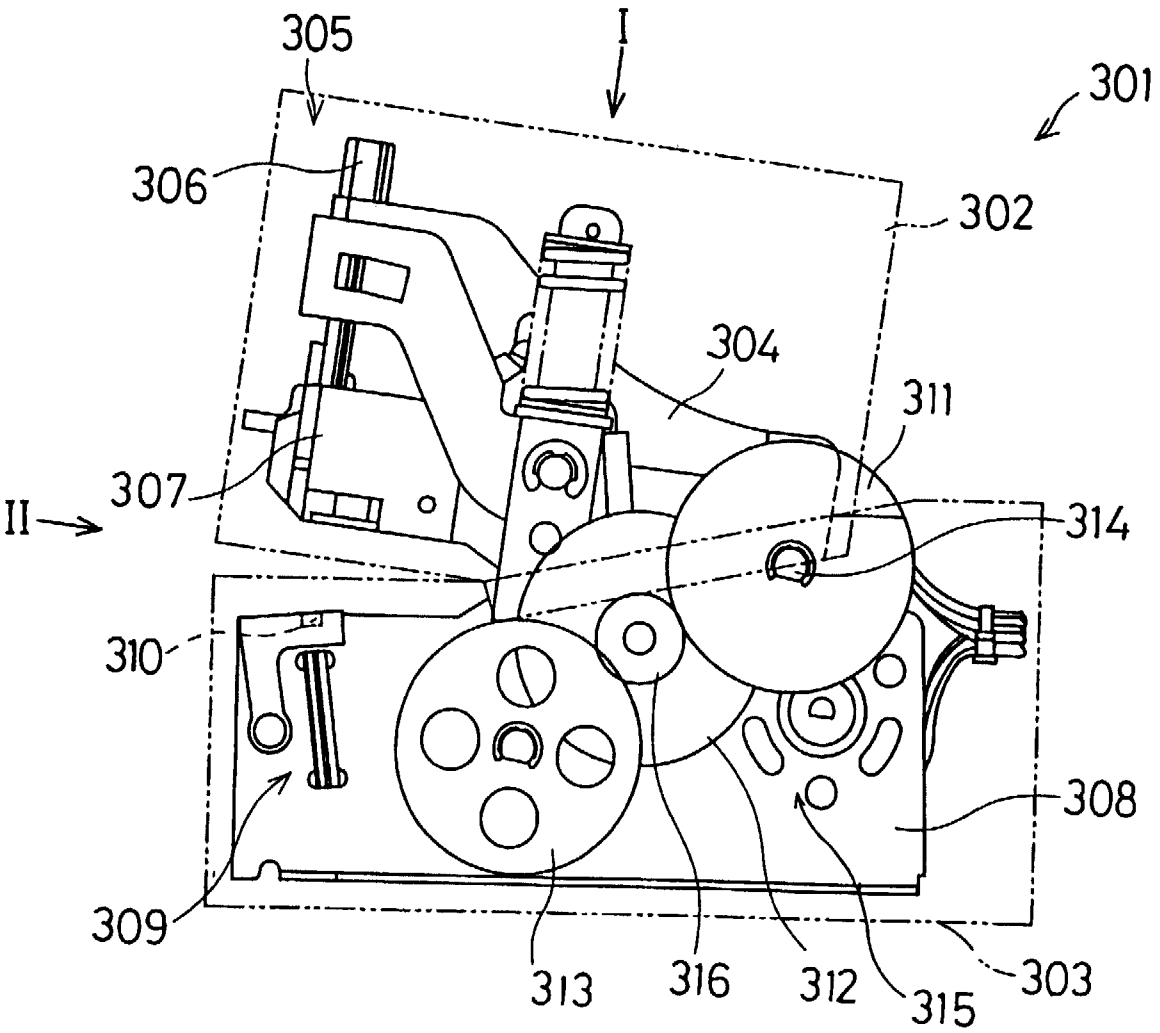
FIG.51 PRIOR ART
FIG. 51 is a side view showing a construction of a stapling apparatus 301 of prior art.
Figure 52:
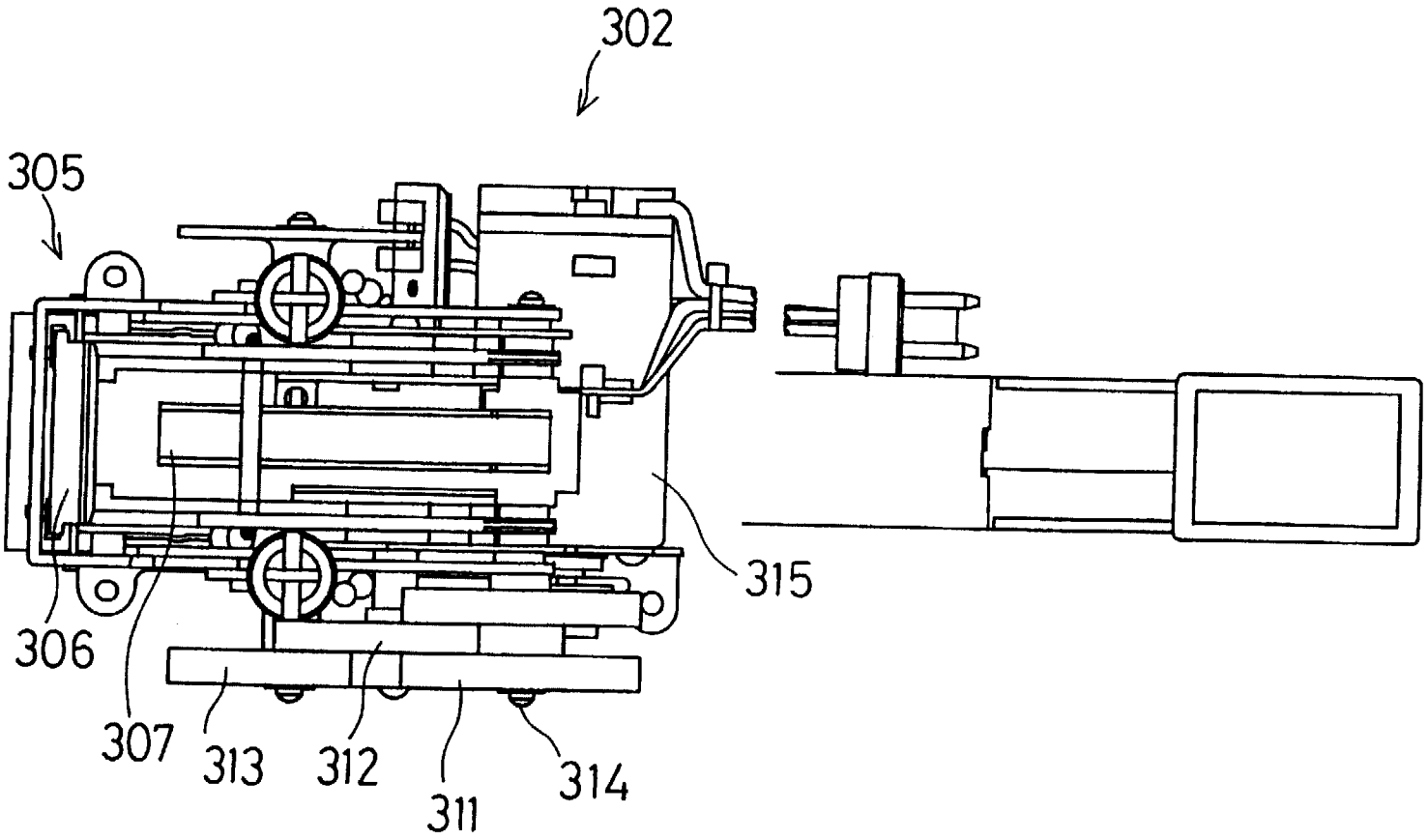
FIG.52 PRIOR ART
FIG. 52 is a plan view showing the stapling apparatus 301.
Figure 53:
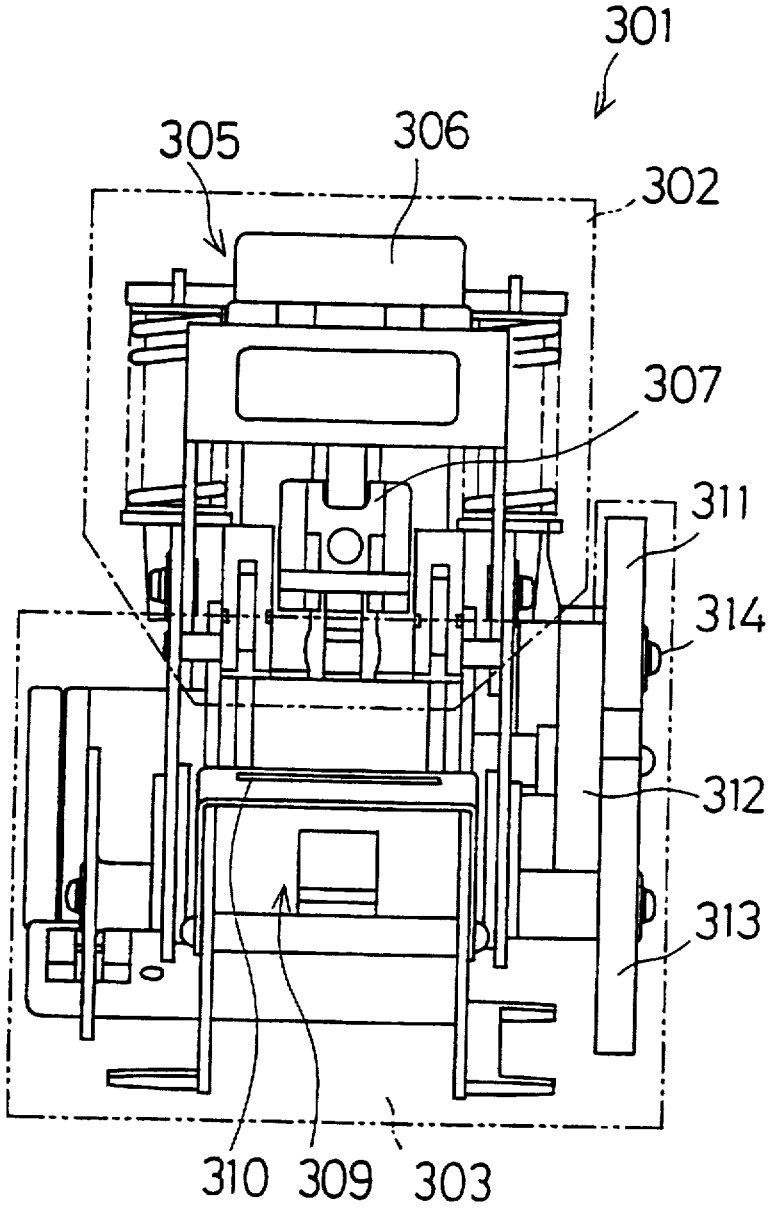
FIG.53 PRIOR ART
FIG. 53 is a front view showing the stapling apparatus 301.
Figure 54:
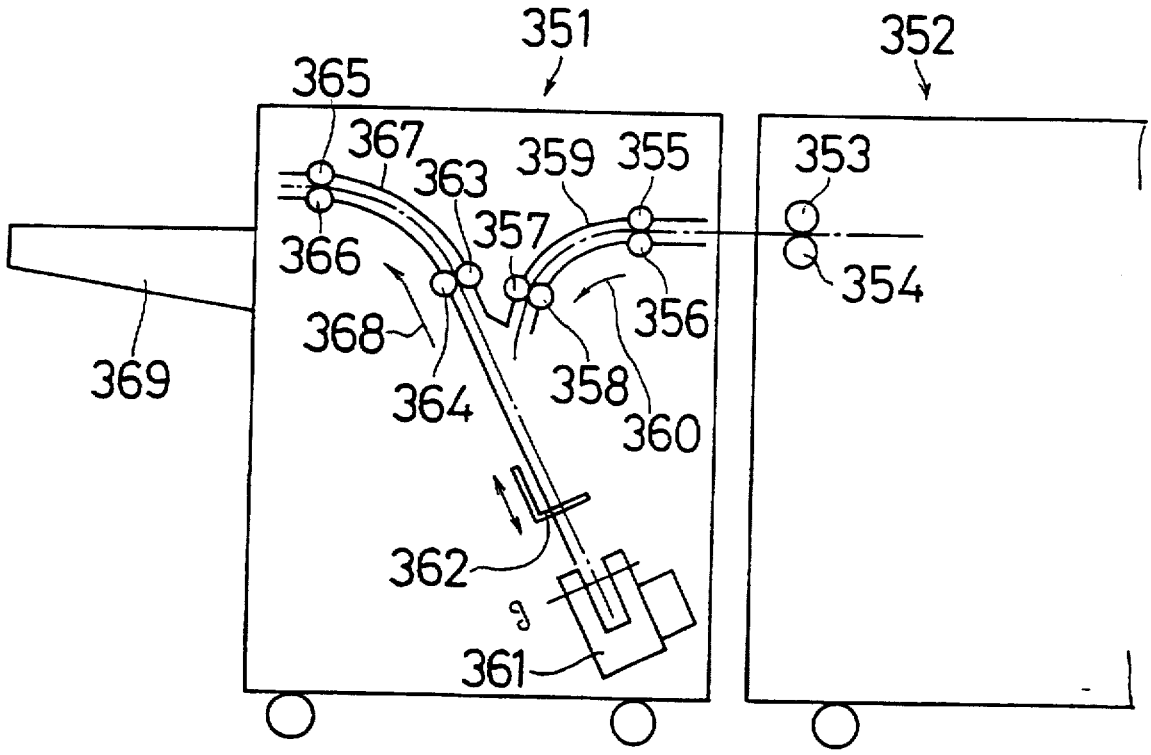
FIG.54 PRIOR ART
FIG. 54 is a side view showing a construction of a finishing apparatus 351 of prior art.
Figure 55:
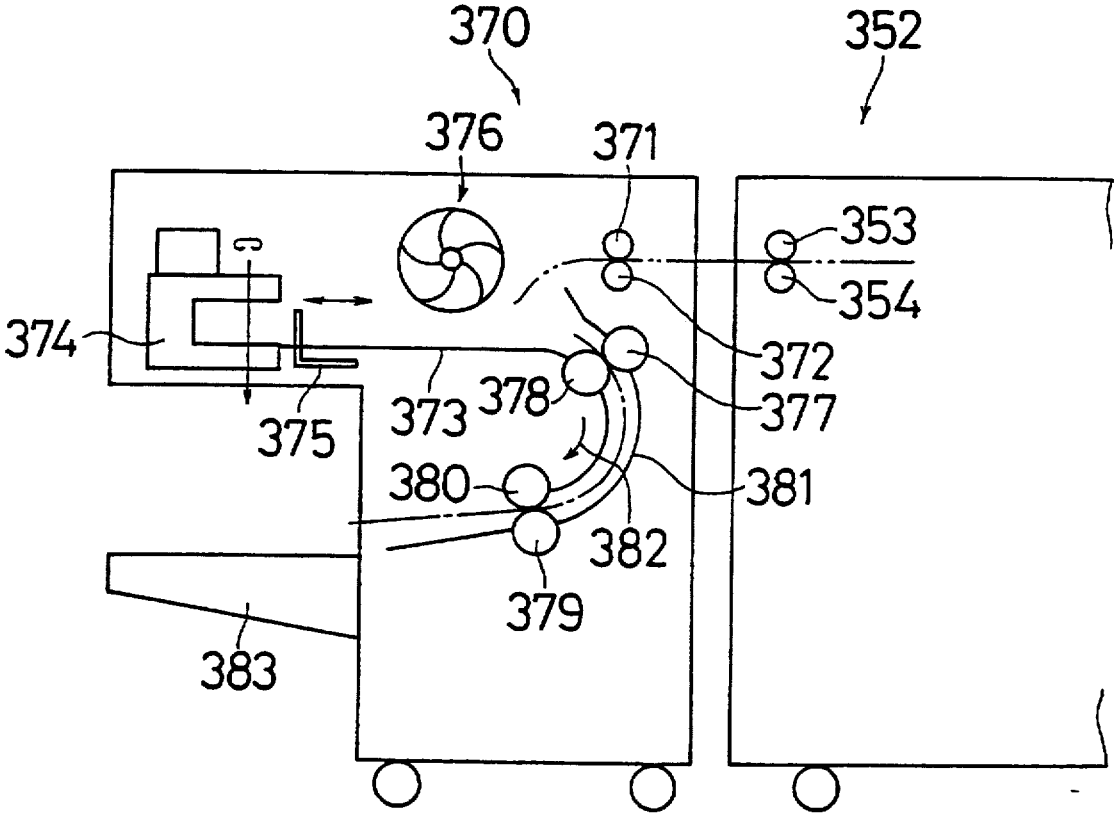
FIG.55 PRIOR ART
FIG. 55 is a side view showing a construction of another finishing apparatus 370 of prior art.
Figure 56:
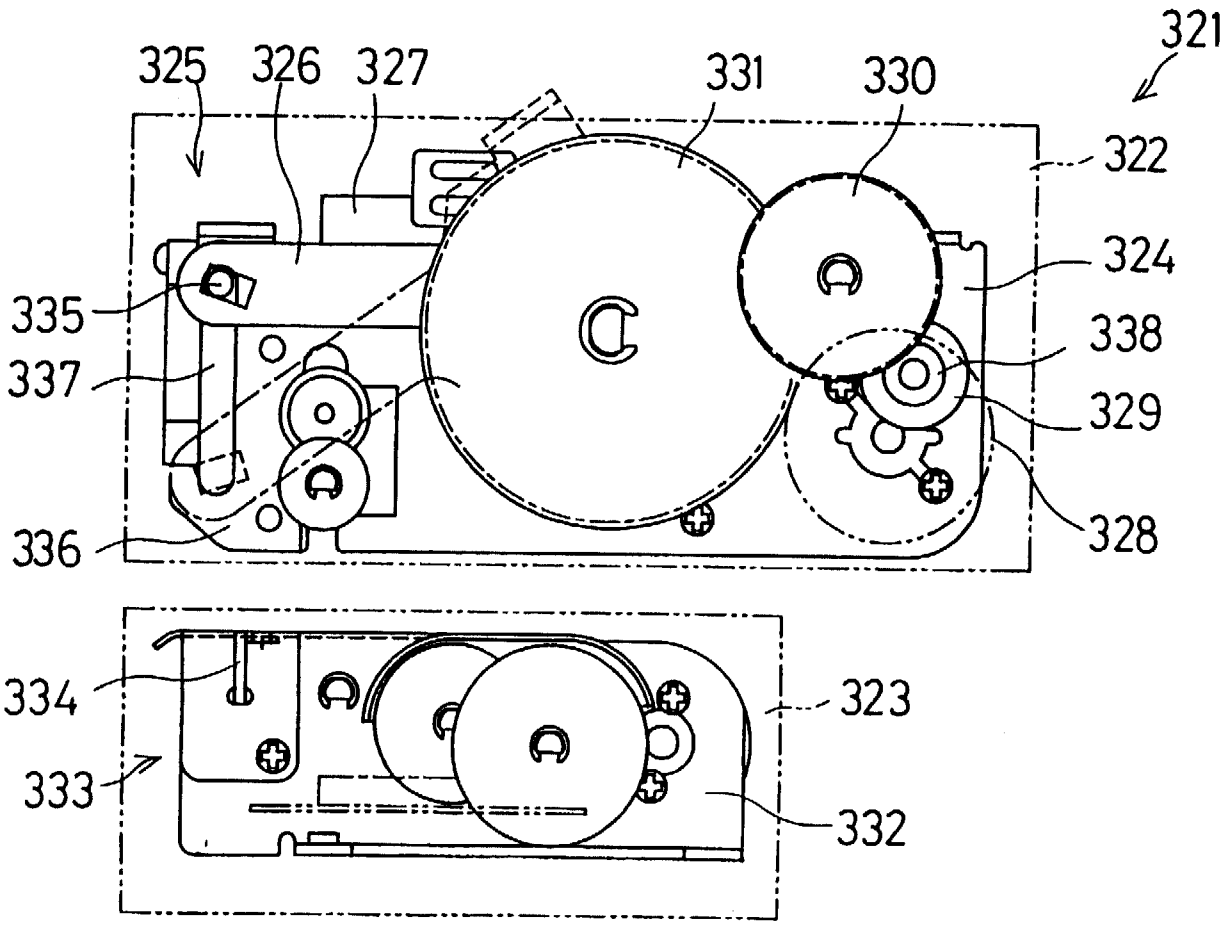
FIG.56 PRIOR ART
FIG. 56 is a side view showing a construction of the other stapling apparatus 321 of prior art.

FIG. 50 is a flowchart showing operations of the finishing apparatus 261. It is constructed similarly to the finishing apparatus 241 except the vicinity of the belt 246, and the operations are explained by referring to FIG. 44. In step k1, initiation of a copying operation is instructed through a control panel 216 of a copying machine 211, and the copying operation is initiated. In step k2, conveying rollers 32, 33 of the finishing apparatus 261 start rotating. In step k3, the belt 246 is moved, and a projecting piece 248 attached to the belt 246 is placed at a predetermined home position.

In step k4, recording paper 43 is fed. In step k5, it is determined whether the fed recording paper 43 is a final one or not, and the sequence is proceeded to step k6, if it is a final one, while the sequence is returned to step k4, if it isn't. In step k6, upper and lower stapling units 39, 40 are put in action, and a stapled sheaf of recording papers 44 is produced. In step k7, the air fan 257 is put in action. Discharge rollers 242, 243 for discharging the sheaf of recording papers 44 are also rotated.

In step k8, a roller 244 is rotated, and the belt 246 is moved in the direction 250 over a predetermined length. In step k9, the sheaf of recording papers 44 is discharged to a discharge tray 42. In step k10, operation of the air fan 257 is discontinued. In step k11, the belt 246 is moved in the direction 250 over a predetermined length, and the projecting piece 248 is placed again at the predetermined home position after a complete cycle.

As described above, according to the thirteenth embodiment, the stapled sheaf of recording papers 44 is discharged as it is adhered to the belt 246. Therefore, single projecting piece 248 can be employed, and construction of the belt 246 is simplified in comparison with that of the twelfth embodiment. A stapling position of the recording paper 43 can be selected simply by selecting a position of the projecting piece 248.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A stapling apparatus for producing a stapled sheaf of recording papers by stapling plural recording papers, the stapling apparatus comprising:

holding means for stacking and holding recording papers fed into a stapled sheaf production area for producing a stapled sheaf of recording papers, aligning means having a projecting piece angularly displaceable such that the projecting piece projects from a holding face of the holding means, recording paper conveying means for conveying the sheaf of the recording papers in such manner that the downstream end of the sheaf of the recording papers in the recording paper conveying direction abuts against the projecting piece projecting from the holding face of the holding means, stapling means including a driving-side stapling unit provided with a drive member for driving a staple from one surface of the sheaf of the plural recording papers held by the holding means and a bending-side stapling unit separated from the driving-side stapling unit and provided with a bending member for bending a tip portion of the driven staple projecting outside from the other surface of the sheaf of the plural recording papers, discharge means for discharging the sheaf of the recording papers from the stapled sheaf production area in the discharging direction parallel to the feeding direction to the stapled sheaf production area, after the sheaf of the recording papers is stapled and the tip portion of the staple projecting outside from the other surface of the sheaf of the recording papers is bended, and control means for allowing the projecting piece to project from the holding face of the holding means at selected one from plural alignment positions preset in the stapled sheaf production area according to a distance between the downstream end of the sheaf of the recording papers in the recording paper conveying direction and a stapling position of the recording papers, activating the stapling means to staple a predetermined number of recording papers to produce a stapled sheaf when the predetermined number of recording papers are held by the holding means, and driving the discharge means.

2. The stapling apparatus of claim 1, wherein the stapling means is provided at each of plural stapling positions preset in the direction orthogonal to the recording paper conveying direction, and the control means activates the stapling means provided at selected one from the plurality of preset stapling positions, when a predetermined number of recording papers are held by the holding means.

3. The stapling apparatus of claim 1, further comprising:

driving means for moving the driving-side and bending-side stapling units of the stapling means in synchronization with each other in the direction orthogonal to the recording paper conveying direction, wherein the control means drives the driving means to move the stapling means to one selected from the plurality of stapling positions preset in the direction orthogonal to the recording paper conveying direction when a predetermined number of recording papers are held by the holding means, and then activates the stapling unit.

4. The stapling apparatus of claim 1, the stapling apparatus further comprising driving means for moving the stapling unit on one side of the bending side and the driving side of the stapling means, wherein the stapling unit on the other side of the driving side and the bending side of the stapling means is provided in each of plural stapling positions preset in the direction orthogonal to the recording paper conveying direction, and when a predetermined number of recording papers are held by the holding means, the control means drives the driving means to move the staple unit on the one side to one stapling position selected from the plurality of preset stapling positions, and then activates the stapling unit on the one side and the stapling unit on the other side, provided at the selected stapling position.

5. The stapling apparatus of claim 1, the stapling apparatus further comprising a belt to which a projecting piece of the alignment means and a projecting piece of the discharge means are attached, located in the side opposite to the holding face of the holding means, and plural rollers about which the belt is wound, wherein the projecting piece of the discharge means is angularly displaceable so as to project from the holding face of the holding means, and the control means drives the rollers so that one of the projecting pieces is positioned so as to project from the holding face of the holding means at a predetermined alignment position, activates the stapling means to form a stapled sheaf of recording papers when a predetermined number of recording papers are held by the holding means, activates the rollers again to allow a projecting piece different from that placed at the alignment position to abut against an upstream end in the conveying direction of the stapled sheaf of recording papers after the stapled sheaf of recording papers is produced, and pushes the stapled sheaf of recording papers for discharging.

6. The stapling apparatus of claim 1, wherein the holding means includes a belt having plural through holes to which the projecting piece of the alignment means is attached and plural rollers about which the belt is wound, the discharge means includes air sucking means placed in a space inside the belt wound about the plural rollers for sucking the air outside the belt through the plural through holes in the belt, and the control means drives the rollers, positions them so that the projecting piece projects from the holding face of the holding means at a predetermined alignment position, activates the stapling means so that a predetermined number of recording papers are stapled to form a stapled sheaf of recording papers when the predetermined number of recording papers are held by the holding means, and then activates the air sucking means, while driving the roller again.

7. The stapling apparatus of claim 1, wherein the aligning means includes a pair of alignment means movable in the direction orthogonal to the recording paper conveying direction for aligning the recording paper by abutting against mutually opposite ends parallel to the conveying direction of the recording paper, respectively; and wherein the control means includes allowing the pair of alignment means to abut against the mutually opposite ends parallel to the recording paper conveying direction every time when the recording paper is fed and moving the pair of alignment means by a predetermined length in a same direction, when a predetermined number of recording papers are held by the holding means, while alignment of the recording papers is maintained.

8. The stapling apparatus of claim 1, further comprising a first driving means for moving the first driving-side and bending-side stapling units of the stapling means in synchronization with each other in the direction parallel to the recording paper conveying direction, and wherein the control means includes driving the first driving means to move the stapling means to a stapling position selected from plural stapling positions preset in the direction parallel to the recording paper conveying direction when a predetermined number of recording papers are held by the holding means.

9. The stapling apparatus of claim 1, further comprising a projecting piece positioned orthogonal to a holding face of the holding means in a lower side of the holding means and movable to be closer to and apart from the holding face of the holding means; and wherein the holding means is positioned at a predetermined angle to the horizontal direction; and the control means includes moving the projecting piece closer to the holding face of the holding member, activating the stapling means so that the recording papers are stapled to form a stapled sheaf of recording papers when a predetermined number of recording papers are held by the holding member, and moving the projecting piece apart from the holding face of the holding means.

* * * * *